US006297587B1

(12) United States Patent
Kikuchi et al.

(10) Patent No.: US 6,297,587 B1
(45) Date of Patent: Oct. 2, 2001

(54) COLOR CATHODE FIELD EMISSION DEVICE, COLD CATHODE FIELD EMISSION DISPLAY, AND PROCESS FOR THE PRODUCTION THEREOF

(75) Inventors: Kazuo Kikuchi; Shinji Kubota, both of Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/357,367

(22) Filed: Jul. 20, 1999

(30) Foreign Application Priority Data

| | | |
|---|---|---|
| Jul. 23, 1998 | (JP) | 10-2507850 |
| Sep. 2, 1998 | (JP) | 10-248827 |
| Dec. 14, 1998 | (JP) | 10-354660 |
| Jul. 14, 1999 | (JP) | 11-200221 |

(51) Int. Cl.[7] ..... H01J 9/02
(52) U.S. Cl. ..... 313/495; 313/309
(58) Field of Search ..... 313/493, 494, 313/495, 309; 445/24, 50

(56) References Cited

U.S. PATENT DOCUMENTS

| | | | | |
|---|---|---|---|---|
| 5,136,764 | | 8/1992 | Vasquez . | |
| 5,151,061 | * | 9/1992 | Sandhu | 445/24 |
| 5,249,340 | | 10/1993 | Kane et al. . | |
| 6,019,658 | * | 2/2000 | Ludwig et al. | 445/24 |

FOREIGN PATENT DOCUMENTS

| | | |
|---|---|---|
| 0545621 A1 | 11/1992 | (EP) . |
| 0 545 621 | 6/1993 | (EP) . |
| 0668603 A1 | 2/1995 | (EP) . |
| 0 668 603 | 8/1995 | (EP) . |
| 0724280 A1 | 1/1996 | (EP) . |
| 0 724 280 | 7/1996 | (EP) . |
| 0834897 A1 | 10/1996 | (EP) . |
| 0 834 897 | 4/1998 | (EP) . |
| 09134664 | 5/1997 | (JP) . |
| 9-139173 | 5/1997 | (JP) . |
| 95 07543 | 3/1995 | (WO) . |
| 97 47021 | 12/1997 | (WO) . |
| WO 97/47021 | 12/1997 | (WO) . |

* cited by examiner

*Primary Examiner*—Kenneth J. Ramsey
(74) *Attorney, Agent, or Firm*—Ronald P. Kananen; Rader, Fishman & Grauer

(57) ABSTRACT

A process for the production of a cold cathode field emission device comprising the steps of; (A) forming a patterned electrode layer on a dielectric supporting substrate, (B) forming an insulating interlayer on the dielectric supporting substrate and the electrode layer, (C) forming a gate electrode constituted of a first conductive layer on the insulating interlayer, (D) forming an opening portion which penetrates through at least the insulating interlayer and has a bottom portion where the electrode layer is exposed, (E) forming a side-wall of an insulating material on the side wall of the opening portion, to decrease the opening portion in diameter, (F) forming a second conductive layer on the entire surface including the inside of the opening portion by a physical or chemical vapor deposition method, (G) etching back the second conductive layer to form an emitter electrode shaped in the form of a column and constituted of the second conductive layer in the opening portion, and (H) removing at least an upper portion of the side-wall.

60 Claims, 33 Drawing Sheets

[STEP–140]

[STEP–140] CONTINUED

[STEP–210] CONTINUED

[STEP–230]

[STEP-110]

[STEP-110] CONTINUED

[STEP-120]

[STEP-130]

[STEP-130] CONTINUED

[STEP-140]

[STEP-140] CONTINUED

[STEP-210]

[STEP-210] CONTINUED

[STEP-220]

[STEP-230]

[STEP-310]

[STEP-310] CONTINUED

[STEP-320]

[STEP-320] CONTINUED

[STEP-410]

[STEP-410] CONTINUED

[STEP-420]

[STEP-500]

[STEP-510]

[STEP-520]

[STEP-530]

[STEP-560]

[STEP-620]

[STEP-630]

[STEP-640]

[STEP-650]

[STEP-660]

[STEP-660] CONTINUED

[STEP-670]

[STEP-670] CONTINUED

[STEP-720]

[STEP-730]

[STEP-730] CONTINUED

[STEP-730] CONTINUED

[STEP-740]

[STEP-740] CONTINUED

[STEP-750]

[STEP-820]

[STEP-830]

[STEP-830] CONTINUED

[STEP-830] CONTINUED

[STEP-840]

[STEP-840] CONTINUED

[STEP-850]

[STEP-850] CONTINUED

[STEP-10]

[STEP-20]

[STEP-30]

[STEP-40]

COLOR CATHODE FIELD EMISSION DEVICE, COLD CATHODE FIELD EMISSION DISPLAY, AND PROCESS FOR THE PRODUCTION THEREOF

BACKGROUND OF THE INVENTION AND RELATED ART STATEMENT

The present invention relates to a cold cathode field emission device, a cold cathode field emission display and processes for the production thereof. More specifically, it relates to a cold cathode field emission device having the form of a column, a flat panel type cold cathode field emission display having a plurality of the cold cathode field emission devices arranged in a two-dimensional matrix, and processes for the production thereof.

Studies are being made on various flat panel type displays for an image displaying unit which is to replace currently main-stream cathode ray tubes (CRT). The flat type displays include a liquid crystal display (LCD), an electroluminescence display (ELD) and a plasma display (PDP). Further, there is also proposed a cold cathode field emission display from the viewpoint of a brightness on displaying.

The above cold cathode field emission display (to be sometimes simply referred to as "field emission display" hereinafter) has a plurality of pixels as its conceptual view and is shown in FIG. 33, and each pixel comprises a plurality of Spindt type cold cathode field emission devices (to be sometimes simply referred to as "Spindt type field emission device" hereinafter) arranged in a two-dimensional matrix form. Each Spindt type field emission device comprises a patterned electrode layer (cathode electrode layer) 11, an insulating interlayer 12, a gate electrode 14 formed on the insulating interlayer 12 and an emitter electrode 102 formed in an opening portion formed in the insulating interlayer 12.

For example, the cathode electrode layer 11 is formed on a dielectric supporting substrate 10 constituted of a glass substrate, and the cathode electrode layer 11 is composed, for example, of niobium (Nb). The cathode electrode layer 11 and the dielectric supporting substrate 10 are covered with the insulating interlayer 12. The emitter electrode 102 is a conical tip which is formed on the cathode electrode layer 11 according to a semiconductor production process and has a diameter of approximately 1.0 $\mu$m. The emitter electrode 102 is composed of molybdenum (Mo) or the like. On the top end side of the emitter electrode 102 is provided the gate electrode 14 so as to surround the emitter electrode 102. A voltage is applied between the emitter electrode 102 and the gate electrode 14 to generate an electric field, and due to the electric field, electrons are extracted from the top end of the emitter electrode 102. The electrons are attracted to a second electrode layer (anode electrode layer) 21 formed on a transparent substrate 20 to collide with a fluorescent layer (light emitting layer) 22 formed between the anode electrode layer 21 and the transparent substrate 20, and as a result, the fluorescent layer 22 emits light, and an intended image can be obtained. The performance of the Spindt type field emission device is controlled in principle on the basis of a voltage to be applied to the gate electrode 14. Such a display is disclosed, for example, in U.S. Pat. No. 4,857,161. The process for the production of the Spindt type field emission device disclosed in the above U.S. Patent will be outlined with reference to FIGS. 34A, 34B, 35A and 35B, hereinafter.

[Step-10]

A niobium layer is formed on a dielectric supporting substrate 10 constituted, for example, of a glass substrate, and then the niobium layer is patterned to form an electrode layer (cathode electrode layer) 11. Then, an insulating interlayer 12, for example, of $SiO_2$ is formed on the entire surface by a CVD method. Further, a gate electrode 14 is formed, for example, by forming a metal layer on the insulating interlayer 12 by a CVD method and then patterning the metal layer. Then, an opening portion 15 is formed in the gate electrode 14 by lithography and dry etching methods. Further, the insulating interlayer 12 below the opening portion 15 is etched to form an opening portion 13 in the insulating interlayer 12 (see FIG. 34A).

[Step-20]

Then, a peeling-off layer 100 composed of aluminum is formed on the gate electrode 14 by oblique vapor deposition of aluminum (see FIG. 34B). Aluminum is obliquely vapor-deposited such that sputtered particles of aluminum arrive onto the gate electrode 14 with an angle tilted at approximately 75° with regard to the normal of the gate electrode 14. As a result, aluminum is deposited to form the peeling-off layer 100 having "eaves" extending from an edge portion 15A of the opening portion 15 formed in the gate electrode 14. As a result, the opening portion 15 is decreased in diameter by the peeling-off layer 100.

[Step-30]

Then, a metal layer 101 is formed by vertical vapor deposition of molybdenum, whereby an emitter electrode 102 of molybdenum having a conical tip is formed in a bottom portion of the opening portion 13 (see FIG. 35A).

[Step-40]

Then, the peeling-off layer 100 is peeled off from the surface of the gate electrode 14 by an electrochemical process and a wet process, to selectively remove the metal layer 101 on the gate electrode 14 (see FIG. 35B), whereby a Spindt type field mission device having the structure shown in FIG. 33 an be obtained.

In the Spindt type field emission device having the structure shown in FIG. 35B, the electron emitting characteristic thereof is greatly dependent upon a distance from the edge portion 15A of the opening portion 15 formed in the gate electrode 14 to the top end portion of the emitter electrode 102. And, the above distance is greatly dependent upon the process accuracy of the form of the opening portion 15, upon the dimensional accuracy of the diameter of the opening portion 15 and upon the thickness accuracy of the metal layer 101 formed in [Step-30]. It is therefore required to carry out the formation of the metal layer 101 uniformly all over the entire surface of the dielectric supporting substrate for producing the field emission display having a plurality of Spindt type field emission devices having uniform characteristics. Further, if the metal layer 101 cannot be vertically deposited, the distance from the top end portion of the conical emitter electrode 102 to the gate electrode 14 varies among Spindt type field emission devices. As a result, the image displaying characteristics of the field emission display, such as brightness of an image, vary. However, it is very difficult to vertically deposit the metal layer 101 having a uniform thickness all over the entire surface of a large-area dielectric supporting substrate for producing a large-area field emission display, and not only an in-plane variation of thickness of the metal layer 101 on the dielectric supporting substrate but also a variation of thickness among lots are also liable to occur. Moreover, a large-scale deposition apparatus is required. Further, since it is required to deposit the metal layer 101 having a thickness of approximately 1 $\mu$m or more by a vapor deposition method, the throughput is low.

Furthermore, it is required to form the peeling-off layer 100 by an oblique vapor deposition method. However, it is difficult to accurately form the above peeling-off layer 100 all over the entire surface of the dielectric supporting substrate having a large area, and it is also difficult to accurately deposit the peeling-off layer 100 such that the peeling-off layer 100 extends from the edge portion 15A of the opening portion 15 formed in the gate electrode 14 so as to have "eaves". Further, the formation of the peeling-off layer 100 varies not only in the in-plane of the dielectric supporting substrate but also among lots.

Furthermore, not only it is very difficult to peel off the peeling-off layer 100 all through the entire surface of the glass substrate having a large area for producing the field emission display having a large area, but also the peeling of the peeling-off layer 100 causes a contamination which results in a decrease in the production yield of the field emission displays.

Moreover, since the height of the conical emitter electrode 102 is defined by the thickness of the metal layer 101 mainly, the freedom of design of the emitter electrode 102 is decreased. Furthermore, since there is a difficulty in determining the height of the emitter electrode 102 as required, the insulating interlayer 12 is inevitably decreased in thickness when the distance from the emitter electrode 102 to the gate electrode 14 is decreased. However, when the insulating interlayer 12 is decreased in thickness, the capacitance between the gate electrode 14 and the cathode electrode layer 11 cannot be decreased, so that the load on the electric circuit of the field emission display increases and further there are caused problems that the in-plane uniformity and the image quality of the field emission display are downgraded.

An emitter electrode having the form of a column is disclosed, for example, in JP-A-9-139173. However, the method of forming the emitter electrode disclosed in the above JP-A-9-139173 is entirely different from the method of forming a cold cathode field emission device or a cold cathode field emission display, provided by the present invention. It is also required to form an insulating layer 7 of $SiO_2$ by a Chimney vapor deposition method for forming the emitter electrode, while it is difficult to form the insulating layer 7, with a high accuracy, all over the entire surface of a glass substrate having a large area for producing a field emission display having a large area. Further, it is required to remove part of the insulating layer 7 and part of the gate electrode 8 together by a wet method using a peeling liquid. Not only it is very difficult to remove them from the entire surface of the glass substrate having a large area, but also the peeling causes a contamination.

OBJECT AND SUMMARY OF THE INVENTION

It is therefore an object of the present invention to provide a process for the production of cold cathode field emission devices, which can overcome the problems in the production of conventional Spindt type cold cathode field emission devices and which enables the production of a plurality of cold cathode field emission devices having uniform characteristics simply, a process for the production of a cold cathode field emission display, and a cold cathode field emission device and a cold cathode field emission display produced by the above processes.

The process for the production of a cold cathode field emission device according to a first aspect of the present invention comprises the steps of;

(A) forming a patterned electrode layer on a dielectric supporting substrate, (B) forming an insulating interlayer on the dielectric supporting substrate and the electrode layer, (C) forming a gate electrode constituted of a first conductive layer on the insulating interlayer, (D) forming an opening portion which penetrates through at least the insulating interlayer and has a bottom portion where the electrode layer is exposed, (E) forming a side-wall of an insulating material on the side wall of the opening portion, to decrease the opening portion in diameter, (F) forming a second conductive layer on the entire surface including the inside of the opening portion by a physical or chemical vapor deposition method, (G) etching back the second conductive layer to form an emitter electrode shaped in the form of a column and constituted of the second conductive layer in the opening portion, and (H) removing at least an upper portion of the side-wall.

The process for the production of a cold cathode field emission display according to a first aspect of the present invention for achieving the above object is a process for the production of a cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer, and (d) an emitter electrode disposed on the electrode layer positioned in a bottom portion of an opening portion penetrating through the gate electrode and the insulating interlayer and shaped in the form of a column, each pixel further comprising;

(e) a second electrode layer and a fluorescent layer formed on a transparent substrate opposite to the emitter electrodes, the process comprises the steps of;

(A) forming the patterned electrode layer on the dielectric supporting substrate, (B) forming the insulating interlayer on the dielectric supporting substrate and the electrode layer, (C) forming the gate electrode constituted of a first conductive layer on the insulating interlayer, (D) forming the opening portion which penetrates through at least the insulating interlayer and has a bottom portion where the electrode layer is exposed, (E) forming a side-wall of an insulating material on the side wall of the opening portion, to decrease the opening portion in diameter, (F) forming a second conductive layer on the entire surface including the inside of the opening portion by a physical or chemical vapor deposition method, (G) etching back the second conductive layer to form the emitter electrode shaped in the form of a column and constituted of the second conductive layer in the opening portion, (H) removing at least an upper portion of the side-wall, and (I) attaching and bonding the transparent substrate on which the fluorescent layer and the second electrode layer are formed and the dielectric supporting substrate to each other.

The cold cathode field emission device according to a first aspect of the present invention for achieving the above object comprises;

(a) a patterned electrode layer formed on a dielectric supporting substrate, (b) an insulating interlayer which is formed on the dielectric supporting substrate and the electrode layer, (c) a gate electrode formed on the insulating interlayer and constituted of a first conductive layer, and (d) an emitter electrode disposed on the electrode layer positioned in a bottom portion of an opening portion penetrating through the gate electrode and the insulating interlayer and shaped in the form of a column, the emitter electrode being formed, after the gate electrode is formed on the insulating interlayer, by forming the opening portion which penetrates through at least the insulating interlayer and has the bottom portion where the electrode layer is exposed; forming a side-wall of an insulating material on the side wall of the opening portion, to decrease the opening portion in diameter; forming a second conductive layer on the entire surface including the inside of the opening portion by a physical or chemical vapor deposition method; etching back the second conductive layer; and then, removing at least an upper portion of the side-wall.

The cold cathode field emission display according to a first aspect of the present invention for achieving the above object is a cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer and constituted of a first conductive layer, and (d) an emitter electrode disposed on the electrode layer positioned in a bottom portion of an opening portion penetrating through the gate electrode and the insulating interlayer and shaped in the form of a column, each pixel further comprising;

(e) a second electrode layer and a fluorescent layer formed on a transparent substrate opposite to the emitter electrodes, the emitter electrode being formed, after the gate electrode is formed on the insulating interlayer, by forming the opening portion which penetrates through at least the insulating interlayer and has the bottom portion where the electrode layer is exposed; forming a side-wall of an insulating material on the side wall of the opening portion, to decrease the opening portion in diameter; forming a second conductive layer on the entire surface including the inside of the opening portion by a physical or chemical vapor deposition method; and then, etching back the second conductive layer.

In the process for the production of the cold cathode field emission device or the process for the production of a cold cathode field emission display according to the first aspect of the present invention, preferably, at least an upper portion of the side-wall is removed in the above step (H) such that no side-wall is present on an imaginary line segment connecting the top surface of the emitter electrode and the edge portion of the opening portion formed in the gate electrode. In the cold cathode field emission device or the cold cathode field emission display according to the first aspect of the present invention, preferably, no side-wall is present on an imaginary line segment connecting the top surface of the emitter electrode and the edge portion of the opening portion formed in the gate electrode. In these configurations, an electric field can be reliably generated when a voltage is applied between the emitter electrode and the gate electrode. In these configurations, preferably, the end portion of the opening portion formed in the gate electrode is projected over the upper end portion of the opening portion formed in the insulating interlayer, whereby the end portion of the opening portion formed in the gate electrode is exposed so that an electric field can be more easily formed.

Further, in the cold cathode field emission device, the cold cathode field emission display or the processes for the production thereof according to the first aspect of the present invention, there may be employed an embodiment in which an acute-angled portion is formed on the top surface of the emitter electrode by etching back the second conductive layer, and the acute-angled portion is constituted of a surface spreading from a pit formed in the central portion of the top surface to a peripheral portion of the top surface and a side surface of the emitter electrode.

Otherwise, in the process for the production of a cold cathode field emission device or the process for the production of a cold cathode field emission display according to the first aspect of the present invention, there may be employed an embodiment in which, the above step (G) comprises the steps of forming a mask material layer on the entire surface; partly removing the mask material layer to leave the mask material layer on the second conductive layer above the opening portion formed in the insulating interlayer; and then, etching back the second conductive layer to form, in the opening portion, the emitter electrode (i.e., emitter electrode whose top surface has a conical form) which has the form of a column, is constituted of the second conductive layer and has an acute-angled portion formed on its top surface, and the acute-angled portion being constituted of a tip end surface projecting toward the central portion of the top surface. In this embodiment, desirably, the second conductive layer is etched back under conditions where the etching rate of the second conductive layer is higher than the etching rate of the mask material layer. When the etching rate of the mask material layer is 1, desirably, the etching rate of the second conductive layer is at least 1.5, preferably at least 2, more preferably at least 3. This point is also applicable in explanations to be made hereinafter.

In the cold cathode field emission device or the cold cathode field emission display according to the first aspect of the present invention, there may be employed an embodiment in which an acute-angled portion is formed on the top surface of the emitter electrode, the acute-angled portion is constituted of a tip end surface projecting toward the central portion of the top surface, and the emitter electrode (i.e., emitter electrode whose top surface has a conical form) is formed, after the second conductive layer is formed on the entire surface including the inside of the opening portion by a physical or chemical vapor deposition method, by forming a mask material layer on the entire surface; partly removing the mask material layer to leave the mask material layer on the second conductive layer above the opening portion formed in the insulating interlayer; etching back the second conductive layer; and then, removing at least the upper portion of the side-wall. In this embodiment as well, desirably, the second conductive layer is etched back under conditions where the etching rate of the second conductive layer is higher than the etching rate of the mask material layer.

In the process for the production of a cold cathode field emission device or a cold cathode field emission display according to the first aspect of the present invention, there may be employed an embodiment in which, after the step (C), the process includes the steps of forming an insulating film on the entire surface, and then, forming a focus electrode on the insulating film, and the above step (D) comprises the step of forming the opening portion which penetrates through the focus electrode, the insulating film, the gate electrode and the insulating interlayer and has a bottom portion where the electrode layer is exposed. By means of the above embodiment, the cold cathode field emission device or the cold cathode field emission display has a focus electrode formed above the gate electrode through the insulating film.

The process for the production of a cold cathode field emission device according to a second aspect of the present invention for achieving the above object comprises the steps of;

(A) forming a patterned electrode layer on a dielectric supporting substrate, (B) forming an insulating interlayer on the dielectric supporting substrate and the electrode layer, (C) forming a gate electrode constituted of a first conductive layer on the insulating interlayer, (D) forming an opening portion which penetrates through at least the insulating interlayer and has a bottom portion where the electrode layer is exposed, (E) forming an insulating material layer on the entire surface including the surface of the side wall of the opening portion, to decrease the opening portion in diameter, (F) forming a second conductive layer on the insulating material layer and in the opening portion by a physical or chemical vapor deposition method, (G) etching back the second conductive layer to form an emitter electrode shaped in the form of a column and constituted of the second conductive layer in the opening portion, and (H) removing the insulating material layer.

The process for the production of a cold cathode field emission display according to a second aspect of the present invention for achieving the above object is a process for the production of a cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer, and (d) an emitter electrode disposed on the electrode layer positioned in a bottom portion of an opening portion penetrating through the gate electrode and the insulating interlayer and shaped in the form of a column, each pixel further comprising;

(e) a second electrode layer and a fluorescent layer formed on a transparent substrate opposite to the emitter electrodes, the process comprises the steps of;

(A) forming the patterned electrode layer on the dielectric supporting substrate, (B) forming the insulating interlayer on the dielectric supporting substrate and the electrode layer, (C) forming the gate electrode constituted of a first conductive layer on the insulating interlayer, (D) forming the opening portion which penetrates through at least the insulating interlayer and has a bottom portion where the electrode layer is exposed, (E) forming an insulating material layer on the entire surface including the surface of the side wall of the opening portion, to decrease the opening portion in diameter, (F) forming a second conductive layer on the insulating material layer and in the opening portion by a physical or chemical vapor deposition method, (G) etching back the second conductive layer to form the emitter electrode shaped in the form of a column and constituted of the second conductive layer in the opening portion, (H) removing the insulating material layer, and (I) attaching and bonding the transparent substrate on which the fluorescent layer and the second electrode layer are formed and the dielectric supporting substrate to each other.

The cold cathode field emission device according to a second aspect of the present invention for achieving the above object comprises;

(a) a patterned electrode layer formed on a dielectric supporting substrate, (b) an insulating interlayer which is formed on the dielectric supporting substrate and the electrode layer, (c) a gate electrode formed on the insulating interlayer and constituted of a first conductive layer, and (d) an emitter electrode disposed on the electrode layer positioned in a bottom portion of an opening portion penetrating through the gate electrode and the insulating interlayer and shaped in the form of a column, the emitter electrode being formed, after the gate electrode is formed on the insulating interlayer, by forming the opening portion which penetrates through at least the insulating interlayer and has the bottom portion where the electrode layer is disposed; forming an insulating material layer on the entire surface including the surface of the side wall of the opening portion, to decrease the opening portion in diameter; forming a second conductive layer on the insulating material layer and in the opening portion by a physical or chemical vapor deposition method; and then, etching back the second conductive layer.

The cold cathode field emission display according to a second aspect of the present invention for achieving the above object is a cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer and constituted of a first conductive layer, and (d) an emitter electrode disposed on the electrode layer positioned in a bottom portion of an opening portion penetrating through the gate electrode and the insulating interlayer and shaped in the form of a column, each pixel further comprising;

(e) a second electrode layer and a fluorescent layer formed on a transparent substrate opposite to the emitter electrodes, the emitter electrode being formed, after the ate electrode is formed on the insulating interlayer, by forming the opening portion which penetrates through at least the insulating interlayer and has the bottom portion where the electrode layer is disposed; forming an insulating material layer on the entire surface including the surface of the side wall of the opening portion, to decrease the opening portion in diameter; forming a second conductive layer on the insulating material layer and in the opening portion by a physical or chemical vapor deposition method; and then, etching back the second conductive layer.

In the cold cathode field emission device, the cold cathode field emission display or the processes for the production thereof according to the second aspect of the present invention, when the opening portion is decreased in diameter by forming the insulating material layer on the gate electrode including the surface of the side wall of the opening portion, the surface of the electrode layer is exposed in the bottom portion of the opening portion decreased in diameter.

In the cold cathode field emission device, the cold cathode field emission display or the processes for the production thereof according to the second aspect of the present invention, there may be also employed an embodiment in which an acute-angled portion is formed on the top surface of the emitter electrode by etching back the second conductive layer, and the acute-angled portion is constituted of a surface spreading from a pit formed in the central portion of the top surface to a peripheral portion of the top surface and a side surface of the emitter electrode.

Otherwise, in the process for the production of a cold cathode field emission device or the process for the production of a cold cathode field emission display according to the second aspect of the present invention, there may be also employed an embodiment in which, the above step (G) comprises the steps of forming a mask material layer on the entire surface; partly removing the mask material layer to leave the mask material layer on the second conductive layer above the opening portion formed in the insulating interlayer; and then, etching back the second conductive layer to form, in the opening portion, the emitter electrode (i.e., emitter electrode whose top surface has a conical form) which has the form of a column, is constituted of the second conductive layer and has an acute-angled portion formed on its top surface, and the acute-angled portion being constituted of a tip end surface projecting toward the central portion of the top surface. In this embodiment, desirably, the second conductive layer is etched back under conditions where the etching rate of the second conductive layer is higher than the etching rate of the mask material layer.

In the cold cathode field emission device or the cold cathode field emission display according to the second aspect of the present invention, there may be also employed an embodiment in which an acute-angled portion is formed on the top surface of the emitter electrode, the acute-angled portion is constituted of a tip end surface projecting toward the central portion of the top surface, and the emitter electrode (i.e., emitter electrode whose top surface has a conical form) is formed, after the second conductive layer is formed on the insulating material layer and in the opening portion by a physical or chemical vapor deposition method, by forming a mask material layer on the entire surface; partly removing the mask material layer to leave the mask material layer on the second conductive layer above the opening portion formed in the insulating interlayer; and then, etching back the second conductive layer. In this embodiment as well, desirably, the second conductive layer is etched back under conditions where the etching rate of the second conductive layer is higher than the etching rate of the mask material layer.

In the process for the production of a cold cathode field emission device or a cold cathode field emission display according to the first or second aspect of the present invention, the above step (D) preferably comprises the steps of forming a resist layer on the insulating interlayer and the gate electrode by a lithography method; forming an opening portion in the gate electrode using the resist layer as an etching mask; and then, further forming an opening portion in the insulating interlayer below the opening portion formed in the gate electrode using the resist layer as an etching mask such that the opening portion reaches the electrode layer.

In the cold cathode field emission device, the cold cathode field emission display, or the processes for the production thereof according to the first or second aspect of the present invention, the embodiment, in which the opening portion which penetrates through "at least" the insulating interlayer and has a bottom portion where the electrode layer is exposed is formed, includes (1) an embodiment in which is formed the opening portion which penetrates through the gate electrode and the insulating interlayer and has a bottom portion where the electrode layer is exposed, that is, the formation of the opening portion in the gate electrode and the formation of the opening portion in the insulating interlayer are carried out in a consecutive process, and (2) an embodiment in which an opening portion is formed in the gate electrode when the gate electrode is formed, and an opening portion which communicates with the opening portion formed in the gate electrode and has a bottom portion where the electrode layer is exposed is formed in the insulating interlayer, that is, the formation of the opening portion in the gate electrode and the formation of the opening portion in the insulating interlayer are carried out in different processes.

The process for the production of a cold cathode field emission device according to a third aspect of the present invention for achieving the above object comprises the steps of;

(A) forming a patterned electrode layer on a dielectric supporting substrate, (B) forming an insulating interlayer on the dielectric supporting substrate and the electrode layer, (C) forming a gate electrode constituted of a first conductive layer on the insulating interlayer, (D) forming an insulating film on the entire surface, (E) forming a first opening portion which penetrates through the insulating film and has a bottom portion where the gate electrode is exposed, (F) forming a first side-wall of a first insulating material on the side wall of the first opening portion, to decrease the first opening portion in diameter, (G) forming a second opening portion which penetrates through the gate electrode and the insulating interlayer below the first opening portion decreased in diameter and has a bottom portion where the electrode layer is exposed, (H) forming a second side-wall of a second insulating material on the first side-wall and the side wall of the second opening portion, to further decrease the first opening portion in diameter and to decrease the second opening portion in diameter, (I) forming a second conductive layer on the entire surface including the insides of the first and second opening portions by a physical or chemical vapor deposition method, (J) etching back the second conductive layer to form an emitter electrode shaped in the form of a column and constituted of the second conductive layer in the second opening portion, and (K) removing the first side-wall and removing at least an upper portion of the second side-wall.

A cold cathode field emission device according to a third aspect of the present invention can be produced by the above process for the production of a cold cathode field emission device according to the third aspect of the present invention.

The process for the production of a cold cathode field emission display according to a third aspect of the present invention for achieving the above object is a process for the production of a cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer, and (d) an emitter electrode disposed on the electrode layer positioned in a bottom portion of a second opening portion penetrating through the gate electrode and the insulating interlayer and shaped in the form of a column, each pixel further comprising;

(e) a second electrode layer and a fluorescent layer formed on a transparent substrate opposite to the emitter electrodes, the process comprises the steps of;

(A) forming the patterned electrode layer on the dielectric supporting substrate, (B) forming the insulating interlayer on the dielectric supporting substrate and the electrode layer, (C) forming the gate electrode constituted of a first conductive layer on the insulating interlayer, (D) forming an insulating film on the entire surface, (E) forming a first opening portion which penetrates through the insulating film and has a bottom portion where the gate electrode is exposed, (F) forming a first side-wall of a first insulating material on the side wall of the first opening portion, to decrease the first opening portion in diameter, (G) forming the second opening portion which penetrates through the gate electrode and the insulating interlayer below the first opening portion decreased in diameter and has a bottom portion where the electrode layer is exposed, (H) forming a second side-wall of a second insulating material on the first side-wall and the side wall of the second opening portion, to further decrease the first opening portion in diameter and to decrease the second opening portion in diameter, (I) forming a second conductive layer on the entire surface including the insides of the first and second opening portions by a physical or chemical vapor deposition method, (J) etching back the second conductive layer to form the emitter electrode shaped in the form of a column and constituted of the second conductive layer in the second opening portion, (K) removing the first side-wall and removing at least an upper portion of the second side-wall, and (L) attaching and bonding the transparent substrate on which the fluorescent layer and the second electrode layer are formed and the dielectric supporting substrate to each other.

A cold cathode field emission display according to a third aspect of the present invention can be produced by the above process for the production of a cold cathode field emission display according to the third aspect of the present invention.

In the process for the production of a cold cathode field emission device or the process for the production of a cold cathode field emission display according to the third aspect of the present invention, there may be employed an embodiment in which, after the step (D), the process includes the step of forming a focus electrode on the insulating film, and the above step (E) comprises the step of forming the first opening portion which penetrates through the focus electrode and the insulating film and has a bottom portion where the gate electrode is exposed. A cold cathode field emission device or a cold cathode field emission display according to a fourth aspect of the present invention to be described later can be produced by the above process for the production of a cold cathode field emission device or the above process for the production of a cold cathode field emission display according to the above embodiment.

Otherwise, in the process for the production of a cold cathode field emission device or the process for the production of a cold cathode field emission display according to the third aspect of the present invention, there may be employed an embodiment in which, after the step (D), the process includes the steps of forming a focus electrode on the insulating film and further forming a second insulating film on the entire surface, and the above step (E) comprises the step of forming the first opening portion which penetrates through the second insulating film, the focus electrode and the insulating film and has a bottom portion where the gate electrode is exposed. A cold cathode field emission device or a cold cathode field emission display according to a fifth aspect of the present invention to be described later can be produced by the above process for the production of a cold cathode field emission device or the above process for the production of a cold cathode field emission display according to the above embodiment.

In the process for the production of the cold cathode field emission device or the process for the production of the cold cathode field emission display according to the third aspect of the present invention, preferably, at least an upper portion of the second side-wall is removed in the above step (K) such that no second side-wall is present on an imaginary line segment connecting the top surface of the emitter electrode and the edge portion of the second opening portion formed in the gate electrode. In this embodiment, preferably, the end portion of the second opening portion formed in the gate electrode is projected over the upper end portion of the second opening portion formed in the insulating interlayer.

In the process for the production of the cold cathode field emission device or the process for the production of the cold cathode field emission display according to the third aspect of the present invention, there may be employed an embodiment in which an acute-angled portion is formed on the top surface of the emitter electrode by etching back the second conductive layer, and the acute-angled portion is constituted of a surface spreading from a pit formed in the central portion of the top surface to a peripheral portion of the top surface and a side surface of the emitter electrode. Otherwise, there may be employed an embodiment in which, the above step (J) comprises the steps of forming a mask material layer on the entire surface; partly removing the mask material layer to leave the mask material layer on the second conductive layer above the second opening portion formed in the insulating interlayer; and then, etching back the second conductive layer to form, in the second opening portion, the emitter electrode which has the form of a column, is constituted of the second conductive layer and has an acute-angled portion formed on its top surface, and the acute-angled portion being constituted of a tip end surface projecting toward the central portion of the top surface. In this embodiment, desirably, the second conductive layer is etched back under conditions where the etching rate of the second conductive layer is higher than the etching rate of the mask material layer.

In the process for the production of the cold cathode field emission device or the process for the production of a cold cathode field emission display according to the third aspect of the present invention, the above step (G) preferably comprises the step of forming the second opening portion which penetrates through the gate electrode and the insulating interlayer below the first opening portion decreased in diameter and has a bottom portion where the electrode layer is exposed, using the first side-wall as an etching mask.

The cold cathode field emission device according to a third aspect of the present invention for achieving the above object comprises;

(a) a patterned electrode layer formed on a dielectric supporting substrate, (b) an insulating interlayer which is formed on the dielectric supporting substrate and the electrode layer, (c) a gate electrode formed on the insulating interlayer and constituted of a first conductive layer, and (d) an emitter electrode disposed on the electrode layer positioned in a bottom portion of a second opening portion penetrating through the gate electrode and the insulating interlayer and shaped in the form of a column, the emitter electrode being formed, after the gate electrode is formed on the insulating interlayer, by forming an insulating film on the entire surface; forming a first opening portion which penetrates through the insulating film and has a bottom portion where the gate electrode is exposed; forming a first side-wall of a first insulating material on the side wall of the first opening portion, to decrease the first opening portion in diameter; forming the second opening portion which penetrates through the gate electrode and the insulating interlayer below the first opening portion decreased in diameter and has a bottom portion where the electrode layer is exposed; forming a second side-wall of a second insulating material on the first side-wall and on the side wall of the second opening portion, to further decrease the first opening portion in diameter and to decrease the second opening portion in diameter; forming a second conductive layer on the entire surface including the insides of the first and second opening portions by a physical or chemical vapor deposition method; etching back the second conductive layer; and then, removing the first side-wall and removing at least an upper portion of the second side-wall.

The cold cathode field emission device according to a fourth aspect of the present invention for achieving the above object comprises;

(a) a patterned electrode layer formed on a dielectric supporting substrate, (b) an insulating interlayer which is formed on the dielectric supporting substrate and the electrode layer, (c) a gate electrode formed on the insulating interlayer and constituted of a first conductive layer, (d) a focus electrode formed above the gate electrode through an insulating film, (e) a second opening portion which communicates with a first opening portion penetrating through the focus electrode and the insulating film and penetrates through the gate electrode and the insulating interlayer, and (f) an emitter electrode disposed on the electrode layer positioned in a bottom portion of the second opening portion and shaped in the form of a column, the emitter electrode being formed, after the gate electrode is formed on the insulating interlayer, by forming the insulating film on the entire surface; forming the focus electrode on the insulating film; forming the first opening portion which penetrates through the focus electrode and the insulating film and has a bottom portion where the gate electrode is exposed; forming a first side-wall of a first insulating material on the side wall of the first opening portion, to decrease the first opening portion in diameter; forming the second opening portion which penetrates through the gate electrode and the insulating interlayer below the first opening portion decreased in diameter and has a bottom portion where the electrode layer is exposed; forming a second side-wall of a second insulating material on the first side-wall and the side wall of the second opening portion, to further decrease the first opening portion in diameter and to decrease the second opening portion in diameter; forming a second conductive layer on the entire surface including the insides of the first and second opening portions by a physical or chemical vapor deposition method; etching back the second conductive layer; and then, removing the first side-wall and removing at least an upper portion of the second side-wall.

The cold cathode field emission device according to a fifth aspect of the present invention for achieving the above object comprises;

(a) a patterned electrode layer formed on a dielectric supporting substrate, (b) an insulating interlayer which is formed on the dielectric supporting substrate and the electrode layer, (c) a gate electrode formed on the insulating interlayer and constituted of a first conductive layer, (d) a focus electrode formed above the gate electrode through an insulating film, (e) a second opening portion which communicates with a first opening portion penetrating through the focus electrode and the insulating film and penetrates through the gate electrode and the insulating interlayer, and (f) an emitter electrode disposed on the electrode layer positioned in a bottom portion of the second opening portion and shaped in the form of a column, the emitter electrode being formed, after the gate electrode is formed on the insulating interlayer, by forming the insulating film on the entire surface; forming the focus electrode on the insulating film; forming a second insulating film on the entire surface; forming the first opening portion which penetrates through the second insulating film, the focus electrode and the insulating film and has a bottom portion where the gate electrode is exposed; forming a first side-wall of a first insulating material on the side wall of the first opening portion, to decrease the first opening portion in diameter; forming the second opening portion which penetrates through the gate electrode and the insulating interlayer below the first opening portion decreased in diameter and has a bottom portion where the electrode layer is exposed; forming a second side-wall of a second insulating material on the first side-wall and the side wall of the second opening portion, to further decrease the first opening portion in diameter and to decrease the second opening portion in diameter; forming a second conductive layer on the entire surface including the insides of the first and second opening portions by a physical or chemical vapor deposition method; etching back the second conductive layer; and then, removing the first side-wall and removing at least an upper portion of the second side-wall.

The cold cathode field emission display according to a third aspect of the present invention for achieving the above object is a cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer and constituted of a first conductive layer, and (d) an emitter electrode disposed on the electrode layer positioned in a bottom portion of a second opening portion penetrating through the gate electrode and the insulating interlayer and shaped in the form of a column, each pixel further comprising;

(e) a second electrode layer and a fluorescent layer formed on a transparent substrate opposite to the emitter electrode, the emitter electrode being formed, after the gate electrode is formed on the insulating interlayer, by forming an insulating film on the entire surface; forming a first opening portion which penetrates through the insulating film and has a bottom portion where the gate electrode is exposed; forming a first side-wall of a first insulating material on the side wall of the first opening portion, to decrease the first opening portion in diameter; forming the second opening portion which penetrates through the gate electrode and the insulating interlayer below the first opening portion decreased in diameter and has a bottom portion where the electrode layer is exposed; forming a second side-wall of a second insulating material on the first side-wall and on the side wall of the second opening portion, to further decrease the first opening portion in diameter and to decrease the second opening portion in diameter; forming a second conductive layer on the entire surface including the insides of the first and second opening portions by a physical or chemical vapor deposition method; etching back the second conductive layer; and then, removing the first side-wall and removing at least an upper portion of the second side-wall.

The cold cathode field emission display according to a fourth aspect of the present invention for achieving the above object is a cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer and constituted of a first conductive layer, (d) a focus electrode formed above the gate electrode through an insulating film, (e) a second opening portion which communicates with a first opening portion penetrating through the focus electrode and the insulating film and penetrates through the gate electrode and the insulating interlayer, and (f) an emitter electrode disposed on the electrode layer positioned in a bottom portion of the second opening portion and shaped in the form of a column, each pixel further comprising;

(g) a second electrode layer and a fluorescent layer formed on a transparent substrate opposite to the emitter electrodes, the emitter electrode being formed, after the gate electrode is formed on the insulating interlayer, by forming the insulating film on the entire surface; forming the focus electrode on the insulating film; forming the first opening portion which penetrates through the focus electrode and the insulating film and has a bottom portion where the gate electrode is exposed; forming a first side-wall of a first insulating material on the side wall of the first opening portion, to decrease the first opening portion in diameter; forming the second opening portion which penetrates through the gate electrode and the insulating interlayer below the first opening portion decreased in diameter and has a bottom portion where the electrode layer is exposed; forming a second side-wall of a second insulating material on the first side-wall and the side wall of the second opening portion, to further decrease the first opening portion in diameter and to decrease the second opening portion in diameter; forming a second conductive layer on the entire surface including the insides of the first and second opening portions by a physical or chemical vapor deposition method; etching back the second conductive layer; and then, removing the first side-wall and removing at least an upper portion of the second side-wall.

The cold cathode field emission display according to a fifth aspect of the present invention for achieving the above object is a cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer and constituted of a first conductive layer, (d) a focus electrode formed above the gate electrode through an insulating film, (e) a second opening portion which communicates with a first opening portion penetrating through the focus electrode and the insulating film and penetrates through the gate electrode and the insulating interlayer, and (f) an emitter electrode disposed on the electrode layer positioned in a bottom portion of the second opening portion and shaped in the form of a column, each pixel further comprising;

(g) a second electrode layer and a fluorescent layer formed on a transparent substrate opposite to the emitter electrode, the emitter electrode being formed, after the gate electrode is formed on the insulating interlayer, by forming an insulating film on the entire surface; forming the focus electrode on the insulating film; forming a second insulating film on the entire surface; forming the first opening portion which penetrates through the second insulating film, the focus electrode and the insulating film and has a bottom portion where the gate electrode is exposed; forming a first side-wall of a first insulating material on the side wall of the first opening portion, to decrease the first opening portion in diameter; forming the second opening portion which penetrates through the gate electrode and the insulating interlayer below the first opening portion decreased in diameter and has a bottom portion where the electrode layer is exposed; forming a second side-wall of a second insulating material on the first side-wall and the side wall of the second opening portion, to further decrease the first opening portion in diameter and to decrease the second opening portion in diameter; forming a second conductive layer on the entire surface including the insides of the first and second opening portions by a physical or chemical vapor deposition method; etching back the second conductive layer; and then, removing the first side-wall and removing at least an upper portion of the second side-wall.

In the cold cathode field emission device or the cold cathode field emission display according to any one of the third to fifth aspects of the present invention, preferably, no second side-wall is present on an imaginary segment line connecting the top surface of the emitter electrode and the end portion of the second opening portion formed in the gate electrode, or the end portion of the second opening portion formed in the gate electrode is projected over the upper end portion of the second opening portion formed in the insulating interlayer.

In the cold cathode field emission device or the cold cathode field emission display according to any one of the third to fifth aspects of the present invention, there may be employed an embodiment in which an acute-angled portion is formed on the top surface of the emitter electrode by etching back the second conductive layer, and the acute-angled portion is constituted of a surface spreading from a pit formed in the central portion of the top surface to a peripheral portion of the top surface and a side surface of the emitter electrode. Otherwise, there may be employed another embodiment in which an acute-angled portion is formed on the top surface of the emitter electrode, the acute-angled portion is constituted of a tip end surface projecting toward the central portion of the top surface, and the emitter electrode is formed, after the second conductive layer is formed on the entire surface including the insides of the first and second opening portions by a physical or chemical vapor deposition method, by forming a mask material layer on the entire surface; partly removing the mask material layer to leave the mask material layer on the second conductive layer above the second opening portion formed in the insulating interlayer; etching back the second conductive layer; and then, removing the first side-wall and removing at least an upper portion of the second side-wall. In this embodiment, desirably, the second conductive layer is etched back under conditions where the etching rate of the second conductive layer is higher than the etching rate of the mask material layer.

The cross-sectional form of the "column" may be any form such as a circular form, a rectangular form, a rounded rectangular form, a polygonal form, a rounded polygonal form, an oval form or the like, and it is dependent upon the cross-sectional form of the opening portion or the second opening portion. The term "decreasing the opening portion in diameter" means that the cross-section area of the opening portion, taken by cutting the opening portion with a plane perpendicular to an axial line passing through the center of the opening portion is decreased.

In the process for the production of a cold cathode field emission device or the process for the production of a cold cathode field emission device according to any one of the first to third aspects of the present invention or in the cold cathode field emission device or the cold cathode field emission display according to any one of the first to fifth aspects of the present invention, the dielectric supporting substrate includes a glass substrate, a quartz substrate, a glass substrate having a surface formed of an insulating film, a quartz substrate having a surface formed of an insulating film, and a silicon semiconductor substrate having a surface formed of an insulating film.

The material for forming the electrode layer includes refractory metals such as tungsten (W), molybdenum (Mo), titanium (Ti), niobium (Nb), tantalum (Ta), chromium (Cr); metals such as aluminum (Al) and copper (Cu); alloys containing these refractory metals or these metals; any one of compounds of these refractory metals or these metals (for example, nitrides and silicides); semiconductors such as silicon (Si); diamond; carbon; and ITO. The electrode layer can be formed by a general thin-film-forming method such as a vapor deposition method, a sputtering method, a CVD method, an ion-plating method, a printing method, a plating method or the like.

When the emitter electrode is formed, the second conductive layer on the gate electrode or on the focus electrode is etched back. Preferably, therefore, the material for forming the gate electrode (first conductive layer) or the focus electrode and the material for forming the emitter electrode (second conductive layer) can permit etching selectivity. The material for forming the gate electrode (first conductive layer) and the focus electrode includes refractory metals such as tungsten (W), molybdenum (Mo), titanium (Ti), niobium (Nb), tantalum (Ta), chromium (Cr); metals such as aluminum (Al) and copper (Cu); alloys containing these refractory metals or these metals; and any one of compounds of these refractory metals or these metals (for example, nitrides and silicides). The material for forming the emitter electrode (second conductive layer) includes refractory metals such as tungsten (W), niobium (Nb), tantalum (Ta), titanium (Ti), molybdenum (Mo), chromium (Cr); metals such as aluminum (Al) and copper (Cu); alloys containing these refractory metals or these metals; and any one of compounds of these refractory metals or these metals, and among these materials, refractory metals, alloys containing these refractory metals or any one of compounds of these refractory metals are preferably used. Preferably, a material for forming the emitter electrode (second conductive layer) and a material for forming the electrode layer are combined so as to attain a high adhesiveness between the electrode layer and the emitter electrode.

The physical vapor deposition (PVD) method for forming the second conductive layer includes (a) various vacuum vapor deposition methods such as an electron beam heating method, a resistance heating method and a flash deposition method, (b) a plasma-enhanced vapor deposition method, (c) various sputtering methods such as a double-pole sputtering method, a DC sputtering method, a DC magnetron sputtering method, a high-frequency sputtering method, a magnetron sputtering method, an ion beam sputtering method and a bias sputtering method, (d) various ion plating methods such as a DC (Direct Current) method, an RF method, a multi-cathode method, an activation reaction method, an HCD (Hollow Cathode Discharge) method, an electric field vapor deposition method, an RF ion plating method and a reactive ion plating method, and (e) an ion vapor deposition (IVD) method. The chemical vapor deposition method (CVD method) for forming the second conductive layer includes a normal pressure CVD method, a low pressure CVD method, a thermal CVD method, a plasma-enhanced CVD method, a photo CVD method and a laser induced CVD method.

The mask material layer can be composed of any material so long as it gives a lower etching rate than the etching rate of the second conductive layer. For example, the material for the mask material layer includes a resist material, SOG (spin on glass) and polyimide-base resins. These materials can be easily applied by a spin coating method. Otherwise, the above material may be a material such as BPSG (boro-phospho-silicate glass) which permits surface flattening after formed into a layer by a thermal reflow method. The "etching rate" means an etching rate of the mask material layer and the second conductive layer in a direction perpendicular to the dielectric supporting substrate.

When the material for forming the emitter electrode (second conductive layer) can be selected from refractory metals such as tungsten (W), titanium (Ti), niobium (Nb), tantalum (Ta), molybdenum (Mo), chromium (Cr), alloys containing these refractory metals, or and any one of compounds of these refractory metals such as nitrides (for example, TiN) and silicides (for example, $WSi_2$, $MoSi_2$, $TiSi_2$, $TaSi_2$), the mask material layer can be composed of any one of copper (Cu), gold (Au) and silver (Ag), or the combination thereof. When such a material is used as the material for forming the mask material layer, and when the etching rate of the mask material layer is 1, desirably, the etching rate of the second conductive layer of at least 10 can be obtained.

The material for forming the insulating interlayer includes $SiO_2$, SiN, SiON and a glass-paste cured product. The material for forming the side-wall, the first side-wall, the second side-wall, the insulating material layer, the insulating film or the second insulating film includes $SiO_2$, SiN and SiON. The formation of the insulating interlayer, the insulating film or the second insulating film can be carried out by a known method such as a CVD method, a coating method, a sputtering method or a printing method, and the formation of the side-wall, the first side-wall or the second side-wall can be carried out by a known method such as a combination of a CVD method and an etching back process. Preferably, the material for forming the insulating interlayer and the material for the side-wall, the first side-wall, the second side-wall, the insulating material layer, the insulating film or the second insulating film (to be generally referred to as "side-wall, etc." hereinafter) can permit etching selectivity. When $SiO_2$ is used as a material for the insulating interlayer, it is preferred to use SiN as an insulating material for forming the side-wall, etc., and when SiON is used as a material for forming the insulating interlayer, it is preferred to use $SiO_2$ as a material for forming the side-wall, etc., although the combination of the above materials shall not be limited to these.

The transparent substrate includes, for example, a glass substrate and a quartz substrate. The material for the second electrode layer can be selected from aluminum, tin oxide-doped indium oxide (ITO) and tin oxide ($SnO_2$). The fluorescent layer can be composed of a known fluorescent material. The second electrode layer and the fluorescent layer may be formed on the transparent substrate in the order of the second electrode layer and the fluorescent layer or in the order of the fluorescent layer and the second electrode layer.

The focus electrode is a member provided for preventing the divergence of path of electrons emitted from an electron emission portion in a so-called high-voltage type display in which the potential difference between the second electrode layer (anode electrode) formed on the transparent substrate and the electrode layer (cathode electrode) formed on the dielectric supporting substrate is an order of 5 kV and the distance between these two electrodes is relatively large (for example, approximately 1 mm). By improving the convergence path of emitted electrons, a crosstalk among pixels can be decreased, and in particular, a color mixing is prevented when displaying is conducted in colors. Further, the pixels can be formed as finer units, so that displaying of finer images can be attained.

In the present invention, the emitter electrode is formed in the opening portion decreased in diameter with the side-wall or the insulating material layer, so that the emitter electrode can be formed in a self-alignment manner. Further, the second conductive layer is etched back to form the acute-angled portion on the top surface of the emitter electrode, so that it is no longer necessary to employ a special production method in order to form an acute-angled portion on the top surface of the emitter electrode.

In the processes for the production of the cold cathode field emission device and the cold cathode field emission display according to the second aspect of the present invention, the second conductive layer is etched back in a state where the gate electrode is covered with the insulating material layer. In the processes for the production of the cold cathode field emission device and the cold cathode field emission display according to the third aspect of the present invention, the second conductive layer is etched back in a state where the gate electrode is covered with the insulating film or where the focus electrode is covered with the second insulating film. Advantageously, therefore, the freedom of selection of the combination of the material for forming the gate electrode or the focus electrode and the material for forming the second conductive layer increases. Particularly, the material for the gate electrode or the focus electrode can be selected from a broader range of materials, and the second conductive layer is no longer required to be selectively etched back with regard to the gate electrode or the focus electrode.

BRIEF DESCRIPTION OF THE DRAWINGS

The present invention will be explained in detail with reference to drawings, hereinafter.

FIG. 4B, are schematic partial end views of a dielectric supporting substrate, etc., for explaining the processes for the production of the cold cathode field emission device and the cold cathode field emission display in Example 1.

FIG. 5C, are schematic partial end views of a dielectric supporting substrate, etc., for explaining the processes for the production of the cold cathode field emission device and the cold cathode field emission display in Example 1.

FIG. 7B, are schematic partial end views of a dielectric supporting substrate, etc., for explaining the processes for the production of the cold cathode field emission device and the cold cathode field emission display in Example 2.

FIG. 11B, are schematic partial end views of a dielectric supporting substrate, etc., for explaining the processes for the production of the cold cathode field emission device and the cold cathode field emission display in Example 3.

FIG. 13B, is a schematic partial end view of a dielectric supporting substrate, etc., for explaining the processes for the production of the cold cathode field emission device and the cold cathode field emission display in Example 4.

FIG. 15B, are schematic partial end views of a dielectric supporting substrate, etc., for explaining the processes for the production of the cold cathode field emission device and the cold cathode field emission display in Example 5.

FIG. 16B, is a schematic partial end view of a dielectric supporting substrate, etc., for explaining the processes for the production of the cold cathode field emission device and the cold cathode field emission display in Example 5.

FIG. 18B, are schematic partial end views of a dielectric supporting substrate, etc., for explaining the processes for the production of the cold cathode field emission device and the cold cathode field emission display in Example 6.

FIG. 19B, are schematic partial end views of a dielectric supporting substrate, etc., for explaining the processes for the production of the cold cathode field emission device and a the cold cathode field emission display in Example 6.

FIG. 20B, are schematic partial end views of a dielectric supporting substrate, etc., for explaining the processes for the production of the cold cathode field emission device and the cold cathode field emission display in Example 6.

FIG. 22B, are schematic partial end views of a dielectric supporting substrate, etc., for explaining the processes for the production of the cold cathode field emission device and the cold cathode field emission display in Example 7.

FIG. 23B, are schematic partial end views of a dielectric supporting substrate, etc., for explaining the processes for the production of the cold cathode field emission device and the cold cathode field emission display in Example 7.

FIG. 24B, is a schematic partial end view of a dielectric supporting substrate, etc., for explaining the processes for the production of the cold cathode field emission device and the cold cathode field emission display in Example 7.

FIG. 26B, are schematic partial end views of a dielectric supporting substrate, etc., for explaining the processes for the production of the cold cathode field emission device and the cold cathode field emission display in Example 8.

FIG. 27B, are schematic partial end views of a dielectric supporting substrate, etc., for explaining the processes for the production of the cold cathode field emission device and the cold cathode field emission display in Example 8.

FIG. 28B, are schematic partial end views of a dielectric supporting substrate, etc., for explaining the processes for the production of the cold cathode field emission device and the cold cathode field emission display in Example 8.

FIG. 31B, is a schematic partial end view of the cold cathode field emission device explained in Example 2 for showing the variant of the process for the production thereof.

FIG. 34B, are schematic partial end views of a dielectric supporting substrate, etc., for explaining the process for the production of the conventional Spindt type cold cathode field emission device.

DESCRIPTION OF THE PREFERRED EMBODIMENTS

EXAMPLE 1

Figure 1A:
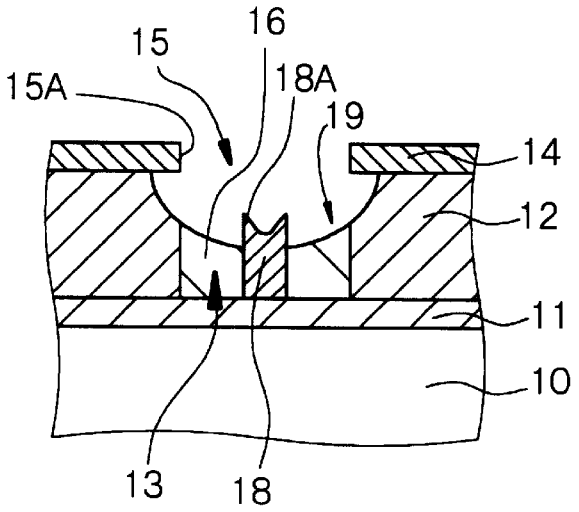
FIG. 1A is a schematic partial end view of a cold cathode field emission device in Example 1.
Figure 1B:
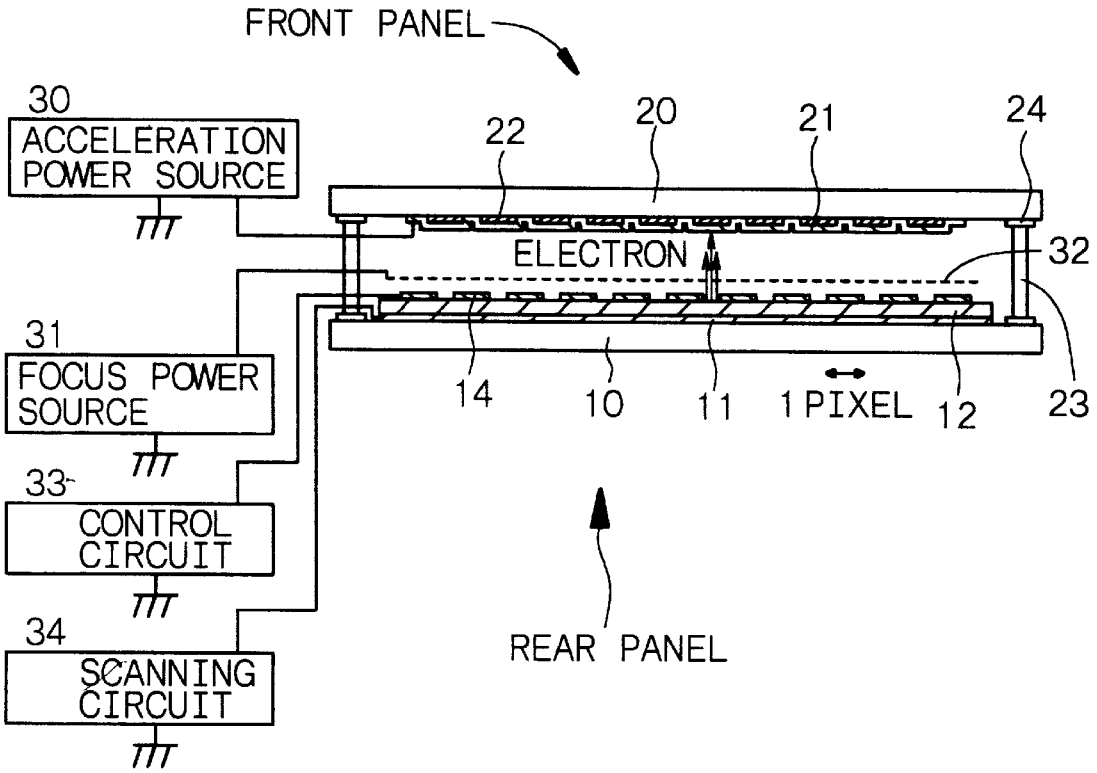
FIG. 1B is a conceptual view of a cold cathode field emission display.
Figure 2A:
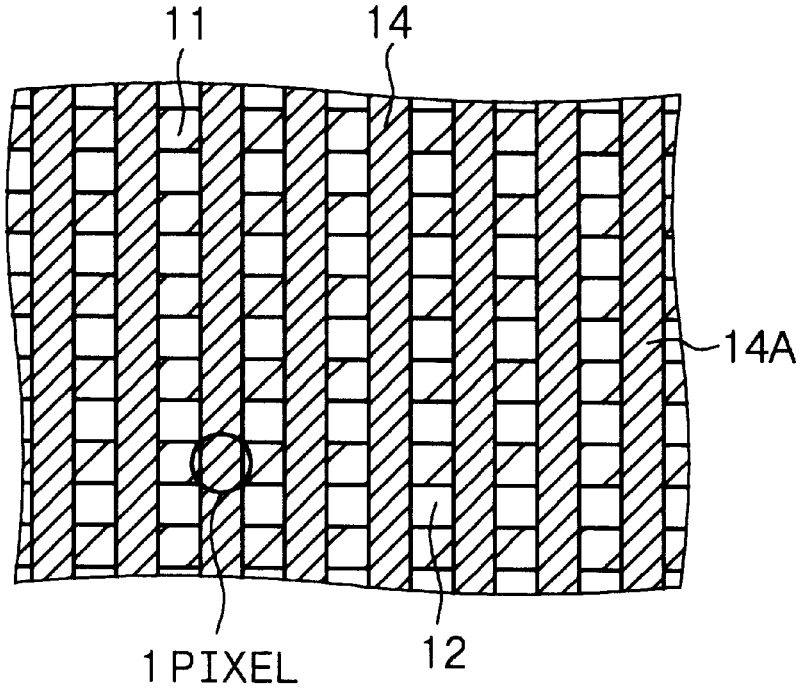
FIG. 2A shows a configuration of part of electrode layers and gate electrodes of a cold cathode field emission display.
Figure 2B:
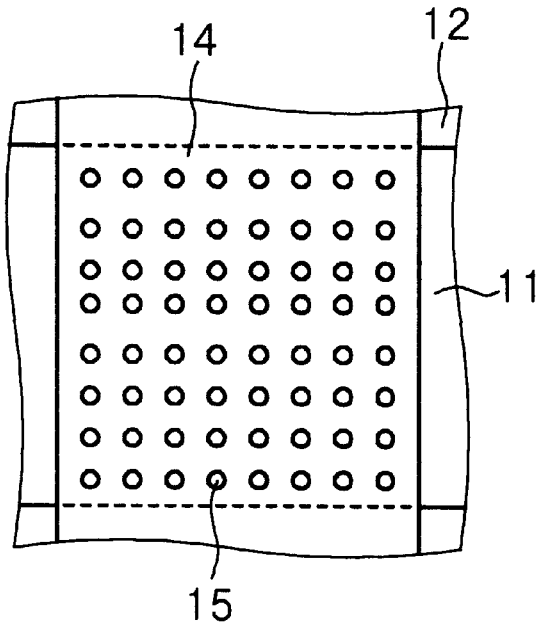
FIG. 2B shows a configuration of an electrode layer and gate electrodes in one pixel.
Figure 3A:
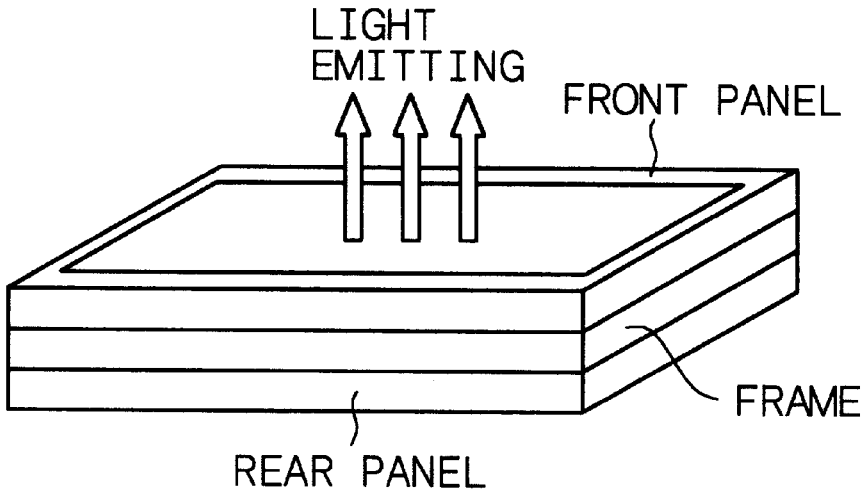
FIG. 3A is a schematic perspective view of a cold cathode field emission display.

Example 1 is concerned with a cold cathode field emission device (to be simply referred to as "field emission device" hereinafter), a cold cathode field emission display (to be simply referred to as "field emission display" hereinafter) having the field emission devices, and processes for the production thereof, according to the first aspect of the present invention. FIG. 1A shows a schematic partial end view of the field emission device in Example 1, and FIG. 1B shows a conceptual view of the field emission display when the field emission display is cut with a vertical plane. FIG. 2A shows a configuration of part of electrode layers (cathode electrode layers) 11 and gate electrodes 14 in the field emission display, FIG. 2B shows a configuration of the electrode layer (cathode electrode layer) 11 and the gate electrode 14 in one pixel, and FIG. 3A shows a schematic perspective view of the field emission display. In FIG. 2B, the number of the field emission devices constituting one pixel is 64, while the above number shall not be limited thereto.

The field emission device comprises a dielectric supporting substrate 10 constituted of a glass substrate, a patterned electrode layer (cathode electrode layer) 11 composed of molybdenum, an insulating interlayer 12 composed of $SiO_2$, a gate electrode 14 composed of aluminum and an emitter electrode 18 which has the form of a column and is composed of tungsten (W). The patterned electrode layer 11 is formed on the dielectric supporting substrate 10 constituted of a glass substrate. The insulating interlayer 12 is formed on the dielectric supporting substrate 10 and the electrode layer 11. The gate electrode 14 constituted of a first conductive layer (aluminum layer) is formed on the insulating interlayer 12. The emitter electrode 18 constituted of a second layer is disposed on the electrode layer 11 exposed in a bottom portion of an opening portion penetrating through the gate electrode 14 and the insulating interlayer 12. The opening portion comprises an opening portion 15 formed in the gate electrode 14 and an opening portion 13 formed in the insulating interlayer 12. The emitter electrode 18 is surrounded by the opening portion 15 formed in the gate electrode 14. A cavity portion 19 is formed in the insulating interlayer 12 below the opening portion 15 formed in the gate electrode 14.

Figure 3B:
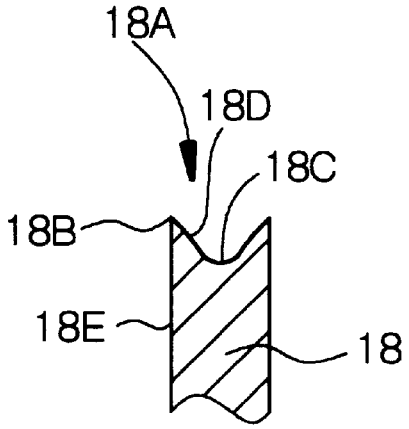
FIG. 3B is an enlarged view of an emitter electrode.
Figure 4A:
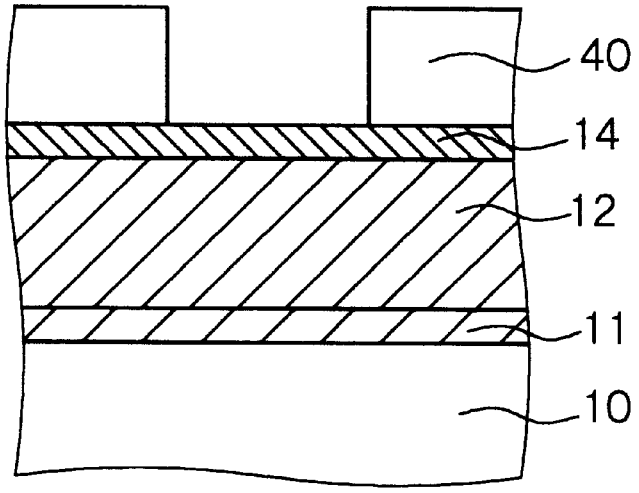
FIGS. 4A and 4B are schematic partial end views of a dielectric supporting substrate, etc., for explaining the processes for the production of a cold cathode field emission device and a cold cathode field emission display in Example 1.
Figure 4B:
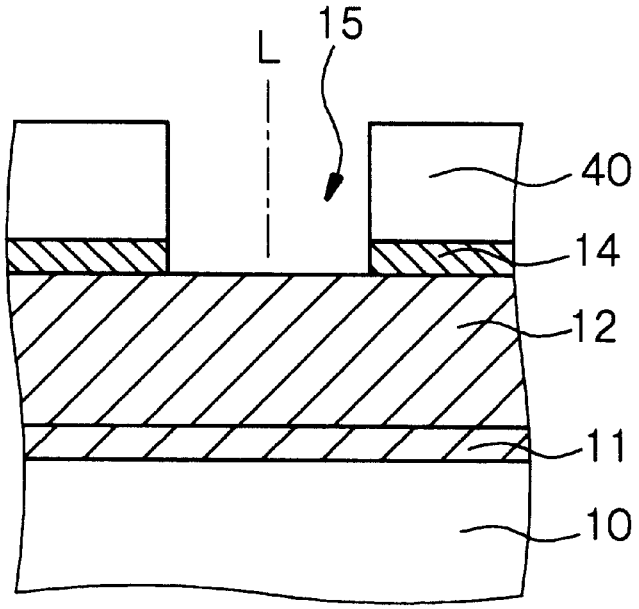
Figure 5A:
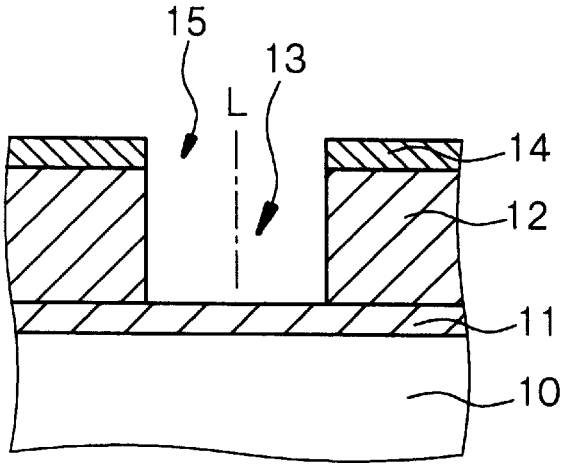
FIGS. 5A, 5B and 5C, following
Figure 5B:
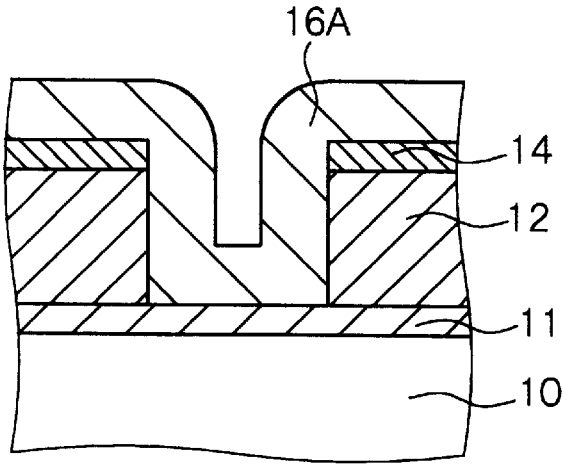
Figure 5C:
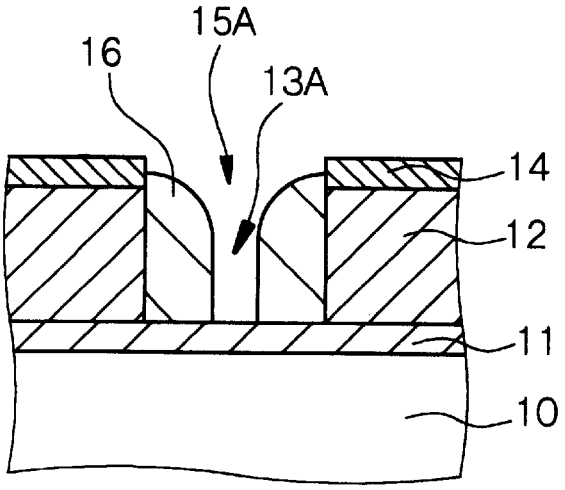

In the field emission device in Example 1, as FIG. 3B shows an enlarged view of a top end portion of the emitter electrode 18, an acute-angled portion 18B is formed on a top surface 18A of the emitter electrode 18, and the acute-angled portion 18B is constituted of a surface 18D spreading from a pit 18C formed in the central portion of the top surface 18A to a peripheral portion of the top surface and a side surface 18E of the emitter electrode 18. The emitter electrode 18 is formed, after the gate electrode 14 is formed on the insulating interlayer 12, by forming the opening portions 15 and 13 which penetrate the gate electrode 14 and the insulating interlayer 12 and have a bottom portion where the electrode layer 11 is exposed (incidentally, the opening portion 13 is formed in the insulating interlayer 12, and the opening portion 15 is formed in the gate electrode 14); forming a side-wall 16 composed of an insulating material on the side walls of the opening portions 13 and 15 to decrease the opening portions 13 and 15 in diameter; forming a second conductive layer 17 on the entire surface (specifically on the insulating interlayer 12 and the gate electrode 14) including the insides of the opening portions 13A and 15A by a CVD method; etching back the second conductive layer 17; and then, removing an upper portion of the side-wall 16 and further the insulating interlayer 12 below the opening portion 15 formed in the gate electrode 14. No side-wall 16 is present on an imaginary segment line connecting the top surface 18A of the emitter electrode 18 and an edge portion 15A of the opening portion 15 formed in the gate electrode 14. Further, the end portion 15A of the opening portion 15 formed in the gate electrode 14 forms an eave above the upper end of the opening portion 13 formed in the insulating interlayer 12. That is, the end portion 15A of the opening portion 15 formed in the gate electrode 14 is projected over the cavity portion 19.

The field emission display of the Example 1 has a plurality of pixels, and each pixel comprises a plurality of the above field emission devices. Further, each pixel comprises a second electrode layer (anode electrode layer) 21 and a fluorescent layer 22 formed on a transparent substrate constituted of a glass substrate opposite to the emitter electrodes 18. The anode electrode layer 21 is composed of aluminum. The field emission display of Example 1 is fabricated in a manner in which a rear panel in which a plurality of the above field emission devices are formed and a front panel are attached and bonded to each other with a frame 23. The frame 23 has a height of about 1mm and is composed of ceramic or glass. For the above bonding (laminating), a seal material 24 of frit glass can be used. The front panel comprises the transparent substrate 20, the fluorescent layer 22 formed thereon and the second electrode layer (anode electrode layer) 21 formed on the fluorescent layer 22. The front panel may comprise the transparent substrate 20, the second electrode layer (anode electrode layer) 21 formed thereon and the fluorescent layer 22 formed on the electrode layer 21.

As shown in FIG. 1B, the anode electrode layer 21 is connected to an acceleration power source 30, the gate electrode 14 is connected to a control circuit 33, and the electrode layer (cathode electrode layer) 11 is connected to a scanning circuit 34. Further, when a focus electrode 32 is disposed above the gate electrode 14, the focus electrode 32 is connected to a focus power source 31. A voltage is applied between the emitter electrode 18 and the gate electrode 14 by proper performances of the above power sources and circuits, to generate an electric field, and due to the electric field, electrons are extracted from the acute-angled portion 18B of the emitter electrode 18. The electrons are attracted to the anode electrode layer 21 formed on the transparent substrate 20 to collide with the fluorescent layer (light emitting layer) 22 formed between the anode electrode layer 21 and the transparent substrate 20. As a result, the fluorescent layer 22 emits light and a desired image can be obtained. By allowing the fluorescent layers 22 to emit light of red, light of green and light of blue, a color image can be obtained. A video signal is inputted to the control circuit 33 to control the amount of emitted electrons from the emitter electrode 18. A scanning signal is inputted to the scanning circuit 34 to emit electrons from a desired emitter electrode 18.

The processes for the production of the field emission device of Example 1 and the field emission display having the field emission devices will be explained with reference to FIGS. 4A, 4B, 5A, 5B, 5C, 6A and 6B showing schematic partial end views of the dielectric supporting substrate and the like.

[Step-100]

First, the patterned electrode layer (cathode electrode layer) 11 composed of molybdenum is formed on the dielectric supporting substrate 10 constituted of a glass substrate. Specifically, a molybdenum layer is deposited on the dielectric supporting substrate 10, for example, by a sputtering method or a CVD method, and the molybdenum layer is patterned whereby a plurality of the electrode layers 11 extending in parallel in a row direction and having the form of a stripe can be formed (see FIGS. 1A and 2A). Then, the insulating interlayer 12 composed of $SiO_2$ is formed on the dielectric supporting substrate 10 and the electrode layers 11 by a CVD method. The insulating interlayer 12 has a thickness of 1 $\mu$m.

[Step-110]

Then, a first conductive layer 14A composed of aluminum is formed on the insulating interlayer 12 by a sputtering method, and then the first conductive layer (aluminum layer) 14A is patterned by a known method to form the gate electrodes 14 composed of the first conductive layer (aluminum layer) 14A. A plurality of the patterned first conductive layers 14A constituting the gate electrodes 14 have the form of a stripe extending in a column direction (see FIG. 2A). Then, a resist layer 40 is formed on the entire surface (specifically, on the insulating interlayer 12 and the gate electrode 14) by a lithography method (see FIG. 4A). While the resist layer 40 is used as an etching mask, an opening portion 15 is formed in the gate electrode 14 by a reactive ion etching method (RIE method) using chlorine-base etching gas (see FIG. 4B). The cross section of the opening portion 15, taken by cutting the opening portion 15 with a plane perpendicular to an axial line L passing through the center of the opening portion 15, has a circular form having a diameter of 2 $\mu$m.

[Step-120]

After the etching of the gate electrode 14, while the resist layer 40 is used as an etching mask, the opening portion 13 is formed in the insulating interlayer 12 below the opening portion 15 formed in the gate electrode 14 so as to reach the electrode layer 11 by an RIE method using carbon tetrafluoride ($CF_4$) gas. The cross section of the opening portion 13, taken by cutting the opening portion 13 with a plane perpendicular to the axial line passing through the center of the opening portion 13 and being in agreement with the axial line L passing through the center of the opening portion 15, also has a circular form having a diameter of 2 $\mu$m. Then, the resist layer 40 is removed by ashing treatment, whereby a structure shown in FIG. 5A can be obtained.

[Step-130]

Then, a side-wall composed of an insulating material ($SiO_2$) is formed on side walls of the opening portions 13 and 15 for decreasing the opening portions 13 and 15 in diameter. Specifically, an insulating material layer 16A composed of $SiO_2$ is deposited on the entire surface by a plasma-enhanced TEOS-CVD method. The insulating material layer 16A on the gate electrode 14 has a thickness of 0.8 $\mu$m (see FIG. 5B). Then, the insulating material layer 16A is etched back by an RIE method using $CF_4$ gas, to form the side-wall 16 on the side walls of the opening portions 13 and 15 (see FIG. 5C). The opening portion 13 alone may be decreased in diameter by forming the side-wall 16 on the side wall of the opening portion 13. The diameter-decreased opening portion 13A has a diameter of 0.4 $\mu$m. The opening portion 13A is formed in a self-alignment manner, and the axial line passing through the center of the opening portion 13A formed in the insulating interlayer 12 and the axial line L passing through the center of the opening portion 15 formed in the gate electrode 14 are in agreement. When the emitter electrode is formed in a step to follow, the emitter electrode is formed in a self-alignment manner, and the axial line passing through the center of the emitter electrode is in agreement with the axial line L passing through the center of the opening portion 15 formed in the gate electrode 14.

[Step-140]

Figure 6A:
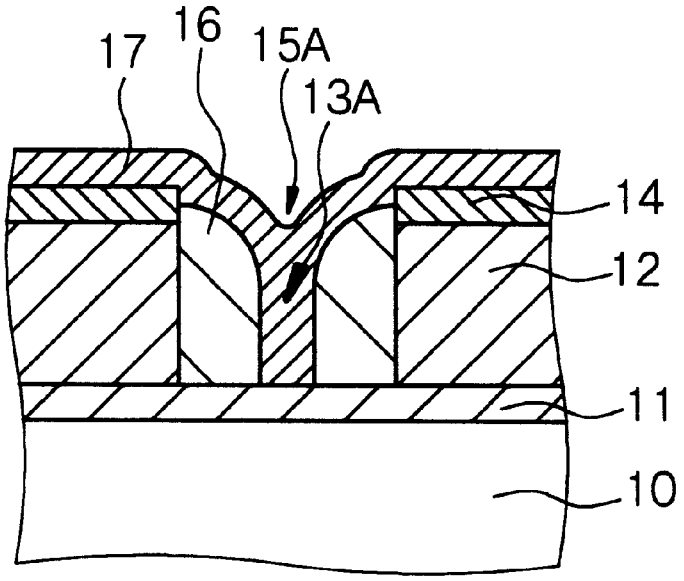
FIGS. 6A and 6B, following
Figure 6B:
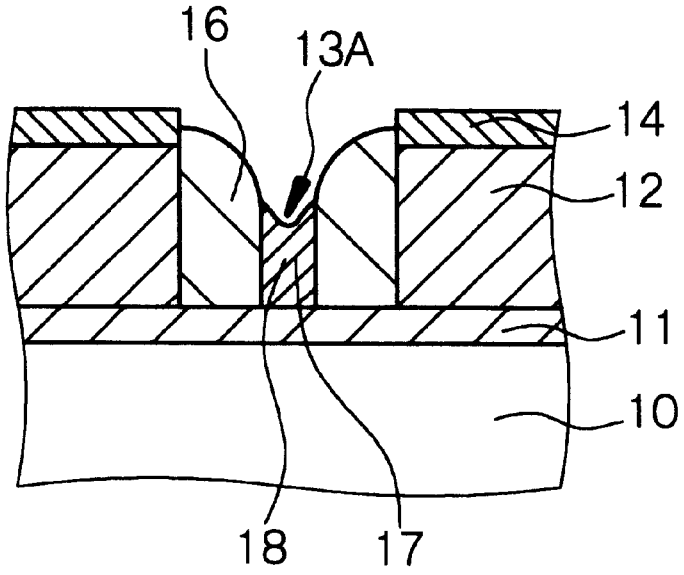

Then, an approximately 200 nm thick second conductive layer 17 composed of tungsten is formed on the entire surface (specifically, on the insulating interlayer 12 and the gate electrode 14) including the insides of the diameter-decreased opening portion 13A and 15A by a CVD method under conditions shown in the following Table 1 as an example (see FIG. 6A). A concave portion is formed in the second conductive layer 17 above the opening portion 15A formed in the gate electrode 14 due to an influence of a height difference between the upper surface of the gate electrode 14 and the bottom surface of the opening portion 13A. And, the second conductive layer 17 is etched back by an RIE method under conditions shown in the following Table 2 as an example, whereby the emitter electrode 18 which has the form of a column (which cross-sectional form is a circle in Example 1) and is constituted of the second conductive layer (tungsten layer) 17 can be formed in the opening portion 13A formed in the insulating interlayer 12 in a self-alignment manner (see FIG. 6B). Under the etching conditions shown in Table 2, the gate electrode 14 composed of aluminum is hardly etched. Further, when the second conductive layer 17 is etched back, the pit 18C is formed in the central portion of the top surface 18A of the emitter electrode 18 due to an influence of the concave portion formed in the second conductive layer 17 above the opening portion 15A formed in the gate electrode 14, and as a result, the acute-angled portion 18B is formed on the top surface 18A of the emitter electrode 18. That is, the acute-angled portion 18B is constituted of a surface 18D spreading from the pit 18C formed in the central portion of the top surface 18A to a peripheral portion of the top surface and the side surface 18E of the emitter electrode 18. Desirably, prior to the formation of the second conductive layer 17 by a low pressure CVD method, an adhesiveness improving layer (not shown) composed of Ti or TiN is formed on the entire surface including the inner surfaces of the opening portions 13 and 15 by a sputtering method or a CVD method for improving the adhesion between the emitter electrode and the electrode layer 11.

TABLE 1

| | |
|---|---|
| Gas used | $WF_6/H_2$ = 95/700 sccm |
| Pressure | $1.2 \times 10^4$ Pa |
| Substrate temperature | 430° C. |

TABLE 2

| | |
|---|---|
| Gas used | $SF_6/O_2/Ar$ = 150/30/90 sccm |
| Pressure | 35 Pa |
| RF wave power | 700 W |

[Step-150]

Then, at least an upper portion of the side-wall 16 is removed (etched) to form the cavity portion 19 below the opening portion 15 formed in the gate electrode 14 (see FIG. 1A). In Example 1, the upper portion of the side-wall 16 and part of the insulating interlayer 12 positioned immediately below the edge portion 15A of the opening portion 15 formed in the gate electrode 14 are etched by isotropic etching using $CF_4$ gas or the like. That is, the cavity portion 19 is formed below the opening portion 15 formed in the gate electrode 14 such that no side-wall 16 is present on an imaginary segment line connecting the top surface 18A of the emitter electrode 18 and the edge portion 15A of the opening portion 15 formed in the gate electrode 14, whereby there can be obtained a structure in which the edge portion 15A of the opening portion 15 formed in the gate electrode 14 is projected over the upper end portion of the opening portion 13 formed in the insulating interlayer 12. In the above steps, the field emission device of Example 1 can be produced.

[Step-160]

For producing the field emission display, the transparent substrate 20 constituted of a glass substrate is prepared. The fluorescent layer 22 (each pixel emits one of three colors of red, green and blue) is formed on the transparent substrate 20, and further, the second electrode layer (anode electrode layer) 21 is formed thereon. The second electrode layer (anode electrode layer) 21 can be formed by sputtering aluminum by a known method and then patterning it. Then, the transparent substrate 20 (front panel) and the dielectric supporting substrate 10 (rear panel) are attached and bonded to each other. The bonding (laminating) can be carried out by applying a seal material 24 of frit glass onto the transparent substrate 20 (front panel), the dielectric supporting substrate 10 (rear panel) and the frame 23 in advance, drying the seal material 24, interposing the frame 23 between the transparent substrate 20 (front panel) and the dielectric supporting substrate 10 (rear panel), and then sintering the frit at approximately 450° C. for 10 to 30 minutes. Then, a vacuum of approximately $10^{-4}$ Pa is provided inside the field emission display. Alternatively, interposing and sintering can be carried out in a vacuum chamber.

EXAMPLE 2

Figure 8A:
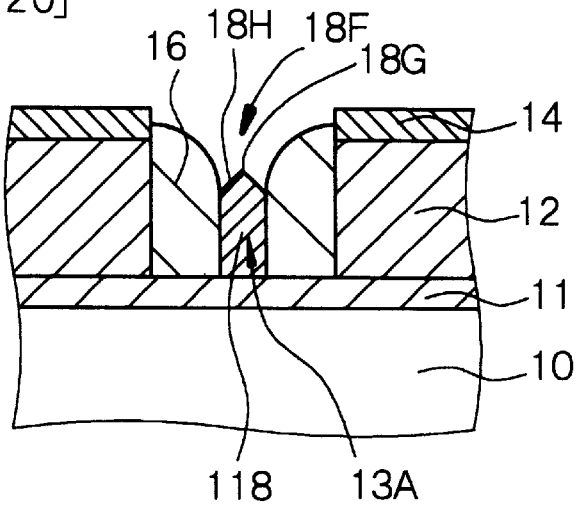
FIGS. 8A and 8B, following
Figure 8B:
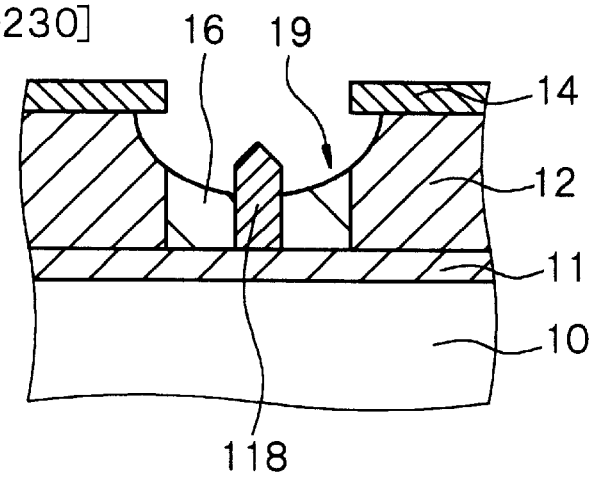

Example 2 is a variant of Example 1. The field emission device of Example 2 differs from the counterpart of Example 1 in the form of top surface of the field emission device. That is, in Example 2, as shown in FIG. 8A, an acute-angled portion 18G is formed on a top surface 18F of an emitter electrode 118, and the acute-angled portion 18G is constituted of a tip end surface 18H projecting toward the central portion of the top surface. That is, the top surface 18F of the emitter electrode 118 has a conical form. The emitter electrode 118 in Example 2 is formed, after a gate electrode 14 is formed on an insulating interlayer 12, by forming opening portions 15 and 13 which penetrate the gate electrode 14 and the insulating interlayer 12 and have a bottom portion where an electrode layer (cathode electrode layer) 11 is exposed; forming a side-wall 16 composed of an insulating material on the side walls of the opening portion 13 and 15, to decrease the opening portions 13 and 15 in diameter; forming a second conductive layer 17 on the entire surface (specifically, on the insulating interlayer 12 and the gate electrode 14) including the insides of the opening portions 13A and 15A by a CVD method; forming a mask material layer 50 on the entire surface; partly removing the mask material layer 50 to leave the mask material layer 50A on the second conductive layer 17 above the opening portion 13A formed in the insulating interlayer 12; and then, etching back the second conductive layer 17. In Example 2, the insulating interlayer 12 is composed of $SiO_2$, and the side-wall 16 is composed of SiN. A concave portion is formed in the second conductive layer 17 above the opening portion 13A formed in the insulating interlayer 12 due to a height level difference between the upper surface of the gate electrode 14 and the bottom of the opening portion 13A. The mask material layer 50A is left in the concave portion.

The processes for the production of the field emission device and the field emission display in Example 2 will be explained with reference to FIGS. 7A, 7B, 8A and 8B showing schematic partial end views of a dielectric supporting substrate and the like, hereinafter.

[Step-200]

The step of forming a patterned electrode layer (cathode electrode layer) 11 on a dielectric supporting substrate 10, the step of forming an insulating interlayer 12 on the dielectric supporting substrate 10 and the electrode layer 11, the step of forming a gate electrode 14 on the insulating interlayer 12, the step of forming opening portions 15 and 13 which penetrate through the gate electrode 14 and the insulating interlayer 12 and have a bottom portion in which the electrode layer 11 is exposed, the step of forming a side-wall 16 composed of an insulating material on the side walls of the opening portions 13 and 15 to decrease the opening portions 13 and 15 in diameter, and the step of forming a second conductive layer 17 composed of tungsten on the entire surface (specifically, on the insulating interlayer 12 and the gate electrode 14) including the insides of the diameter-decreased opening portions 13A and 15A by a CVD method can be carried out in the same manner as in [Step-100] to [Step-130] and the formation of the second conductive layer composed of tungsten in [Step-140] in Example 1, and explanations thereof are therefore omitted. In a step similar to the [Step-130] in Example 1, a side-wall composed of an insulating material (SiN) is formed on the side walls of the opening portions 13 and 15 for decreasing the opening portions 13 and 15 in diameter. Specifically, an insulating material layer 16A composed of SiN is deposited on the entire surface by a plasma-enhanced CVD method. Then, the insulating material layer 16A is etched back by an RIE method using $CHF_3/O_2$ gas, to form the side-wall 16 on the side walls of the opening portions 13 and 15. The side-wall 16 may be formed on the side wall of the opening portion 13 alone.

[Step-210]

Figure 7A:
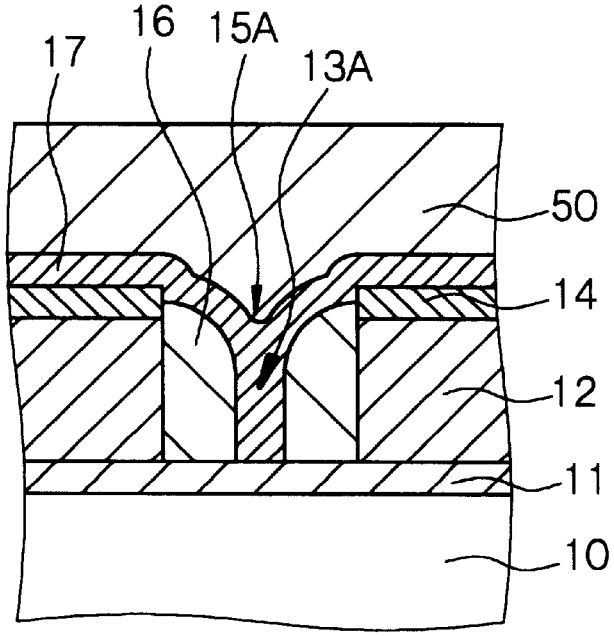
FIGS. 7A and 7B are schematic partial end views of a dielectric supporting substrate, etc., for explaining the processes for the production of a cold cathode field emission device and a cold cathode field emission display in Example 2.
Figure 7B:
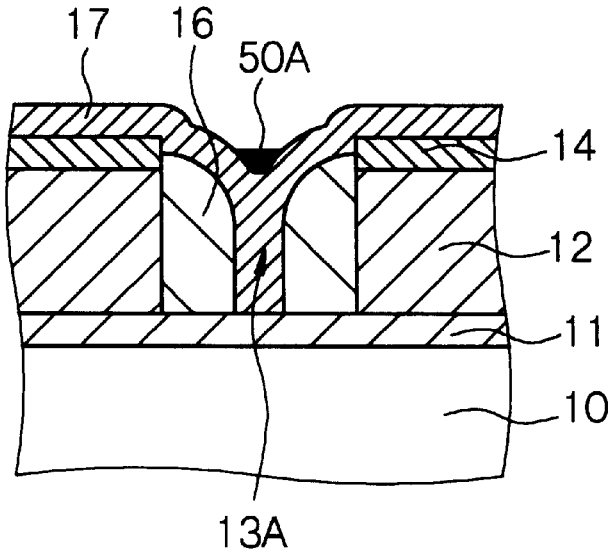

Then, an approximately 0.77 $\mu$m thick mask material layer 50 composed of a resist material is formed on the entire surface (see FIG. 7A), and the mask material layer 50 is partly removed by ashing treatment using oxygen gas, whereby a mask material layer 50A is left on the second conductive layer 17 above the opening portion 13A formed in the insulating interlayer 12 (see FIG. 7B). That is, the mask material layer 50A is left in the concave portion formed in the second conductive layer 17 above the opening portion 13A.

[Step-220]

Then, the second conductive layer 17 is etched back to form the emitter electrode 118 which has the form of a column and is constituted of the second conductive layer (tungsten layer) 17 in the opening portion 13A formed in the insulating interlayer 12 (see FIG. 8A). An emitter electrode which has the form of a column and is constituted of the second conductive layer (tungsten layer) 17 may be formed in the opening portion 13A formed in the insulating interlayer 12 and in the opening portion 15 formed in the gate electrode 14. This point is also applicable to other Examples. When the second conductive layer 17 is etched back, the second conductive layer 17 is etched back under conditions where the etching rate of the second conductive layer 17 is higher than the etching rate of the mask material layer 50. Specifically, by changing the flow rate of oxygen gas under etching conditions shown in Table 2, there can be obtained etching conditions where the etching rate of the second conductive layer 17 is, for example, approximately 1.5 when the etching rate of the mask material layer 50 is 1. In this manner, the second conductive layer 17 on which no mask material layer 50A is left is etched from the beginning of the etching back, the etching of the second conductive layer 17 on which the mask material layer 50A having a smaller thickness is left is initiated some time later, and the etching of the second conductive layer 17 on which the mask material layer 50A having a larger thickness is initiated after a longer time is taken. Due to the above difference in the time of initiation of etching back of the second conductive layer 17, the emitter electrode 118 whose top end is sharpened as shown in FIG. 8A can be obtained.

[Step-230]

Then, [Step-150] in Example 1 is carried out to produce the field emission device of Example 2, and further, [Step-160] in Example 1 is carried out to produce the field emission display of Example 2. In a step similar to [Step-150] in Example 1, the upper portion of the side-wall 16 and part of the insulating interlayer 12 positioned immediately below the edge portion 15A of the opening portion 15 formed in the gate electrode 14 are removed (etched) by carrying out isotropic etching with $CF_4/O_2$ gas or the like.

Figure 9:
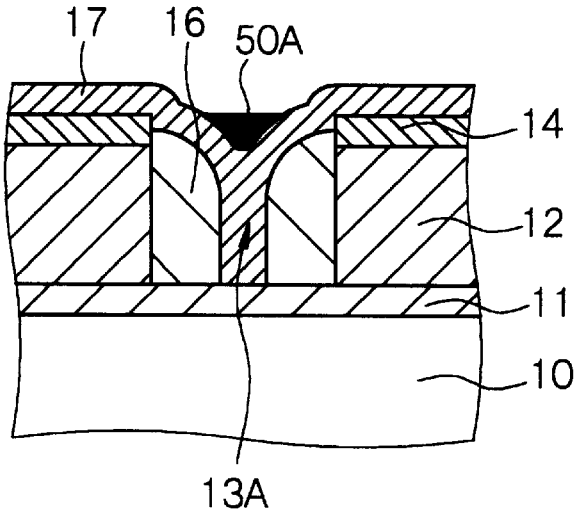
FIG. 9 is a schematic partial end view of a variant of the process for the production of the cold cathode field emission device explained in Example 2.

The acute-angled portion 18G formed on the top surface 18F of the emitter electrode 118 in Example 2 can be formed as desired mainly by controlling the ratio of the etching rate of the mask material layer 50 and the etching rate of the second conductive layer 17. That is, an acute-angled portion 18G having an acute-angled form to a higher degree can be formed on the top surface 18F of the emitter electrode 118 by setting the etching rate of the second conductive layer 17 at a higher rate than the etching rate of the mask material layer 50, i.e., by making the etching of the second conductive layer 17 faster than the etching of the mask material layer 50. When the mask material layer 50 is allowed to be left on the second conductive layer 17 above the opening portion 13A formed in the insulating interlayer 12, it is not necessarily required to rigorously leave the mask material layer 50A on the second conductive layer 17 above the opening portion 13A. As shown in FIG. 9, the mask material layer 50A may be left to have a broadened area on the second conductive layer 17 which is broadened from a portion above the opening portion 13A.

EXAMPLE 3

Figure 10A:
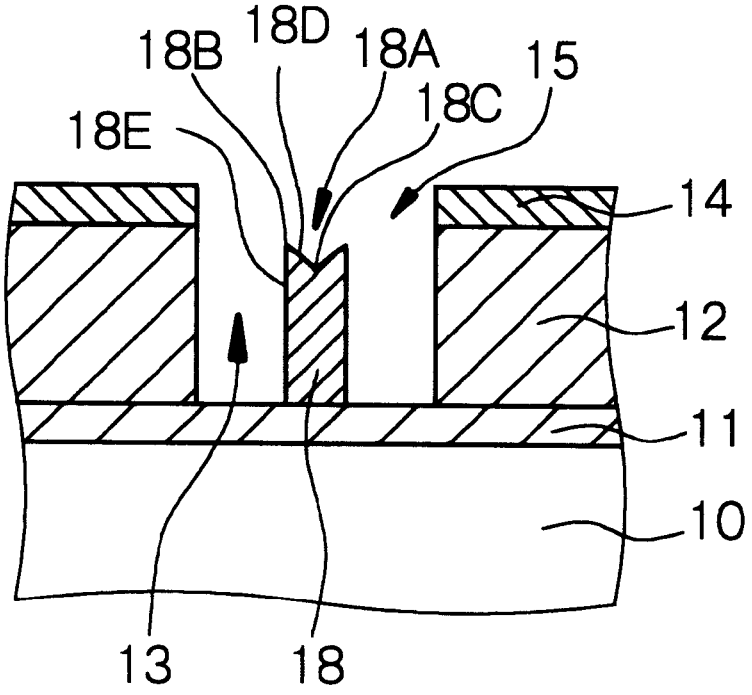
FIGS. 10A and 10B are schematic partial end views of cold cathode field emission devices in Examples 3 and 4.

Example 3 is concerned with the field emission device, the field emission display and the processes for the production thereof, according to the second aspect of the present invention. FIG. 10A shows a schematic partial end view of the field emission device of Example 3. When cut with a perpendicular plane, the field emission display of Example 3 has a conceptual view similar to that shown in FIG. 1B. Further, for a configuration of part of the electrode layers (cathode electrode layers) 11 and the gate electrodes 14 in the field emission display, a configuration of the electrode layer (cathode electrode layer) 11 and the gate electrode 14 in one pixel and a perspective view of the field emission display, see FIGS. 2A, 2B and 3A. Further, the basic configuration of the field emission device in Example 3 is similar to the configuration of the field emission device explained in Example 1, and the emitter electrode 18 has a top portion as shown in the enlarged view of FIG. 3B.

The emitter electrode 18 in Example 3 is formed, after the gate electrode 14 is formed on the insulating interlayer 12, by forming opening portions 15 and 13 which penetrate the gate electrode 14 and the insulating interlayer 12 and have a bottom portion where the electrode layer 11 is exposed; forming an insulating material layer 16B on the entire surface (specifically, on the gate electrode 14) including the surfaces of the side walls of the opening portions 13 and 15, to decrease the opening portions 13 and 15 in diameter; forming a second conductive layer 17 on the insulating interlayer 16B and in the diameter-decreased opening portions 13A and 15A by a CVD method; and then, etching back the second conductive layer 17.

The processes for the production of the field emission device and the field emission display having the field emission devices in Example 3 will be explained with reference to FIGS. 11A, 11B, 12A and 12B showing schematic partial end views of a dielectric supporting substrate and the like, hereinafter.

[Step-300]

The step of forming a patterned electrode layer (cathode electrode layer) 11 on a dielectric supporting substrate 10, the step of forming an insulating interlayer 12 on the dielectric supporting substrate 10 and the electrode layer 11, the step of forming a gate electrode 14 on the insulating interlayer 12 and the step of forming opening portions 15 and 13 which penetrate through the gate electrode 14 and the insulating interlayer 12 and have a bottom portion in which the electrode layer 11 is exposed can be carried out in the same manner as in [Step-100] to [Step-120] in Example 1, and explanations thereof are therefore omitted.

[Step-310]

Then, an insulating material layer 16B composed of $SiO_2$ is formed on the entire surface including the surfaces of side walls of the opening portions 13 and 15, to decrease the opening portions 13 and 15 in diameter. Specifically, the insulating material layer 16B composed of $SiO_2$ is deposited on the gate electrode 14 including the inner surfaces of the opening portions 13 and 15 by a plasma-enhanced TEOS-CVD method (see FIG. 11A). Then, the insulating material layer 16B is etched back by an RIE method using $CF_4$ gas, to leave the insulating material layer 16B on the side walls of the opening portions 13 and 15 and on the gate electrode 14 (see FIG. 11B). In the bottom portion of the diameter-decreased opening portion 13A, a surface of the electrode layer 11 is exposed. The opening portion 13A is formed in a self-alignment manner, and the axial line passing through the center of the opening portion 13A and the axial line L passing through the center of the opening portion 15 are in agreement. When the emitter electrode is formed in a step to follow, the emitter electrode is formed in a self-alignment manner, and the axial line passing through the center of the emitter electrode is in agreement with the axial line L passing through the center of the opening portion 15.

[Step-320]

Figure 12A:
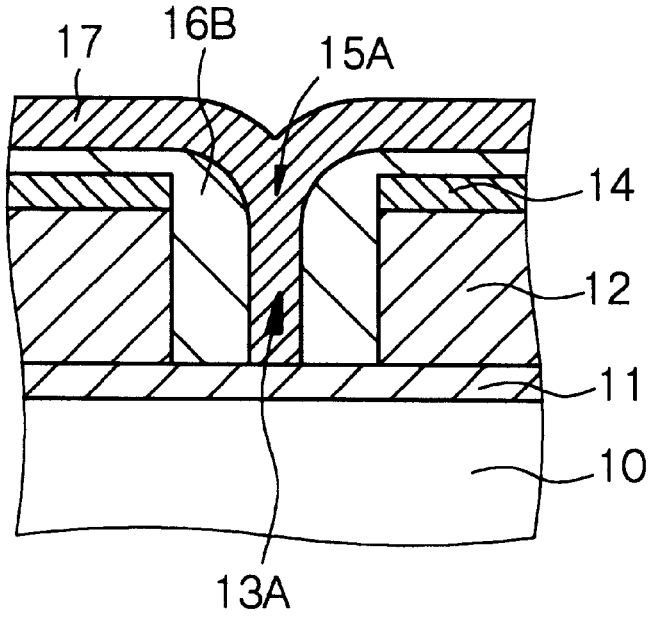
FIGS. 12A and 12B, following
Figure 12B:
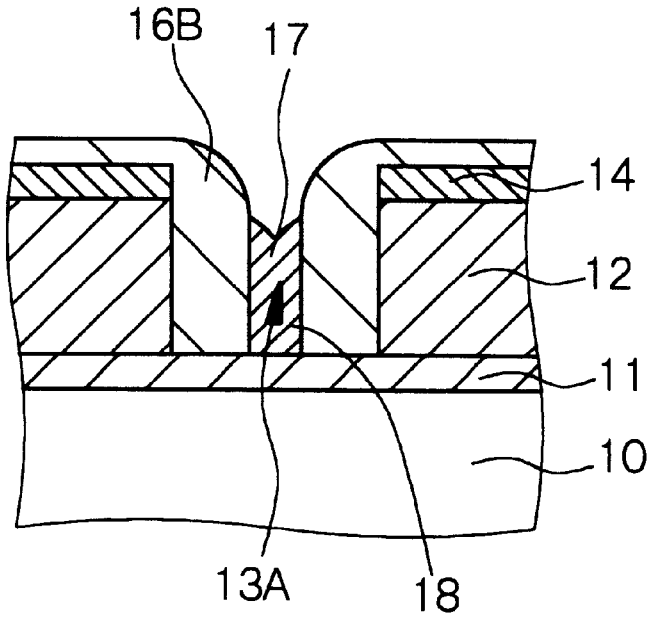

Then, a second conductive layer 17 composed of tungsten is formed on the insulating material layer 16B and in the opening portions 13A and 15A by a CVD method under conditions shown in Table 1 as an example (see FIG. 12A). Then, the second conductive layer 17 is etched back by an RIE method under conditions shown in Table 2 as an example, whereby the emitter electrode 18 which has the form of a column (which cross section form is a circle) and is constituted of the second conductive layer (tungsten layer) 17 can be formed in the opening portion 13A formed in the insulating interlayer 12 (see FIG. 12B) in a self-alignment manner. When the second conductive layer 17 is etched back, a pit 18C is formed in the central portion of the top surface 18A of the emitter electrode 18, and as a result, the acute-angled portion 18B is formed on the top surface 18A of the emitter electrode 18. That is, the acute-angled portion 18B is constituted of a surface 18D spreading from the pit 18C formed in the central portion of the top surface 18A to a peripheral portion of the top surface and a side surface 18E of the emitter electrode 18. Desirably, prior to the formation of the second conductive layer 17 by a low pressure CVD method, an adhesiveness improving layer (not shown) composed of Ti or TiN is formed on the entire surface including the inner surfaces of the opening portions 13A and 15A by a CVD method or a sputtering method for improving the adhesion between the emitter electrode and the electrode layer 11.

[Step-330]

Then, the insulating material layer 16B is etched, whereby a field emission device having a structure shown in FIG. 10A can be produced, and further, [Step-160] in Example 1 is carried out to produce a field emission display.

In Example 3, the second conductive layer 17 is etched in a state where the gate electrode 14 is covered with the insulating material layer 16B. Therefore, the freedom of selection of combination of a material for forming the gate electrode 14 and a material for forming the second conductive layer 17 is increased. Particularly advantageously, the material for forming the gate electrode 14 can be selected from a broader range of materials, and the second conductive layer 17 is no longer required to be selectively etched back with regard to the gate electrode 14.

EXAMPLE 4

Figure 10B:
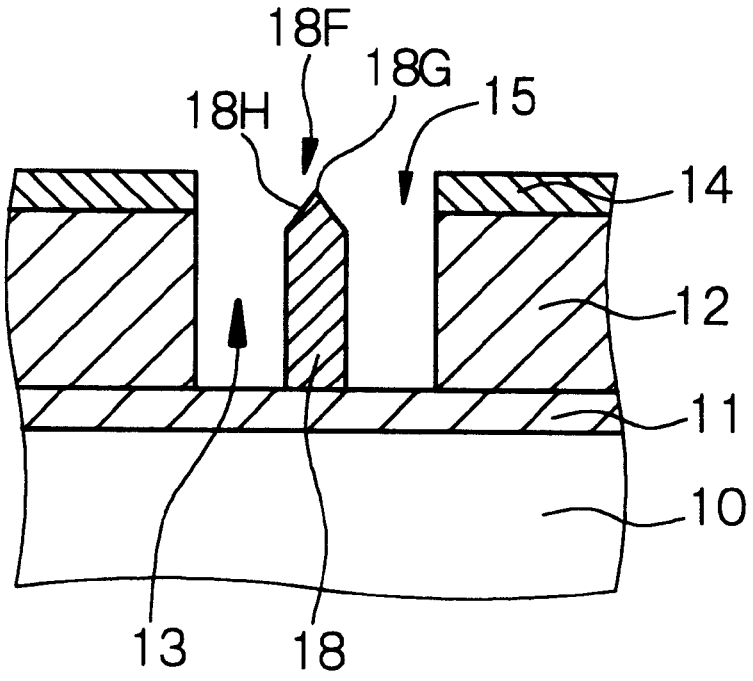
Figure 11A:
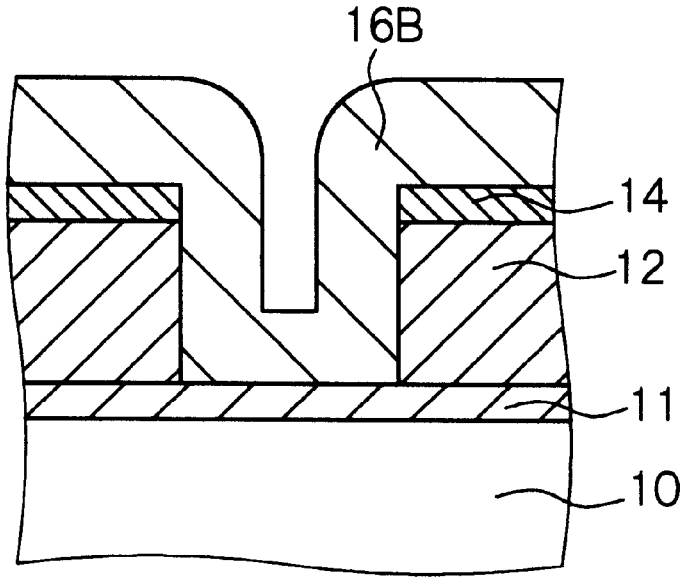
FIGS. 11A and 11B are schematic partial end views of a dielectric supporting substrate, etc., for explaining the processes for the production of the cold cathode field emission device and the cold cathode field emission display in Example 3.
Figure 11B:
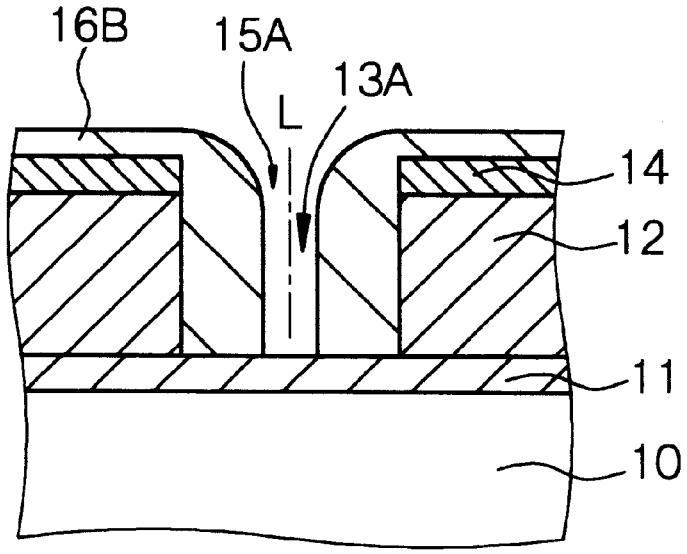

Example 4 is a variant of Example 3. The field emission device of Example 4 differs from the counterpart of Example 3 in the form of top surface of the field emission device. That is, in Example 4, as shown in FIG. 10B, an acute-angled portion 18G is formed on a top surface 18F of an emitter electrode 118, and the acute-angled portion 18G is constituted of a tip end surface 18H projecting toward the central portion of the top surface. That is, the top surface 18F of the emitter electrode 118 has a conical form. The emitter electrode 118 in Example 4 is formed, after the gate electrode 14 is formed on the insulating interlayer 12, by forming opening portions 15 and 13 which penetrate through the gate electrode 14 and the insulating interlayer 12 and have a bottom portion where the electrode layer (cathode electrode layer) 11 is exposed; forming an insulating material layer 16B on the entire surface (specifically, on the gate electrode 14) including the surfaces of side walls of the opening portions 13 and 15, to decrease the opening portions 13 and 15 in diameter; forming a second conductive layer 17 on the insulating material layer 16B and in the diameter-decreased opening portions 13A and 15A by a CVD method; forming a mask material layer 50 on the entire surface; partly removing the mask material layer 50 to leave the mask material layer 50A on the second conductive layer 17 above the opening portion 13A formed in the insulating interlayer 12; and then, etching back the second conductive layer 17. In Example 4, the insulating interlayer 12 is composed of $SiO_2$, and the insulating material layer 16B is composed of SiN.

Figure 13A:
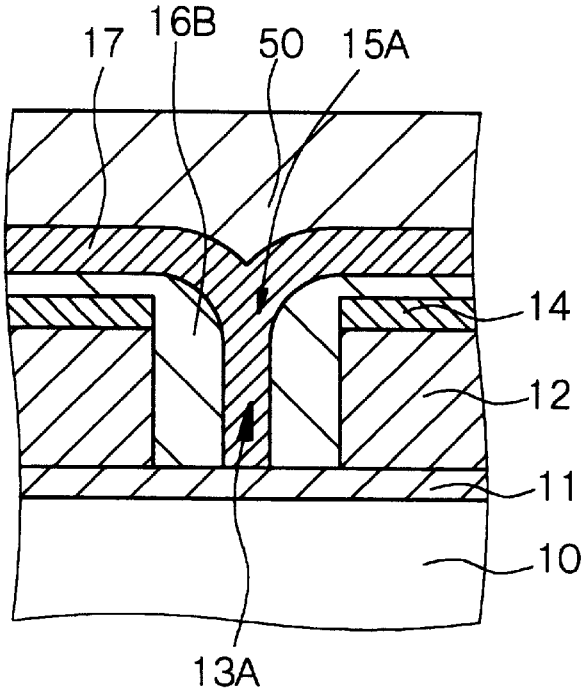
FIGS. 13A and 13B are schematic partial end views of a dielectric supporting substrate, etc., for explaining the processes for the production of a cold cathode field emission device and a cold cathode field emission display in Example 4.
Figure 13B:
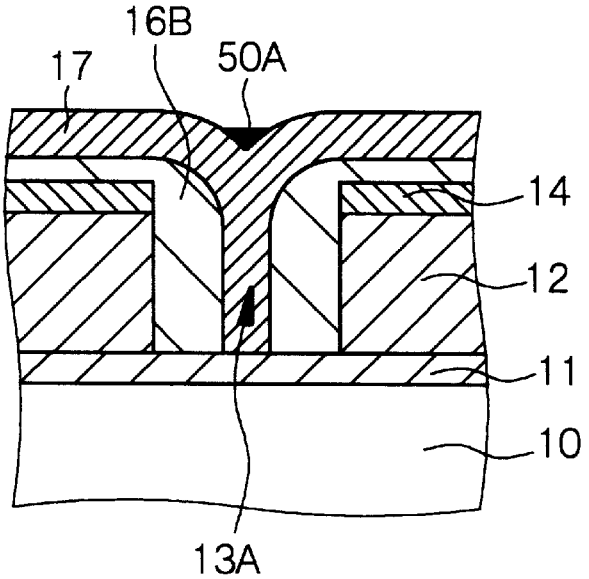
Figure 14:
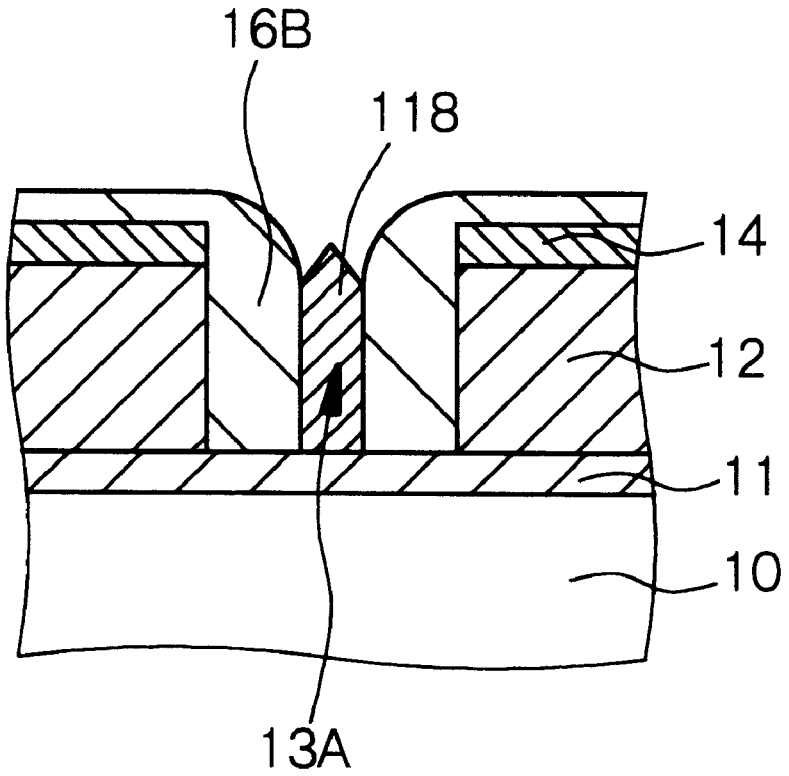
FIG. 14, following
Figure 15A:
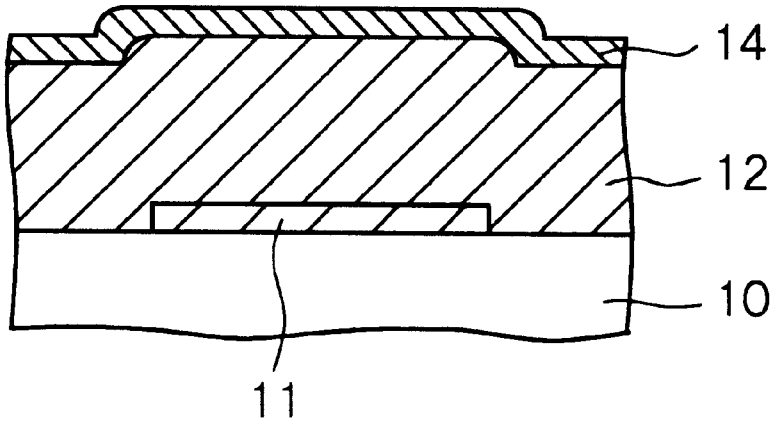
FIGS. 15A and 15B are schematic partial end views of a dielectric supporting substrate, etc., for generally explaining the processes for the production of a cold cathode field emission device and a cold cathode field emission display in Example 5.
Figure 15B:
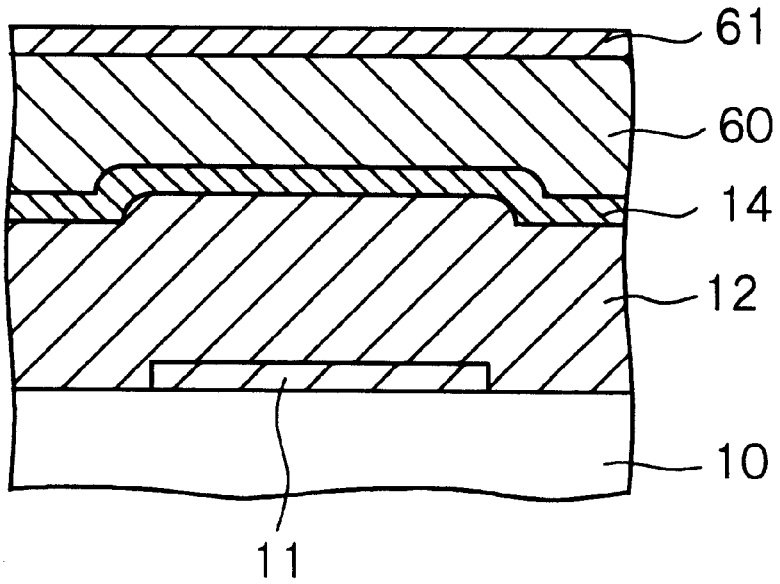

The processes for the production of the field emission device and the field emission display in Example 4 will be explained with reference to FIGS. 13A, 13B and 14 showing schematic partial end views of a dielectric supporting substrate and the like, hereinafter.

[Step-400]

The step of forming a patterned electrode layer (cathode electrode layer) 11 on a dielectric supporting substrate 10, the step of forming an insulating interlayer 12 on the dielectric supporting substrate 10 and the electrode layer 11, the step of forming a gate electrode 14 on the insulating interlayer 12, the step of forming opening portions 15 and 13 which penetrate through the gate electrode 14 and the insulating interlayer 12 and have a bottom portion in which the electrode layer 11 is exposed, the step of forming an insulating material layer 16B on the entire surface (specifically, on the gate electrode 14) including the surfaces of side walls of the opening portions 13 and 15 to decrease the opening portions 13 and 15 in diameter, and the step of forming a second conductive layer 17 composed of tungsten on the insulating material layer 16B and in the diameter-decreased opening portions 13A and 15A can be carried out in the same manner as in [Step-300] to [Step-310] and the formation of the second conductive layer composed of tungsten in [Step-320] in Example 3, and explanations thereof are therefore omitted. In a step similar to [Step-310] in Example 3, the insulating material layer 16B composed of SiN is deposited on the entire surface by a plasma-enhanced CVD method for decreasing the opening portions 13 and 15 in diameter. Then, the insulating material layer 16B is etched back by an RIE method using $CHF_3/O_2$ gas or the like, to form the insulating material layer 16B on the gate electrode 14 including the surfaces of side walls of the opening portions 13 and 15.

[Step-410]

Then, a mask material layer 50 composed of a resist material is formed on the entire surface (see FIG. 13A), and the mask material layer 50 is partly removed by ashing treatment using oxygen gas or the like, whereby the mask material layer 50A is left on the second conductive layer 17 above the opening portion 13A formed in the insulating interlayer 12 (see FIG. 13B). That is, the mask material layer 50A is left in a concave portion formed in the second conductive layer 17 above the opening portion 13A.

[Step-420]

Then, the second conductive layer 17 is etched back to form the emitter electrode 118 which has the form of a column and is constituted of the second conductive layer (tungsten layer) 17 in the opening portion 13A formed in the insulating interlayer 12 (see FIG. 14). When the second conductive layer 17 is etched back, the second conductive layer 17 is etched back under conditions where the etching rate of the second conductive layer 17 is higher than the etching rate of the mask material layer 50. Specifically, by changing the flow rate of oxygen gas under etching conditions shown in Table 2, there can be obtained etching conditions where the etching rate of the second conductive layer 17 is, for example, approximately 1.5 when the etching rate of the mask material layer 50 is 1. In this manner, the second conductive layer 17 on which no mask material layer 50A is left is etched from the beginning of the etching back, the etching of the second conductive layer 17 on which the mask material layer 50A having a smaller thickness is left is initiated some time later, and the etching of the second conductive layer 17 on which the mask material layer 50A having a larger thickness is initiated after a longer time is taken. Due to the above difference in the time of initiation of etching back of the second conductive layer 17, the emitter electrode 118 whose top end is sharpened as shown in FIG. 14 can be obtained.

[Step-430]

Then, [Step-330] in Example 3 is carried out to produce the field emission device of Example 4, and further, [Step-160] in Example 1 is carried out to produce the field emission display.

The acute-angled portion 18G formed on the top surface 18F of the emitter electrode 118 in Example 4 can be formed as desired mainly by controlling the ratio of the etching rate of the mask material layer 50 and the etching rate of the second conductive layer 17. That is, an acute-angled portion 18G having an acute-angled form to a higher degree can be formed on the top surface 18F of the emitter electrode 118 by setting the etching rate of the second conductive layer 17 at a higher rate than the etching rate of the mask material layer 50, i.e., by making the etching of the second conductive layer 17 faster than the etching of the mask material layer 50. When the mask material layer 50 is allowed to be left on the second conductive layer 17 above the opening portion 13A formed in the insulating interlayer 12, it is not necessarily required to rigorously leave the mask material layer 50A on the second conductive layer 17 above the opening portion 13A. As shown in FIG. 9, the mask material layer 50A may be left to have a broadened area on the second conductive layer 17 which is broadened from a portion above the opening portion 13A.

EXAMPLE 5

Example 5 is a variant of Example 2. In the field emission device of Example 5, a focus electrode is formed above the gate electrode through an insulating film. The process for the production of the field emission device in Example 5 differs from the counterpart in Example 2 in that the process in Example 5 includes the steps, after the gate electrode is formed, of forming the insulating film on the entire surface and forming the focus electrode on the insulating film and that formed is an opening portion which penetrates through the focus electrode, the insulating film, the gate electrode and the insulating interlayer and has a bottom portion where the electrode layer is exposed.

The processes for the production of the field emission device and the field emission display in Example 5 will be explained with reference to FIGS. 15A, 15B, 16A, 16B and 17 showing schematic partial end views of a dielectric supporting substrate and the like, hereinafter.

[Step-500]

The step of forming a patterned electrode layer (cathode electrode layer) 11 on a dielectric supporting substrate 10, the step of forming an insulating interlayer 12 on the dielectric supporting substrate 10 and the electrode layer 11, and the step of forming a gate electrode 14 on the insulating interlayer 12 can be carried out in the same manner as in [Step-100] and the formation of the gate electrode 14 in [Step-110] in Example 1, and explanations thereof are therefore omitted. In this manner, a structure shown in FIG. 15A can be obtained.

[Step-510]

Then, an insulating film 60 composed of SiN is formed on the entire surface by a known CVD method, and then, a focus electrode 61 is formed on the insulating film 60. The focus electrode 61 can be obtained by forming an aluminum layer on the insulating film 60 by a sputtering method and etching the aluminum layer to form a predetermined pattern. In this manner, a structure shown in FIG. 15B can be obtained.

[Step-520]

Then, a resist layer 40 is formed on the entire surface (specifically, on the insulating film 60 and the focus electrode 61) by a lithography method, and then an opening portion 62 which penetrates through the focus electrode 61, the insulating film 60, the gate electrode 14 and the insulating interlayer 12 and has a bottom portion where the electrode layer 11 is exposed is formed. For etching the focus electrode 61 and the gate electrode 14, a chlorine-base etching gas can be used, and for etching the insulating film 60 composed of SiN and the insulating interlayer 12 composed of $SiO_2$, $CF_4$ gas or the like can be used. In this manner, a structure shown in FIG. 16A can be obtained.

Figure 16A:
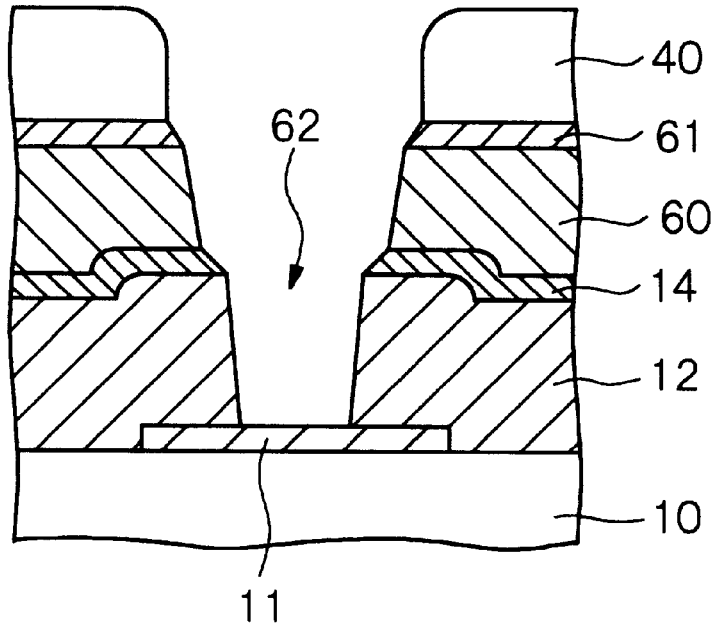
FIGS. 16A and 16B, following
Figure 16B:
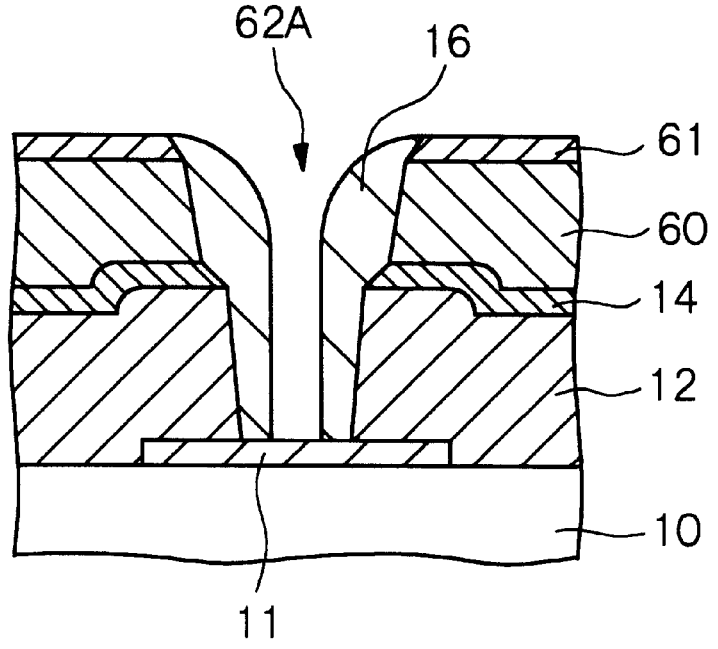

In the structure shown in FIG. 16A, the side wall of each of the opening portions formed in the focus electrode 61, the insulating film 60, the gate electrode 14 and the insulating interlayer 12 is inclined. This inclination is attained, for example, by employing conditions for decreasing the etching resistivity of the resist layer 40 such as an increase in the ratio of flow rate of oxygen gas in an etching gas so as to gradually remove a patterned edge of the resist layer 40 backward as the etching proceeds, although the method of forming the inclination shall not be limited to the above means. The opening diameter of the opening portion 62 is therefore not uniform along the depth direction, and the opening portion formed in the focus electrode 61 has a greater diameter than the opening portion formed in the gate electrode 14. That is, the top end portion of the focus electrode 61 is located more backward than the top end portion of the gate electrode 14. The purpose of the focus electrode 61 is originally to correct the path of electrons which may deviate from the direction perpendicular to the electrode layer 11 to a great extent, and when the opening diameter of the focus electrode 61 is too small, the electron emission efficiency of the field emission device may decrease. However, when the focus electrode 61 has a larger opening diameter than the gate electrode 14, i.e., when the diameter of the opening portion formed in the gate electrode 14 is adjusted to be smaller than the diameter of the opening portion formed in the focus electrode 61 by properly controlling the etching conditions of the focus electrode 61 and the gate electrode 14, a required focusing effect alone can be obtained without preventing the emission of electrons, which is the most desirable.

[Step-530]

Thereafter, the steps of removing the resist layer 40 and forming the side-wall 16 of an insulating material (for example, SiN) on the side wall of the opening portion 62 (see FIG. 16B) to decrease the opening portion 62 in diameter, and the step of forming the second conductive layer composed of tungsten on the entire surface (specifically, on the insulating film 60 and the focus electrode 61) including the inside of the diameter-decreased opening portion 62A by a CVD method can be carried out in the same manner as in [Step-130] and the formation of the second conductive layer composed of tungsten in [Step-140] in Example 1, and explanations thereof are therefore omitted.

[Step-540]

Then, an approximately 0.77 μm thick mask material layer is formed on the entire surface, and the mask material layer is partly removed by ashing treatment using oxygen gas, in the same manner as in [Step-210] in Example 2, whereby the mask material layer is left on the second conductive layer above the opening portion formed in the insulating interlayer 12.

[Step-550]

Then, the second conductive layer is etched back in the same manner as in [Step-220] in Example 2, to form an emitter electrode 118 which has the form of a column and is constituted of the second conductive layer (tungsten layer) in the opening portion formed in the insulating interlayer 12. When the second conductive layer is etched back, the second conductive layer is etched back under conditions where the etching rate of the second conductive layer is higher than the etching rate of the mask material layer. Specifically, by changing the flow rate of oxygen gas under conditions shown in Table 2, there can be obtained conditions where the etching rate of the second conductive layer is approximately 1.5 when the etching rate of the mask material layer is 1. Due to the difference in the time of initiation of etching back of the second conductive layer, the emitter electrode 118 whose top end is sharpened as shown in FIG. 17 can be obtained.

[Step-560]

Figure 17:
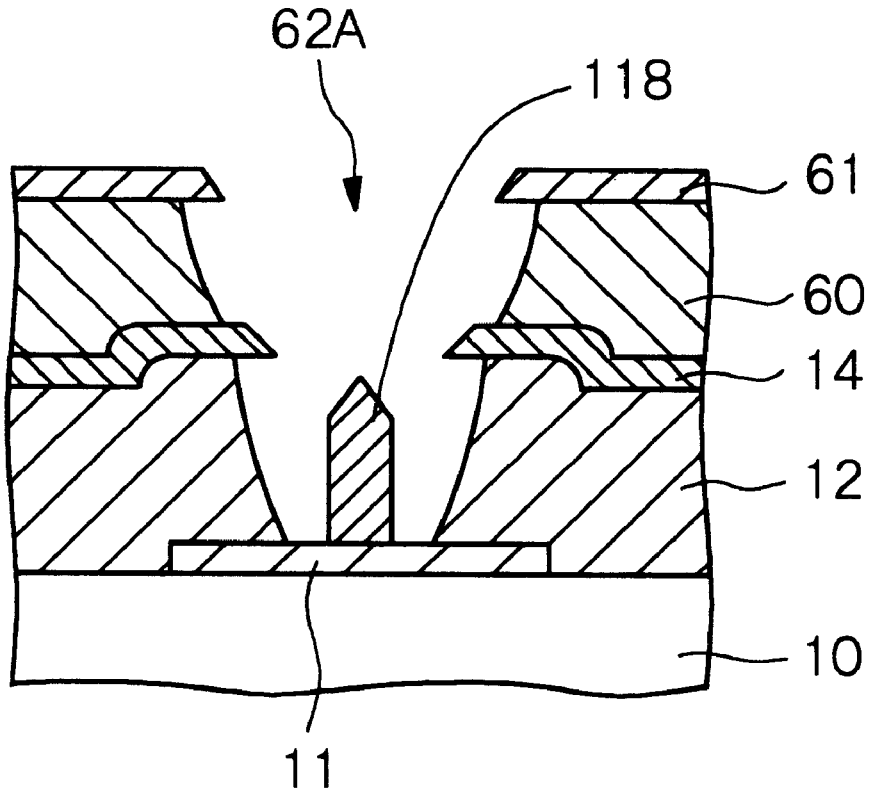
FIG. 17, following

Then, the side-wall 16 is removed, and further, the insulating film 60 and the insulating interlayer 12 are etched as required to broaden the opening portions formed in the insulating film 60 and the insulating interlayer 12, whereby the field emission device of Example 5 shown in FIG. 17 can be produced.

Alternatively, the etching back of the second conductive layer 17 explained in [Step-140] in Example 1 may be carried out to form the emitter electrode 18 shown in FIG. 3B.

EXAMPLE 6

Example 6 is concerned with the field emission device, the field emission display and the processes for the production thereof, according to the third aspect of the present invention. When cut with a perpendicular plane, the field emission display of Example 6 has a conceptual view similar to that shown in FIG. 1B. Further, for a configuration of part of the electrode layers (cathode electrode layers) 11 and the gate electrodes 14 in the field emission display, a configuration of the electrode layer (cathode electrode layer) 11 and the gate electrode 14 in one pixel and a perspective view of the field emission display, see FIGS. 2A, 2B and 3A. Further, the basic configuration of the field emission device in Example 6 is similar to the configuration of the field emission device explained in Example 2, and the emitter electrode 118 has a top portion similar to that shown in FIG. 8A.

In the field emission device or the field emission display in Example 6, the emitter electrode is formed by;

(1) forming a gate electrode 14 on an insulating interlayer 12, then forming an insulating film 60 on the entire surface, (2) forming a first opening portion 70 which penetrates through the insulating film 60 and has a bottom portion where the gate electrode 14 is exposed, (3) forming a first side-wall 71 composed of a first insulating material on the side wall of the first opening portion 70, to decrease the first opening portion 70 in diameter, (4) forming a second opening portion 72 which penetrates through the gate electrode 14 and the insulating interlayer 12 below the diameter-decreased first opening portion 70A and has a bottom portion where the electrode layer 11 is exposed, (5) forming a second side-wall 73 on the first side-wall 71 and the side wall of the second opening portion 72, to further decrease the first opening portion 70A in diameter and to decrease the second opening portion 72 in diameter, (6) forming a second conductive layer on the entire surface (specifically, on the insulating film 60) including the insides of the first and second opening portions 70A and 72A by a CVD method, (7) etching back the second conductive layer, and then (8) removing the first side-wall 71 and removing at least an upper portion of the second side-wall 73. Preferably, the insulating film 60 is finally removed, and substantially, the insulating film 60 works as a protective film for protecting the gate electrode 14 when the second conductive layer is etched back.

In the field emission device of Example 6, similarly, no second side-wall is present on an imaginary segment line connecting the top surface of the emitter electrode and the edge portion of the second opening portion formed in the gate electrode, and the edge portion of the second opening portion formed in the gate electrode is projected over the upper end portion of the second opening portion formed in the insulating interlayer. Further, an acute-angled portion is formed on the top surface of the emitter electrode, and the acute-angled portion is constituted of a tip end surface projecting toward the central portion of the top surface. The emitter electrode is formed by forming a second conductive layer on the entire surface including the insides of the first and second opening portions by a physical or chemical vapor deposition method; forming a mask material layer on the entire surface; partly removing the mask material layer to leave the mask material layer on the second conductive layer above the second opening portion formed in the insulating interlayer; etching back the second conductive layer; and then, removing the first side-wall and removing at least an upper portion of the second side-wall. That is, the top surface of the emitter electrode has a conical form. The emitter electrode having the above form can be obtained by etching back the second conductive layer under conditions where the etching rate of the second conductive layer is higher than the etching rate of the mask material layer.

In Example 2, after the formation of the opening portion which penetrates through the gate electrode and the insulating interlayer and has a bottom portion where the electrode layer is exposed, the side-wall is formed for decreasing the opening portion in diameter. In Example 4, after the formation of the opening portion which penetrates through the gate electrode and the insulating interlayer and has a bottom portion where the electrode layer is exposed, the opening portion is decreased in diameter by forming the insulating material layer on the entire surface including the surface of the side wall of the opening portion.

In the processes for the production of the field emission device and the field emission display in Example 6, an insulating film having a diameter-decreased first opening portion is formed on the gate electrode, then, a second opening portion which penetrates through the gate electrode and the insulating interlayer below the diameter-decreased first opening portion and has a bottom portion where the electrode layer is exposed is formed while the focus electrode and the first side-wall are used as etching masks, and a side-wall is formed for further decreasing the first opening portion in diameter and decreasing the second opening portion in diameter.

The processes for the production of the field emission device and the field emission display in Example 6 will be explained with reference to FIGS. 18A, 18B, 19A, 19B, 20A, 20B, 21A and 21B showing schematic partial end views of a dielectric supporting substrate and the like, hereinafter.

[Step-600]

The step of forming a patterned electrode layer (cathode electrode layer) 11 on a dielectric supporting substrate 10, the step of forming an insulating interlayer 12 on the dielectric supporting substrate 10 and the electrode layer 11, and the step of forming a gate electrode 14 on the insulating interlayer 12 can be carried out in the same manner as in [Step-100] and the formation of the gate electrode 14 in [Step-110] in Example 1, and explanations thereof are therefore omitted.

[Step-610]

Then, an insulating film 60 composed of SiN is formed on the entire surface by a known CVD method, and a resist layer 40 is formed on the insulating film 60 by a lithography method.

[Step-620]

Figure 18A:
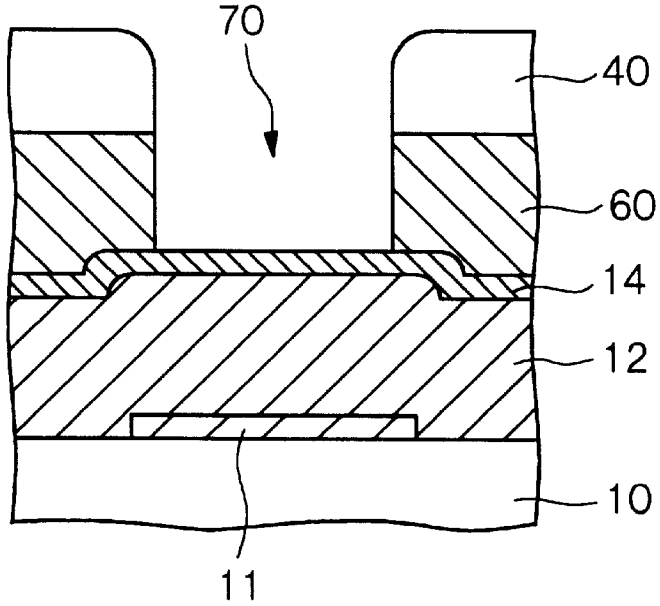
FIGS. 18A and 18B are schematic partial end views of a dielectric supporting substrate, etc., for explaining the processes for the production of a cold cathode field emission device and a cold cathode field emission display in Example 6.

Then, an RIE method using $CF_4$ gas is carried out to form a first opening portion 70 which penetrates through the insulating film 60 and has a bottom portion where the gate electrode 14 is exposed, whereby a structure shown in FIG. 18A can be obtained. The first opening portion 70 may have a diameter, for example, of 3 $\mu$m.

[Step-630]

Figure 18B:
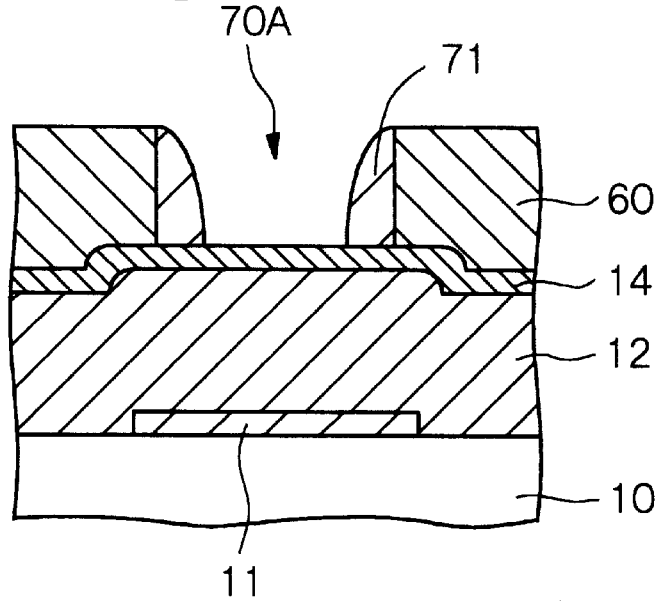

Then, the resist layer 40 is removed, and a first side wall 71 composed of a first insulating material (SiN in Example 6) is formed on the side wall of the first opening portion 70, to decrease the first opening portion 70 in diameter (see FIG. 18B). Specifically, an SiN layer is formed on the entire surface and in the first opening portion 70, for example, by a plasma-enhanced CVD method, and then the SiN layer is etched back until the gate electrode 14 is exposed.

[Step-640]

Then, a second opening portion 72 which penetrates through the gate electrode 14 and the insulating interlayer 12 below the diameter-decreased first opening portion 70A and has a bottom portion where the electrode layer 11 is exposed is formed. Specifically, while the insulating film 60 and the first side-wall 71 are used as etching masks, a second opening portion is formed in the gate electrode 14 by an RIE method using chlorine-base etching gas, and further, a second opening portion is formed in the insulating interlayer 12 by an RIE method using $CF_4$ gas or the like, whereby a structure shown in FIG. 19A can be obtained.

[Step-650]

Figure 19A:
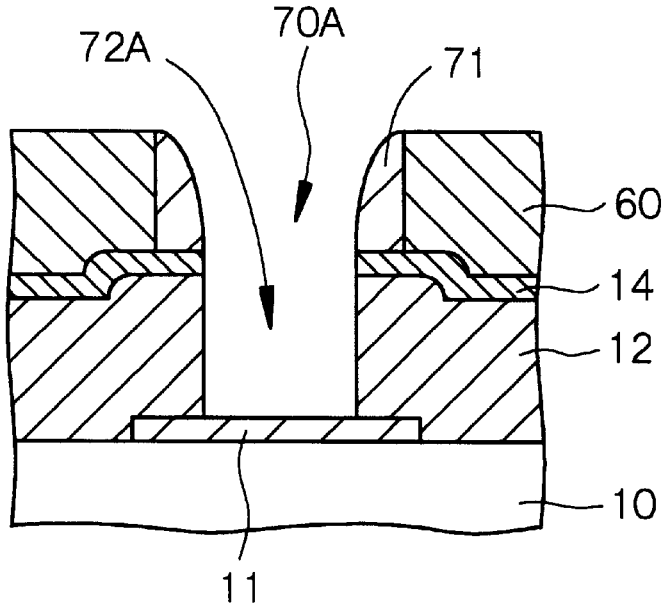
FIGS. 19A and 19B, following
Figure 19B:
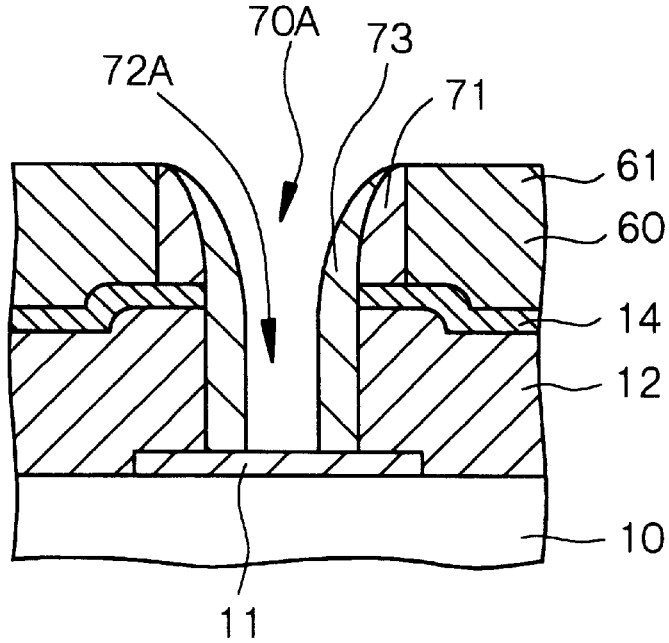

Then, a second side-wall 73 composed of a second insulating material ($SiO_2$ in Example 6) is formed on the first side-wall 71 and the side wall of the second opening portion 72, to further decrease the first opening portion 70A in diameter and to decrease the second opening portion 72A in diameter (see FIG. 19B). Specifically, an $SiO_2$ layer is formed on the entire surface and in the second opening portion 72, for example, by a plasma-enhanced CVD method, and the $SiO_2$ layer is etched back by an RIE method using $CF_4$ gas or the like until the electrode layer 11 is exposed.

[Step-660]

Then, a second conductive layer 17 composed of tungsten is formed on the entire surface including the insides of the first and second opening portions 70A and 72A by a CVD method, then, an approximately 0.35 $\mu$m thick mask material layer composed of a resist material is formed on the entire surface, the mask material layer is partly removed to leave the mask material layer 50A on the second conductive layer 17 above the second opening portion 72A formed in the insulating interlayer 12 (see FIG. 20A), and then, the second conductive layer 17 is etched back, thereby to form, in the second opening portion 72A, an emitter electrode 118 (whose top surface has a conical form) which has the form of a column, is constituted of the second conductive layer 17 and has an acute-angled portion on its top surface, the acute-angled portion being constituted of a tip end surface projecting toward the central portion of the top surface.

Figure 20A:
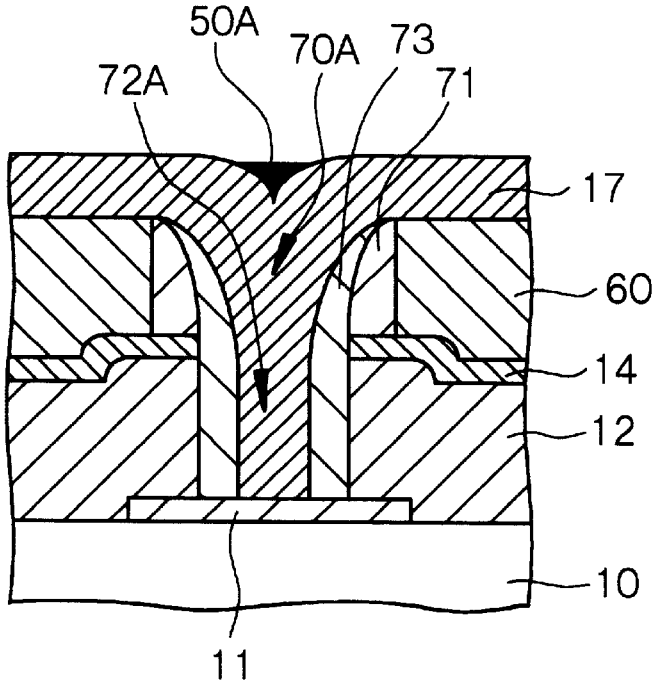
FIGS. 20A and 20B, following
Figure 20B:
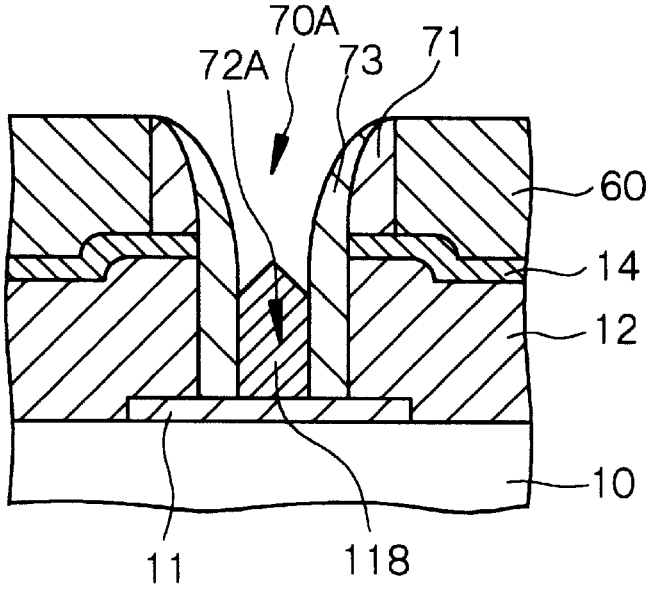

Specifically, the second conductive layer 17 can be etched back in the same manner as in [Step-220] in Example 2. When the second conductive layer 17 is etched back, the second conductive layer 17 is etched back under conditions where the etching rate of the second conductive layer 17 is higher than the etching rate of the mask material layer. Specifically, by changing the flow rate of oxygen gas under etching conditions shown in Table 2, there can be obtained etching conditions where the etching rate of the second conductive layer 17 is approximately 1.5 when the etching rate of the mask material layer is 1. Due to the difference in the time of initiation of etching back of the second conductive layer, the emitter electrode 118 whose top end is sharpened as shown in FIG. 20B can be obtained.

[Step-670]

Figure 21A:
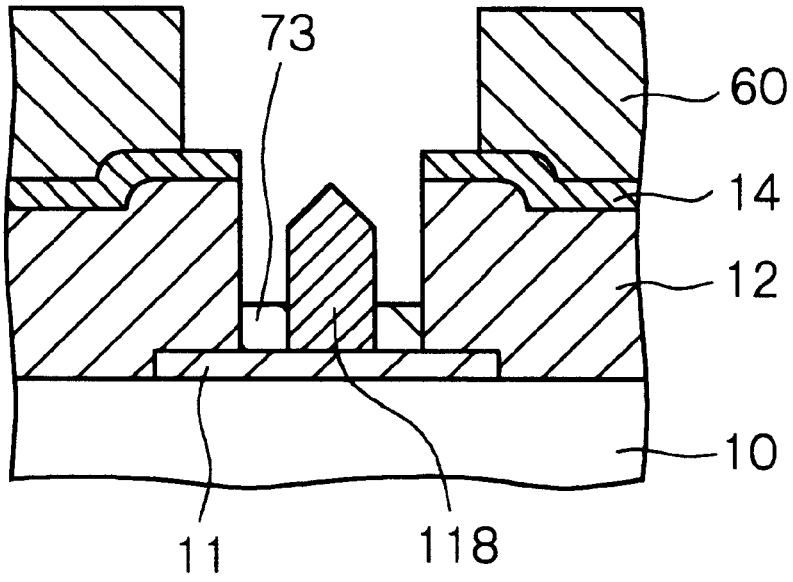
FIGS. 21A and 21B, following
Figure 21B:
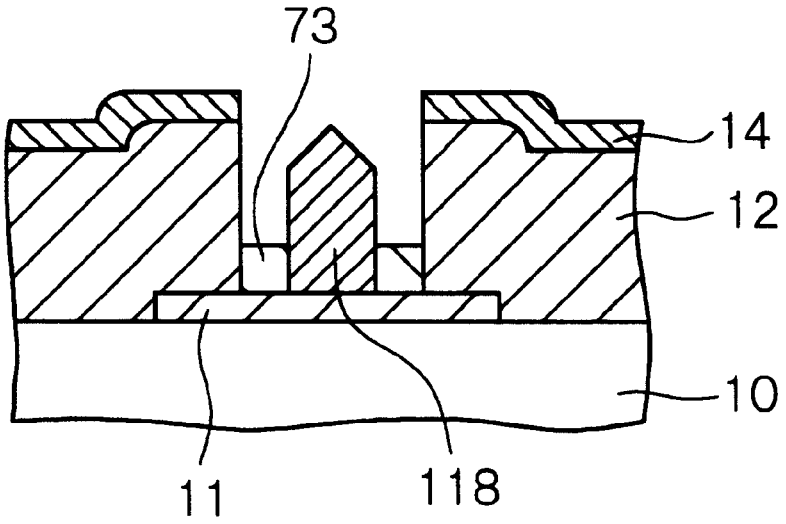

Then, the first side-wall 71 is removed, and an upper portion of the second side-wall 73 is removed, whereby a structure shown in FIG. 21A can be obtained. Then, the insulating film 60 is removed for the prevention of a static charge, and the field emission device of Example 6 shown in FIG. 21B can be produced. Further, [Step-160] in Example 1 is carried out, whereby the field emission display can be produced.

Alternatively, an emitter electrode 18 having a form shown in FIG. 3B may be formed by etching back the second conductive layer 17 as explained in [Step-140] in Example 1.

In Example 6, the second conductive layer 17 is etched in a state where the gate electrode 14 is covered with the insulating film 60. Therefore, the freedom of selection of combination of a material for forming the gate electrode 14 and a material for forming the second conductive layer 17 is increased. Particularly advantageously, the material for forming the gate electrode 14 can be selected from a broader range of materials, and the second conductive layer 17 is no longer required to be selectively etched back with regard to the gate electrode 14.

EXAMPLE 7

The process for the production of a field emission device and the process for the production of a field emission display in Example 7 are variants of the processes according to the third aspect of the present invention explained in Example 6. Further, Example 7 is concerned with the field emission device and the field emission display according to the fourth aspect of the present invention. In Example 7, a focus electrode is formed above a gate electrode through an insulating film. When cut with a perpendicular plane, the field emission display of Example 7 has a conceptual view similar to that shown in FIG. 1B. Further, for a configuration of part of the electrode layers (cathode electrode layers) 11 and the gate electrodes 14 in the field emission display, a configuration of the electrode layer (cathode electrode layer) 11 and the gate electrode 14 in one pixel and a perspective view of the field emission display, see FIGS. 2A, 2B and 3A. Further, the basic configuration of the field emission device in Example 7 is, in principle, similar to the configuration of the field emission device explained in Example 2, and the emitter electrode 118 has a top portion as shown in FIG. 8A.

The emitter electrode in the field emission device or the field emission display in Example 7 is formed by;

(1) after an gate electrode is formed on an insulating interlayer, forming an insulating film on the entire surface, (2) forming a focus electrode on the insulating film, (3) forming a first opening portion which penetrates through the focus electrode and the insulating film and has a bottom portion where the gate electrode is exposed, (4) forming a first side-wall composed of a first insulating material on the side wall of the first opening portion, to decrease the first opening portion in diameter, (5) forming a second opening portion which penetrates through the gate electrode and the insulating interlayer below the diameter-decreased first opening portion and has a bottom portion where the electrode layer is exposed, (6) forming a second side-wall composed of a second insulating material on the first side-wall and on the side wall of the second opening portion, to further decrease the first opening portion in diameter and to decrease the second opening portion in diameter, (7) forming a second conductive layer on the entire surface including the insides of the first and second opening portions by a physical or chemical vapor deposition method, (8) etching back the second conductive layer, and then (9) removing the first side-wall and removing at least an upper portion of the second side-wall.

In the field emission device of Example 7, similarly, no second side-wall is present on an imaginary segment line connecting the top surface of the emitter electrode and the edge portion of the second opening portion formed in the gate electrode, and the edge portion of the second opening portion formed in the gate electrode is projected over the upper end portion of the second opening portion formed in the insulating interlayer. Further, an acute-angled portion is formed on the top surface of the emitter electrode, and the acute-angled portion is constituted of a tip end surface projecting toward the central portion of the top surface. The emitter electrode is formed by forming a second conductive layer on the entire surface including the insides of the first and second opening portions by a physical or chemical vapor deposition method; forming a mask material layer on the entire surface; partly removing the mask material layer to leave the mask material layer on the second conductive layer above the second opening portion formed in the insulating interlayer; etching back the second conductive layer; and then, removing the first side-wall and removing at least an upper portion of the second side-wall. That is, the top surface of the emitter electrode has a conical form. The emitter electrode having the above form can be obtained by etching back the second conductive layer under conditions where the etching rate of the second conductive layer is higher than the etching rate of the mask material layer.

The processes for the production of the field emission device and the field emission display in Example 7 will be explained with reference to FIGS. 22A, 22B, 23A, 23B, 24A, 24B and 25 showing schematic partial end views of a dielectric supporting substrate and the like, hereinafter.

[Step-700]

The step of forming a patterned electrode layer (cathode electrode layer) 11 on a dielectric supporting substrate 10, the step of forming an insulating interlayer 12 on the dielectric supporting substrate 10 and the electrode layer 11, and the step of forming a gate electrode 14 on the insulating interlayer 12 can be carried out in the same manner as in [Step-100] and the formation of the gate electrode 14 in [Step-110] in Example 1, and explanations thereof are therefore omitted.

[Step-710]

Then, an insulating film 60 composed of SiN is formed on the entire surface by a known CVD method, and then a focus electrode 61 is formed on the insulating film 60. The focus electrode 61 can be obtained by forming an aluminum layer on the insulating film 60 by a sputtering method and etching the aluminum layer to form a predetermined pattern.

[Step-720]

Then, a resist layer 40 is formed on the entire surface (specifically, on the insulating film 60 and the focus electrode 61) by a lithography method. And, a first opening portion 70 which penetrates through the focus electrode 61 and the insulating film 60 and has a bottom portion where the gate electrode 14 is exposed is formed. Chlorine-base etching gas can be used for etching the focus electrode 61, and $CF_4$ gas or the like can be used for etching the insulating film 60 composed of SiN. In this manner, a structure shown in FIG. 22A can be obtained. The first opening portion 70 may have a diameter, for example, of 3 $\mu$m.

[Step-730]

Figure 22A:
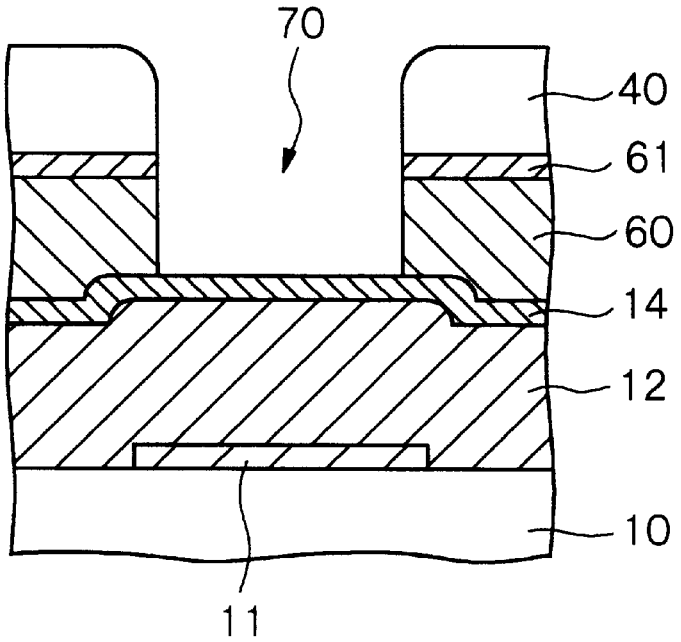
FIGS. 22A and 22B are schematic partial end views of a dielectric supporting substrate, etc., for explaining the processes for the production of a cold cathode field emission device and a cold cathode field emission display in Example 7.
Figure 22B:
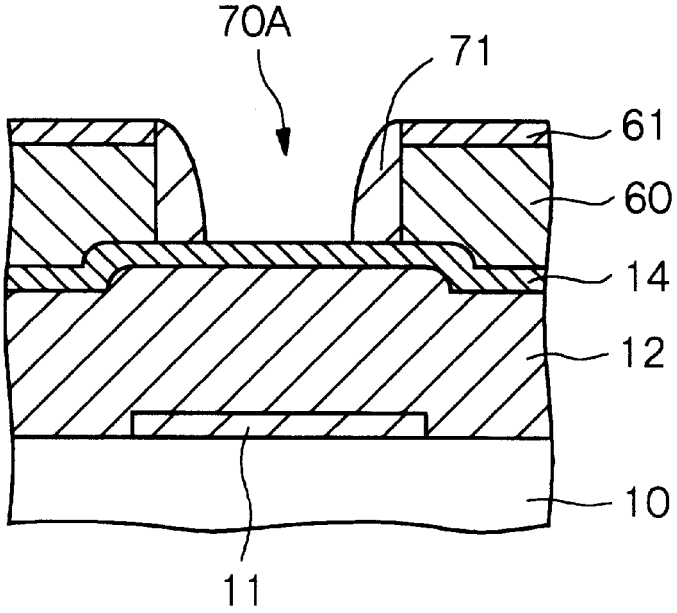
Figure 23A:
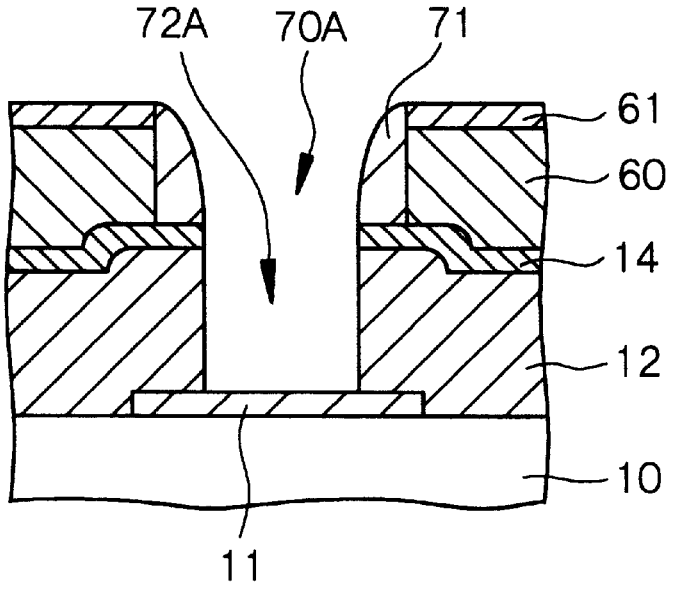
FIGS. 23A and 23B, following
Figure 23B:
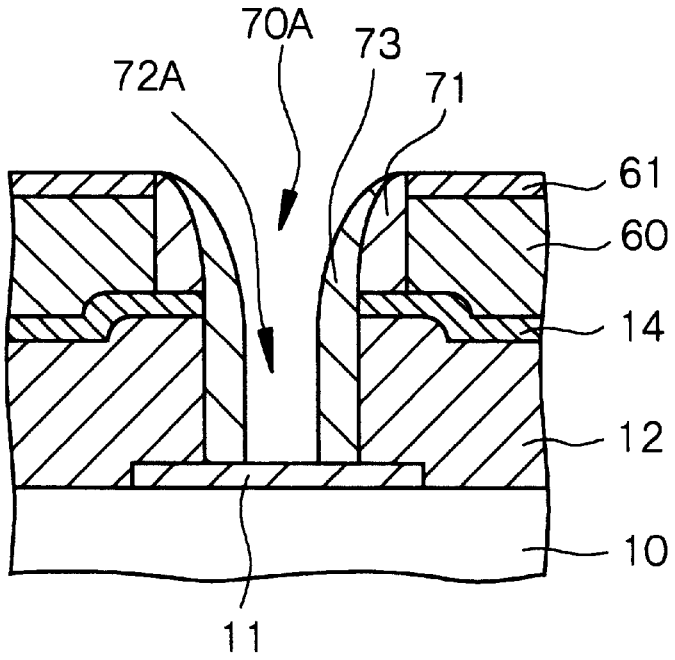

Then, a step similar to [Step-630] in Example 6 is carried out to form a first side-wall 71 to decrease the first opening portion 70 in diameter (see FIG. 22B). Then, a step similar to [Step-640] in Example 6 is carried out to form a second opening portion 72 which penetrates through the gate electrode 14 and the insulating interlayer 12 below the diameter-decreased first opening portion 70A and has a bottom portion where the electrode layer 11 is exposed (see FIG. 23A). Then, a step similar to [Step-650] is carried out to form a second side-wall 73 composed of a second insulating material on the first side-wall 71 and on the side wall of the second opening portion 72, whereby the first opening portion 70A is further decreased in diameter and the second opening portion 72A is decreased in diameter (see FIG. 23B).

[Step-740]

Figure 24A:
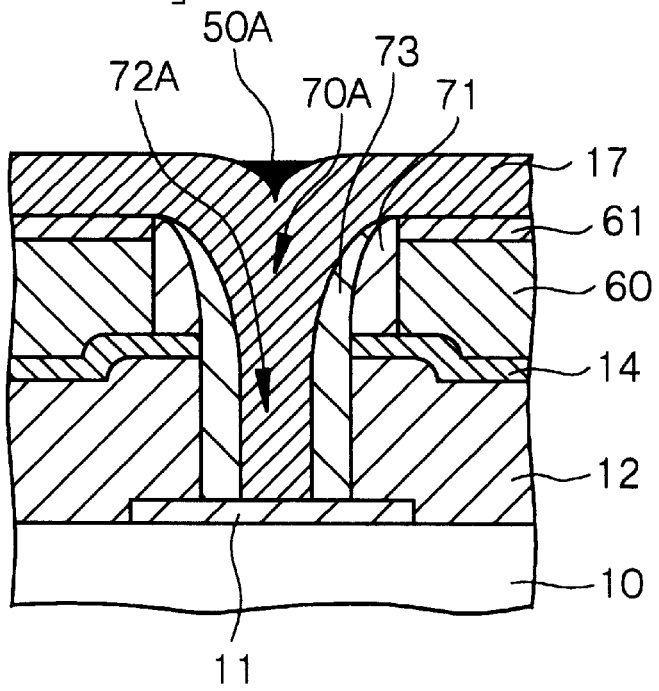
FIGS. 24A and 24B, following
Figure 24B:
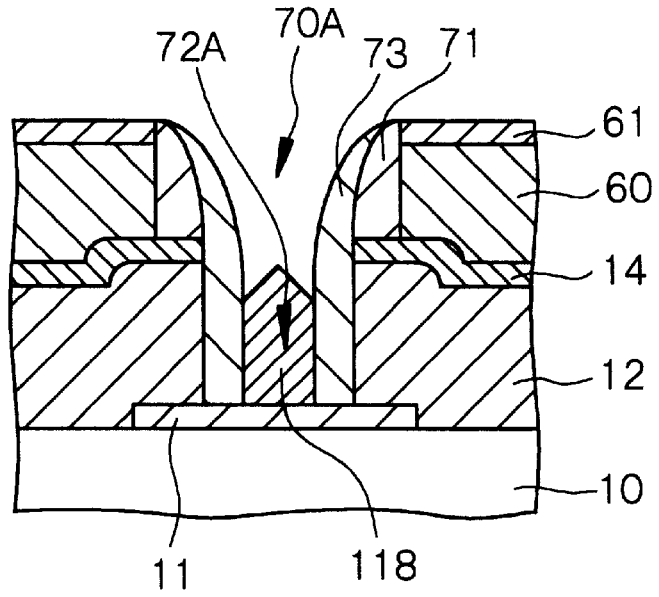

Then, a step similar to [Step-660] in Example 6 is carried out to form a second conductive layer 17 composed of tungsten on the entire surface (specifically, on the insulating film 60 and the focus electrode 61) including the insides of the first and second opening portions 70A and 72A by a CVD method, then, a mask material layer composed of a resist material is formed on the entire surface, the mask material layer is partly removed to leave the mask material layer 50A on the second conductive layer 17 above the second opening portion 72A formed in the insulating interlayer 12 (see FIG. 24A), and then, the second conductive layer 17 is etched back, thereby to form, in the second opening portion 72A, an emitter electrode 118 (whose top surface has a conical form) which has the form of a column, is constituted of the second conductive layer 17 and has an acute-angled portion on its top surface, the acute-angled portion being constituted of a tip end surface projecting toward the central portion of the top surface (see FIG. 24B).

[Step-750]

Figure 25:
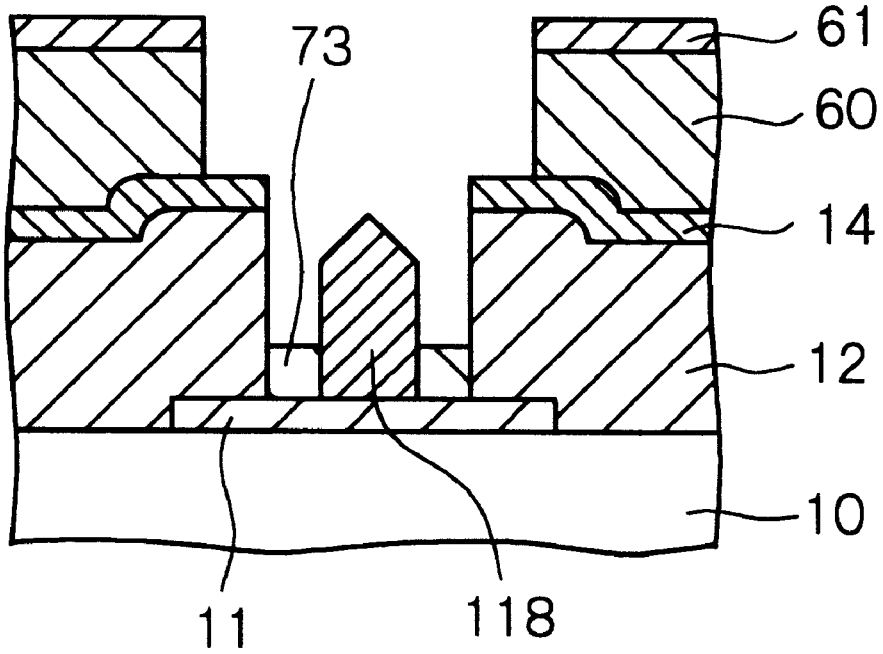
FIG. 25, following

Then, the first side-wall 71 and an upper portion of the second side-wall 73 are removed by an etching method using, for example, a $CHF_3/O_2$ gas mixture, whereby the field emission device of Example 7 shown in FIG. 25 can be obtained. The opening portions formed in the insulating interlayer 12 and the insulating film 60 may be broadened with $CH_4$ gas. Further, [Step-160] in Example 1 is carried out, whereby the field emission display can be produced.

Alternatively, the second conductive layer 17 may be etched back as explained in [Step-140] in Example 1 to form an emitter electrode 18 having a form shown in FIG. 3B.

EXAMPLE 8

The process for the production of a field emission device and the process for the production of a field emission display in Example 8 are variants of the processes according to the third aspect of the present invention explained in Example 6. Further, Example 8 is concerned with the field emission device and the field emission display according to the fifth aspect of the present invention. In Example 8, a focus electrode is formed above a gate electrode through an insulating film as well. When cut with a perpendicular plane, the field emission display of Example 8 has a conceptual view similar to that shown in FIG. 1B. Further, for a configuration of part of the electrode layers (cathode electrode layers) 11 and the gate electrodes 14 in the field emission display, a configuration of the electrode layer (cathode electrode layer) 11 and the gate electrode 14 in one pixel and a perspective view of the field emission display, see FIGS. 2A, 2B and 3A. Further, the basic configuration of the field emission device in Example 8 is, in principle, similar to the configuration of the field emission device explained in Example 2, and the emitter electrode 118 has a top portion as shown in FIG. 8A.

The emitter electrode in the field emission device or the field emission display in Example 8 is formed by;

(1) after a gate electrode is formed on an insulating interlayer, forming an insulating film on the entire surface, then, forming a focus electrode on the insulating film, (2) further, forming a second insulating film on the entire surface, (3) then, forming a first opening portion which penetrates through the second insulating film, the focus electrode and the insulating film and has a bottom portion where the gate electrode is exposed, (4) forming a first side-wall composed of a first insulating material on the side wall of the first opening portion, to decrease the first opening portion in diameter, (5) forming a second opening portion which penetrates through the gate electrode and the insulating interlayer below the diameter-decreased first opening portion and has a bottom portion where the electrode layer is exposed, (6) forming a second side-wall composed of a second insulating material on the first side-wall and on the side wall of the second opening portion, to further decrease the first opening portion in diameter and to decrease the second opening portion in diameter, (7) forming a second conductive layer on the entire surface including the insides of the first and second opening portions by a physical or chemical vapor deposition method, (8) etching back the second conductive layer, and then (9) removing the first side-wall and removing at least an upper portion of the second side-wall.

In the field emission device of Example 8, similarly, no second side-wall is present on an imaginary segment line connecting the top surface of the emitter electrode and the edge portion of the second opening portion formed in the gate electrode, and the edge portion of the second opening portion formed in the gate electrode is projected over the upper end portion of the second opening portion formed in the insulating interlayer. Further, an acute-angled portion is formed on the top surface of the emitter electrode, and the acute-angled portion is constituted of a tip end surface projecting toward the central portion of the top surface. The emitter electrode is formed by forming a second conductive layer on the entire surface including the insides of the first and second opening portions by a physical or chemical vapor deposition method; forming a mask material layer on the entire surface; partly removing the mask material layer to leave the mask material layer on the second conductive layer above the second opening portion formed in the insulating interlayer; etching back the second conductive layer; and then, removing the first side-wall and removing at least an upper portion of the second side-wall. That is, the top surface of the emitter electrode has a conical form. The emitter electrode having the above form can be obtained by etching back the second conductive layer under conditions where the etching rate of the second conductive layer is higher than the etching rate of the mask material layer.

The processes for the production of the field emission device and the field emission display in Example 8 will be explained with reference to FIGS. 26A, 26B, 27A, 27B, 28A, 28B, 29A and 29B showing schematic partial end views of a dielectric supporting substrate and the like, hereinafter.

[Step-800]

The step of forming a patterned electrode layer (cathode electrode layer) 11 on a dielectric supporting substrate 10, the step of forming an insulating interlayer 12 on the dielectric supporting substrate 10 and the electrode layer 11, and the step of forming a gate electrode 14 on the insulating interlayer 12 can be carried out in the same manner as in [Step-100] and the formation of the gate electrode 14 in [Step-110] in Example 1, and explanations thereof are therefore omitted.

[Step-810]

Then, an insulating film 60 composed of SiN is formed on the entire surface by a known CVD method, and then a focus electrode 61 is formed on the insulating film 60. The focus electrode 61 can be obtained by forming an aluminum layer on the insulating interlayer 60 and etching the aluminum layer to form a predetermined pattern. Then, a second insulating film 63 constituted of a laminate of $SiO_2$ and SiN is formed on the entire surface by a known CVD method. In the Figures, the second insulating film 63 is shown as a single layer.

[Step-820]

Then, a resist layer 40 is formed on the second insulating film 63 by a lithography method. Then, a first opening portion 70 which penetrates through the second insulating film 63, the focus electrode 61 and the insulating film 60 and has a bottom portion where the gate electrode 14 is exposed is formed. Chlorine-base etching gas can be used for etching the focus electrode 61, and $CF_4$ gas or the like can be used for etching the second insulating film 63 and the insulating film 60. In this manner, a structure shown in FIG. 26A can be obtained.

[Step-830]

Figure 26A:
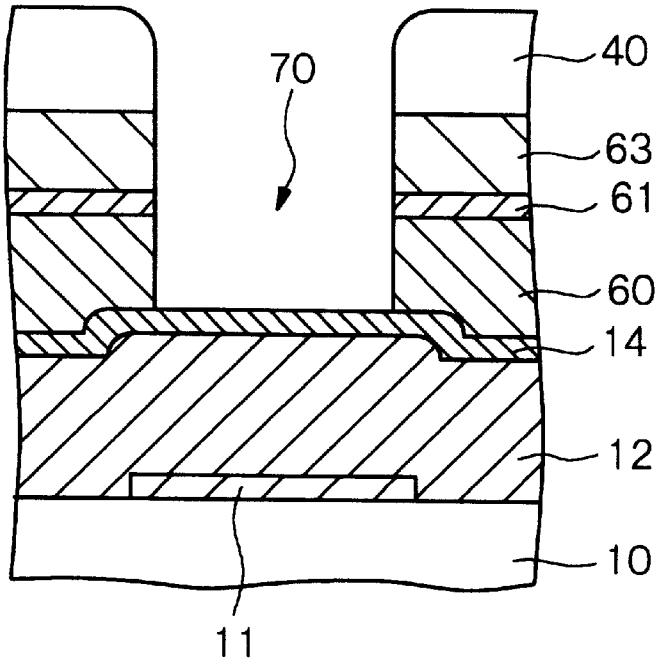
FIGS. 26A and 26B are schematic partial end views of a dielectric supporting substrate, etc., for explaining the processes for the production of a cold cathode field emission device and a cold cathode field emission display in Example 8.
Figure 26B:
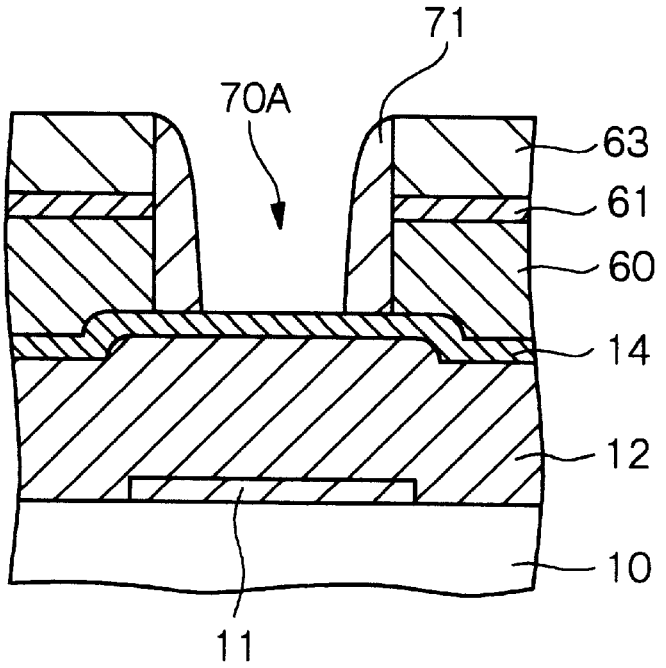
Figure 27A:
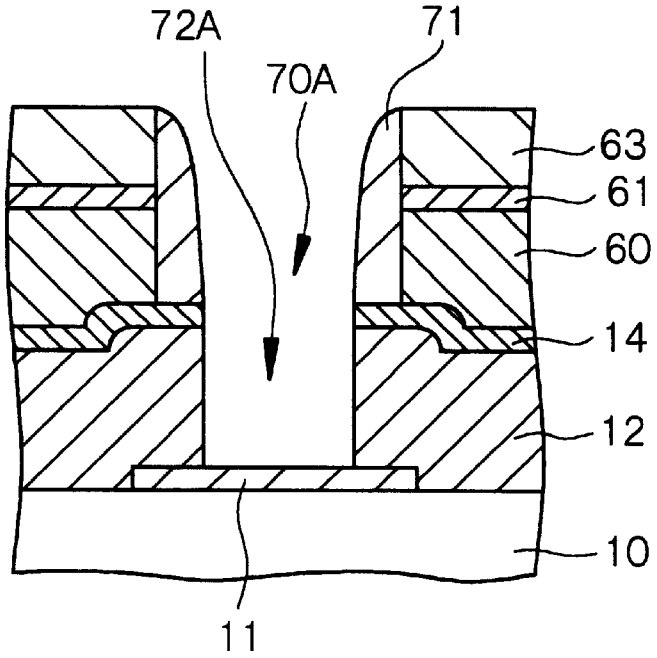
FIGS. 27A and 27B, following
Figure 27B:
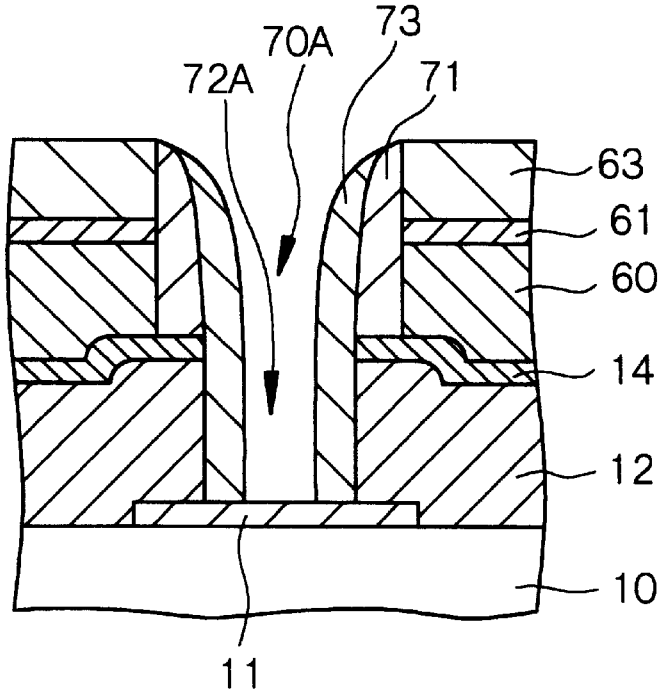

Then, a step similar to [Step-630] in Example 6 is carried out to form a first side-wall 71 to decrease the first opening portion 70 in diameter (see FIG. 26B). Then, a step similar to [Step-640] in Example 6 is carried out to form a second opening portion 72 which penetrates through the gate electrode 14 and the insulating interlayer 12 below the diameter-decreased first opening portion 70A and has a bottom portion where the electrode layer 11 is exposed (see FIG. 27A). Then, a step similar to [Step-650] is carried out to form a second side-wall 73 composed of a second insulating material on the first side-wall 71 and on the side wall of the second opening portion 72, whereby the first opening portion 70A is further decreased in diameter and the second opening portion 72A is decreased in diameter (see FIG. 27B).

[Step-840]

Figure 28A:
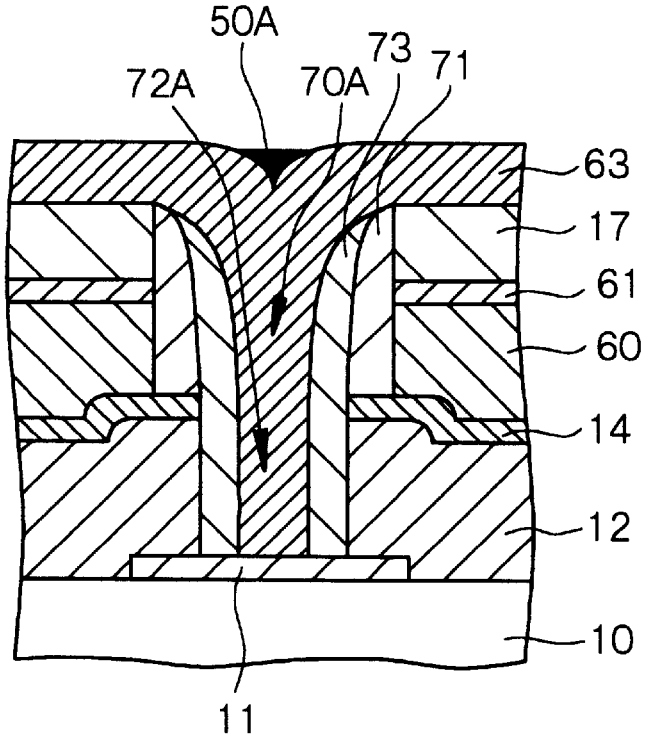
FIGS. 28A and 28B, following
Figure 28B:
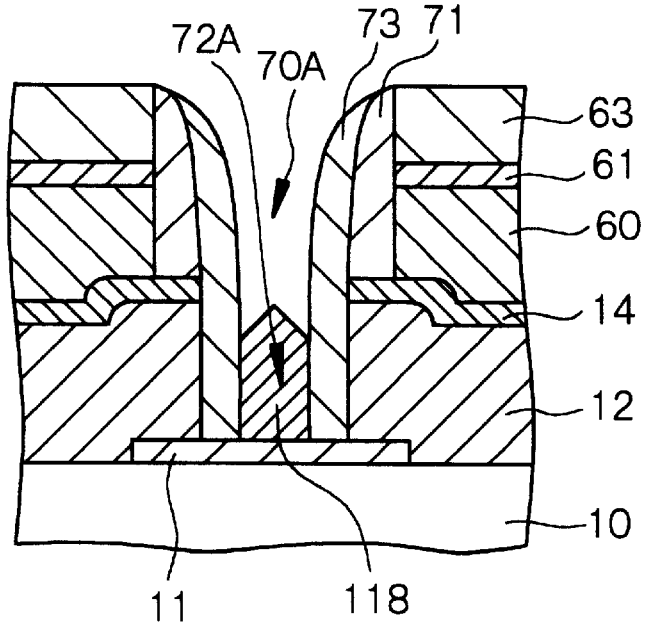

Then, a step similar to [Step-660] in Example 6 is carried out to form a second conductive layer 17 composed of tungsten on the entire surface (specifically, on the second insulating film 63) including the insides of the first and second opening portions 70A and 72A by a CVD method, then, a mask material layer composed of a resist material is formed on the entire surface, the mask material layer is partly removed to leave the mask material layer 50A on the second conductive layer 17 above the second opening portion 72A formed in the insulating interlayer 12 (see FIG. 28A), and then, the second conductive layer 17 is etched back, thereby to form, in the second opening portion 72A, an emitter electrode 118 (whose top surface has a conical form) which has the form of a column, is constituted of the second conductive layer 17 and has an acute-angled portion on its top surface, the acute-angled portion being constituted of a tip end surface projecting toward the central portion of the top surface (see FIG. 28B).

[Step-850]

Figure 29A:
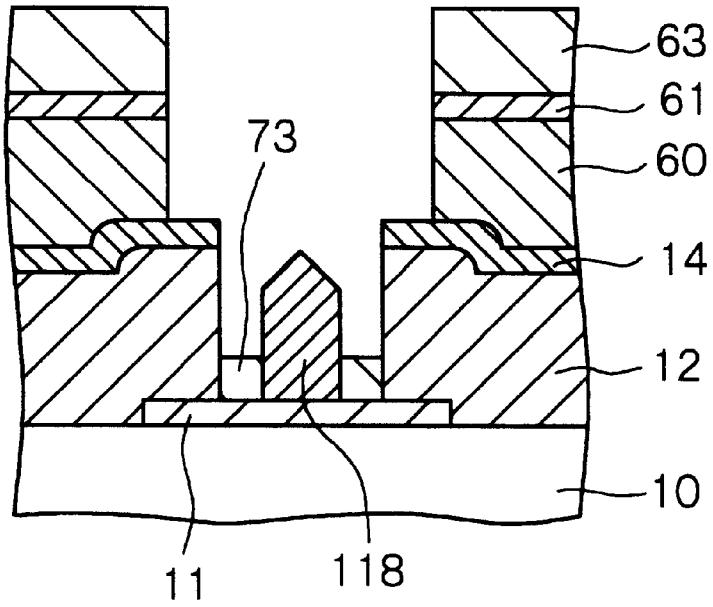
FIGS. 29A and 29B, following
Figure 29B:
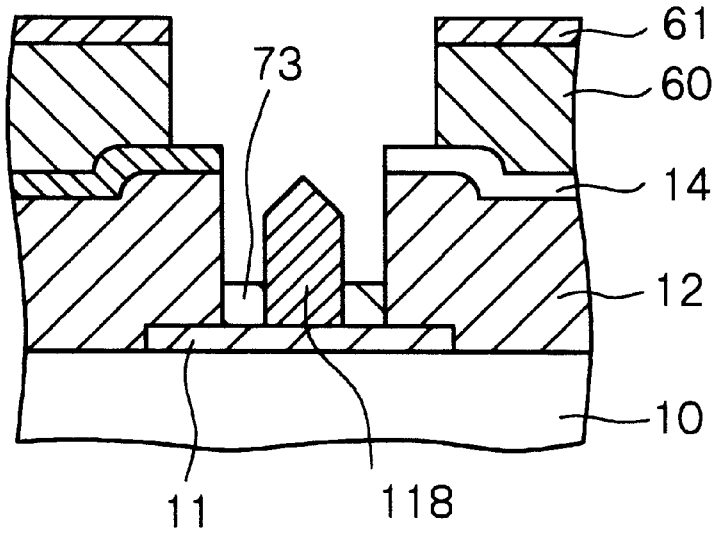

Then, the first side-wall 71 and an upper portion of the second side-wall 73 are removed, whereby a structure shown in FIG. 29A can be obtained. Then, the second insulating film 63 is removed, whereby the field emission device of Example 8 can be produced. Further, [Step-160] in Example 1 is carried out, whereby the field emission display can be produced.

Alternatively, the second conductive layer 17 may be etched back as explained in [Step-140] in Example 1 to form an emitter electrode 18 having a form shown in FIG. 3B.

In Example 8, the second conductive layer 17 is etched in a state where the focus electrode 61 is covered with the second insulating film 63. Therefore, the freedom of selection of combination of a material for forming the focus electrode 61 and a material for forming the second conductive layer 17 is increased. Particularly advantageously, the material for forming the focus electrode 61 can be selected from a broader range of materials, and the second conductive layer 17 is no longer required to be selectively etched back with regard to the focus electrode 61.

Figure 30A:
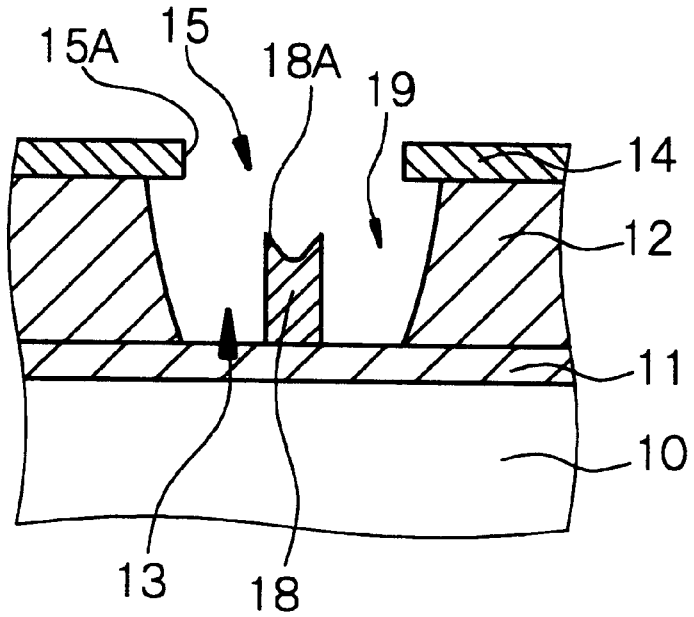
FIGS. 30A and 30B are schematic partial end views of variants of the cold cathode field emission devices explained in Examples 1 and 2.
Figure 30B:
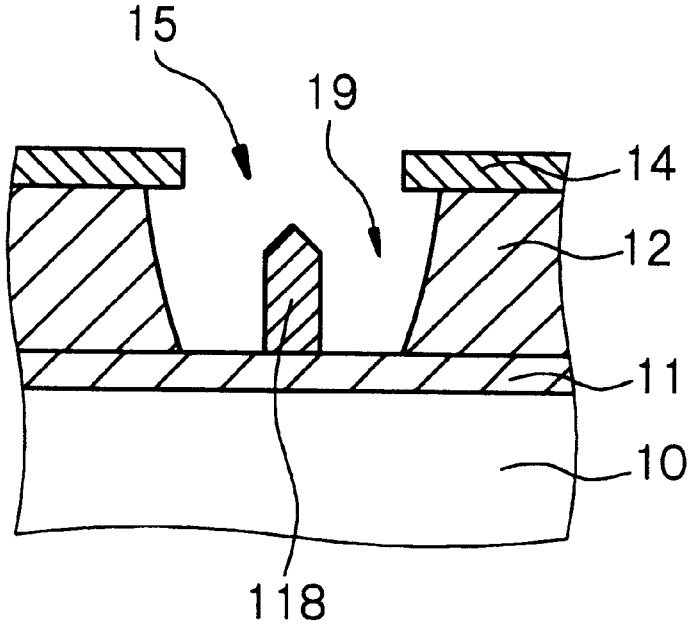

The present invention has been explained with reference Examples hereinabove, while the present invention shall not be limited thereto. Those various values, processing conditions and materials explained in Examples are given for illustrative purposes and may be altered as required. As shown in FIGS. 30A and 30B, in the etching of the side-wall 16, etc., in [Step-150] in Example 1, the whole of the side-wall 16 may be removed by etching. Further, in [Step-330] in Example 3, the insulating material layer 16B may be left in the bottom portion of the opening portion 13A. Further, in [Step-330] in Example 3, the portion of the insulating interlayer 12 corresponding to the side wall of the opening portion 13 may be etched. These are also applicable in the other Examples. In Examples, the second conductive layer 17 is formed by a CVD method, while it may be formed by a PVD method such as a sputtering method.

The cross-sectional form which the opening portion has, when cut with a plane perpendicular to the axial line L passing through the center of the opening portion 15, shall not be limited to a circle, and it may be any form such as an oval, a polygon or a polygon having rounded edges or sides. The cross-sectional form which the diameter-decreased opening portion has, when cut with a plane perpendicular to the axial line passing through the center thereof, shall not be limited to a circle, either, and it is analogous or similar to the cross-sectional form of the opening portion. Therefore, the cross-sectional form which the emitter electrode 18, 118 has, when cut with a plane perpendicular to the axial line passing through the center of the emitter electrode 18, 118, shall not be limited to a circle, either, and it is analogous or similar to the cross-sectional form of the opening portion.

Figure 31A:
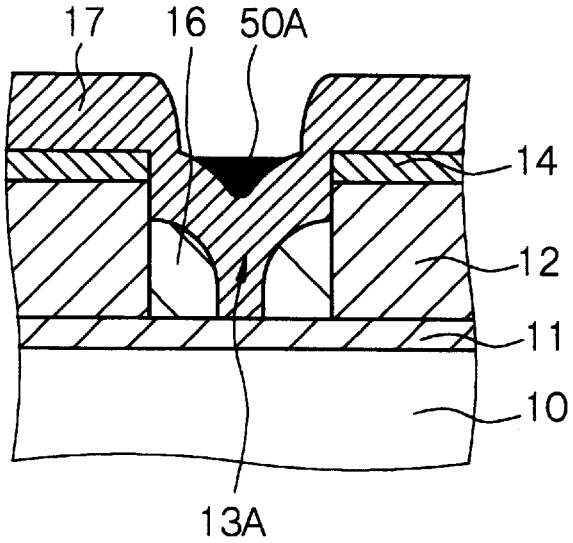
FIGS. 31A and 31B are schematic partial end views of the cold cathode field emission device explained in Example 2 for showing another variant of the process for the production thereof.
Figure 31B:
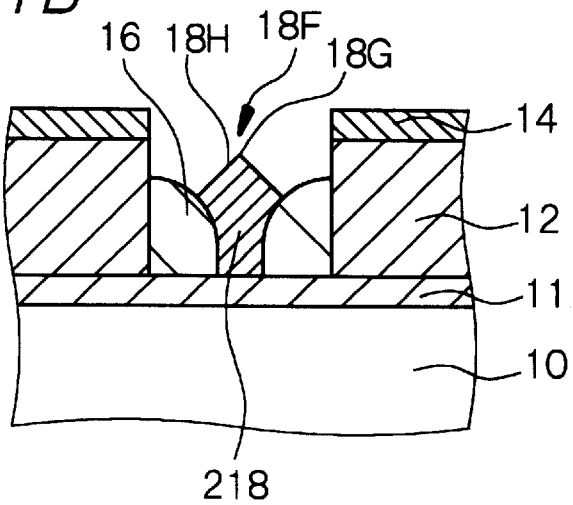
Figure 32:
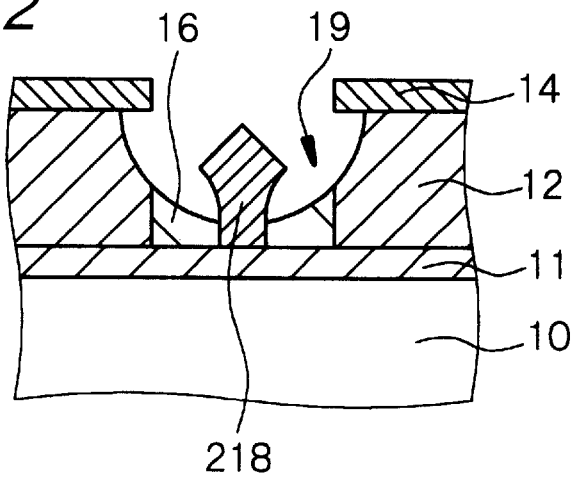
FIG. 32, following
Figure 33:
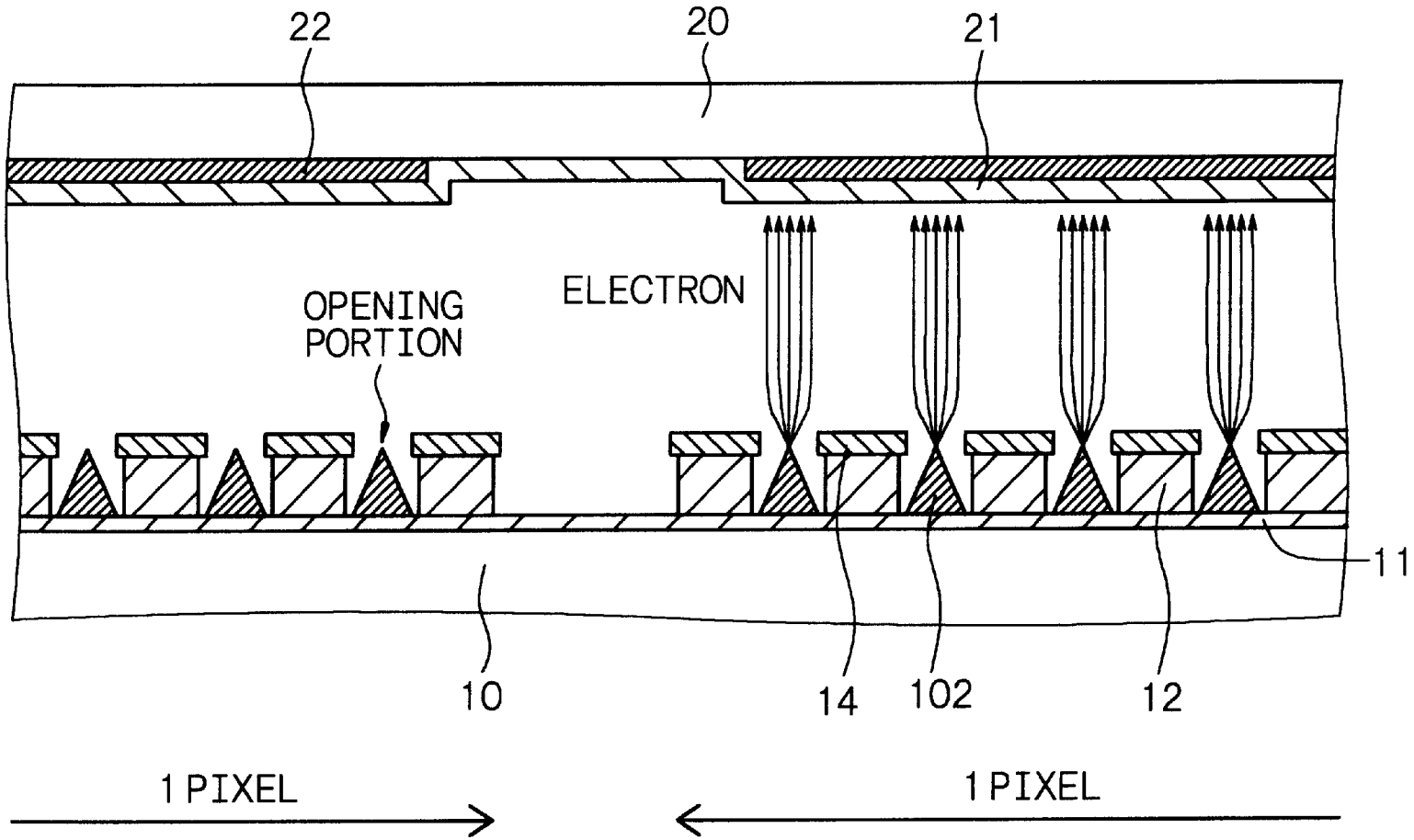
Fig. 33 (PRIOR ART)
FIG. 33 is a conceptual view of a conventional cold cathode field emission display.
Figure 34A:
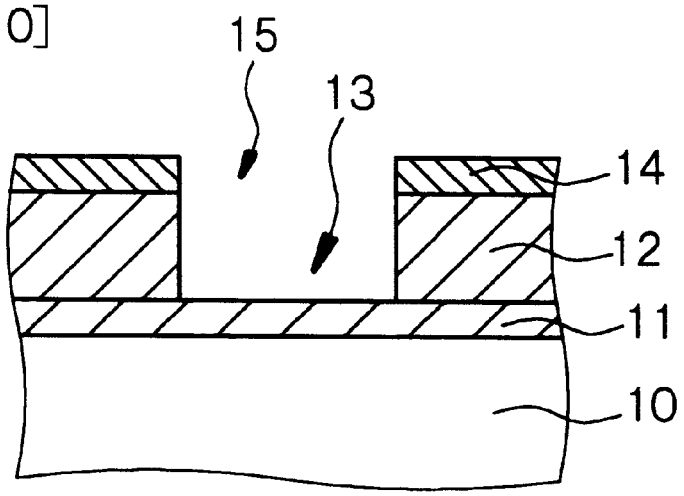
(PRIOR ART) Fig. 34A
FIGS. 34A and 34B are schematic partial end views of a dielectric supporting substrate, etc., for explaining the process for the production of a conventional Spindt type cold cathode field emission device.
Figure 34B:
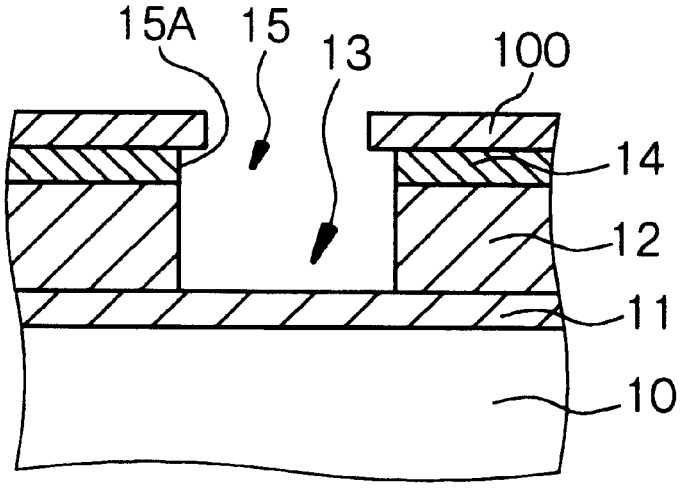
Figure 35A:
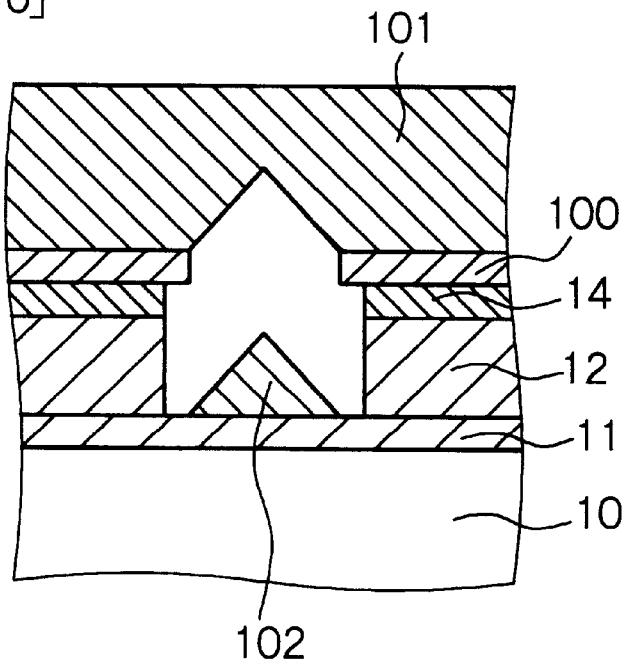
(PRIOR ART) Fig. 35A
FIGS. 35A and 35B, following
Figure 35B:
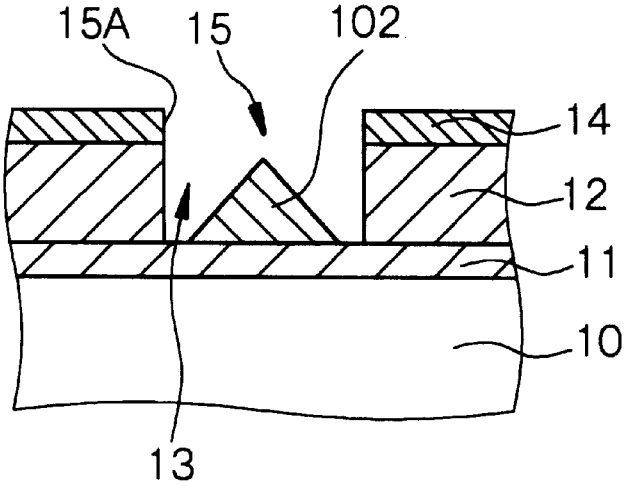

Further, in the emitter electrode of the field emission device explained in Example 2 or 4, the emitter electrode may have a structure in which the top portion thereof has a larger diameter than any other portion thereof. The emitter electrode having the above structure can be obtained by controlling the height of the side-wall 16 along the side walls of the opening portions 13 and 15 or the height of the insulating material layer 16B, controlling the thickness of the second conductive layer 17 or controlling the conditions of etching back the second conductive layer 17. That is, as shown in FIG. 31A for example, the height of the side-wall 16 along the side wall of the opening portion 13 is decreased to make it lower than that shown in FIG. 7A, and the thickness of the second conductive layer 17 is increased to make it greater than that shown in FIG. 7A. And, as shown in FIG. 31A, a mask material layer 50 is left, to some extent, on the second conductive layer 17 having a broadened area above the opening portion 13A formed in the insulating interlayer 12. And, as shown in FIG. 31B, the second conductive layer 17 is etched back, whereby an emitter electrode 218 whose top portion has a larger diameter than any other portion can be obtained. A structure obtained after the etching of the side-wall 16, etc., is shown in FIG. 32.

The distance from the edge portion 15A of the opening portion 15 formed in the gate electrode 14 to the acute-angled portion of the emitter electrode 18 or 118 is dependent upon the thickness of the insulating interlayer 12, the diameter of the opening portion 15 and the distance from the electrode layer (cathode electrode layer) 11 to the acute-angled portion 18B or 18G of the emitter electrode 18 or 118. In the process for the production of the conventional Spindt type field emission device, it is difficult to determine the height of the emitter electrode 102 as required. In the present invention, however, the distance from the electrode layer 11 to the acute-angled portion 18B or 18G of the emitter electrode 18 or 118 can be determined depending upon the conditions of etching back the second conductive layer 17 and upon the cross-sectional form of the side-wall 16 or the insulating material layer 16B on the side walls of the opening portions 13 and 15 when cut with a perpendicular plane including the axial line passing through the center of the opening portion 13. Therefore, when conditions of forming the side-wall 16 or the insulating material layer 16B is determined so as to obtain the side-wall 16 having a proper cross-sectional form or the insulating material layer 16B on the side walls of the opening portions 13 and 15 having a proper cross-sectional form, and further, when the conditions of etching back the second conductive layer 17 are properly determined, the distance from the edge portion 15A of the opening portion 15 formed in the gate electrode 14 to the acute-angled portion 18B or 18G of the emitter electrode 18 or 118 can be designed with a high degree of freedom. Therefore, the distance between the gate electrode 14 and the electrode layer 11, in other words, the thickness of the insulating interlayer 12, can be designed so as to be a proper value.

In some cases, after the opening portion (or second opening portion) which reaches the electrode layer 11 is formed in the insulating interlayer 12, and before the opening portion (or second opening portion) is decreased in diameter, an electrically conductive material may be filled in the bottom portion of the opening portion (or second opening portion). Otherwise, after the opening portion (or second opening portion) is decreased in diameter, an electrically conductive material may be filled in the bottom portion of the opening portion (or second opening portion). The above electrically conductive material may be the same as, or different from, the material for forming the second conductive layer, and in the latter case, for example, polycrystalline silicon containing an impurity can be used as the electrically conductive material. Further, the field emission device or the field emission display explained in Example 3 or 4 may be provided with a focus electrode.

The opening portion may be formed in the gate electrode when the gate electrode is formed, and the opening portion which communicates with the opening portion formed in the gate electrode and has a bottom portion where the electrode layer is exposed may be formed in the insulating interlayer. The formation of the opening portion in the gate electrode can be carried out by forming the first conductive layer on the insulating interlayer 12 by, for example, a sputtering method, and then patterning the first conductive layer by a known method to form the gate electrodes with the opening portion. Alternatively, when a patterned gate electrode is formed on the insulating interlayer 12 by, for example, a printing method, an opening portion can be formed in the gate electrode, simultaneously.

The formation of the opening portion in the focus electrode can be carried out by forming a conductive layer on the insulating film by, for example, a sputtering method, and then patterning the conductive layer by a known method to form the focus electrodes with the opening portion. Alternatively, when a patterned focus electrode is formed on the insulating film by, for example, a printing method, an opening portion can be formed in the focus electrode, simultaneously.

The mask material layer may be composed of, for example, copper (Cu). When the mask material layer is composed of metal, the high ratio of (the etching rate of the second conductive layer)/(the etching rate of the mask material layer) can be obtained. When copper is used as a material for the mask material layer, catalyst treatment and accelerator treatment are carried out, and then, the mask material layer can be formed, by an electroless plating method under conditions shown in the following Table 3. The plating solution contains small amounts of a stabilizer and a wetting agent. When the mask material layer remains on the top portion of the emitter electrode after completion of etching back of the second conductive layer, the remaining mask material layer can be removed by a proper wet etching process.

TABLE 3

| | | |
|---|---|---|
| Plating solution | Copper sulfate ($CuSO_4 5H_2O$) | 7 g/liter |
| | Formalin (37% HCHO) | 20 ml/liter |
| | Sodium hydroxide (NaOH) | 10 g/liter |
| | Sodium potassium tartarate | 20 g/liter |
| Plating bath temperature | 50° C. | |

In the present invention, the emitter electrode is formed in the opening portion which is decreased in diameter by means of the side-wall or the insulating material layer, and therefore, the emitter electrode can be formed in a self-alignment manner by applying the method of producing a semiconductor device, and an emitter electrode having a finer diameter and a finer field emission device can be formed with a high degree of design freedom. Further, the acute-angled portion having a small curvature can be formed on the top surface of the emitter electrode by etching back the second conductive layer with excellent reproducibility, and therefore, it is no longer necessary to use a special production method for forming the acute-angled portion on the top surface of the emitter electrode. Furthermore, the axial line passing through the center of the emitter electrode and the axial line passing through the center of the opening portion are in agreement with each other, and therefore, the direction in which electrons are emitted from the field emission device due to an electric field is constant, so that the direction of emission of electrons can be easily controlled. Moreover, the distance from the edge portion of the opening portion formed in the gate electrode to the acute-angled portion of the emitter electrode can be designed with a high degree of freedom, and therefore, the distance between the electrode layer and the gate electrode can be increased. As a result, the load on the electric circuit of the field emission display can be reduced, and the field emission display can be improved in in-plane uniformity and image quality. Moreover, the capacitance between the gate electrode and the electrode layer can be decreased, so that there can be avoided problems that the load on the electric circuit of the field emission display increases and that the field emission display is deteriorated in in-plane uniformity and image quality.

Since the emitter electrode can be formed in a self-alignment manner, the production process can be decreased in steps, and particularly, an investment in photolithography equipment can be reduced. It is not required to form the peeling-off layer by an oblique vapor deposition method, nor is it required to form the metal layer having a large thickness in a perpendicular direction, for forming the emitter electrode. The process time can be therefore decreased, and the cost required for the production of the field emission device and the field emission display can be decreased. Further, the focus electrode can be formed without increasing the number of process steps much.

What is claimed is:

1. A process for the production of a cold cathode field emission device comprising the steps of;

(A) forming a patterned electrode layer on a dielectric supporting substrate, (B) forming an insulating interlayer on the dielectric supporting substrate and the electrode layer, (C) forming a gate electrode comprising a first conductive layer on the insulating interlayer, (D) forming an opening portion which penetrates through at least the insulating interlayer and has a bottom portion where the electrode layer is exposed, (E) forming a side-wall of an insulating material on side walls of the opening portion, to decrease the opening portion in diameter, (F) forming a second conductive layer on at least the insulating interlayer, the gate electrode and inside of the opening portion by a physical or chemical vapor deposition method, (G) etching back the second conductive layer to form an emitter electrode having a column shape and comprising the second conductive layer in the opening portion, and (H) removing at least an upper portion of the side-wall.

2. The process for the production of a cold cathode field emission device according to claim 1, in which, in the step (H), at least an upper portion of the side-wall is removed such that no side-wall is present on an imaginary line segment connecting a top surface of the emitter electrode and an edge portion of the opening portion formed in the gate electrode.

3. The process for the production of a cold cathode field emission device according to claim 2, in which an end portion of the opening portion formed in the gate electrode is projected over an upper end portion of the opening portion formed in the insulating interlayer.

4. The process for the production of a cold cathode field emission device according to claim 1, in which an acute-angled portion is formed on the top surface of the emitter electrode by etching back the second conductive layer, and the acute-angled portion is constituted of a surface spreading from a pit formed in a central portion of the top surface to a peripheral portion of the top surface and a side surface of the emitter electrode.

5. The process for the production of a cold cathode field emission device according to claim 1, in which the step (G) comprises the steps of forming a mask material layer on the, at least the second conductive layer; partly removing the mask material layer to leave the mask material layer on the second conductive layer above the opening portion formed in the insulating interlayer; and then, etching back the second conductive layer to form, in the opening portion, the emitter electrode which has the column shape, comprises the second conductive layer and has an acute-angled portion formed on its top surface, and the acute-angled portion comprising a tip end surface projecting toward a central portion of the top surface.

6. The process for the production of a cold cathode field emission device according to claim 5, in which the second conductive layer is etched back under conditions where the etching rate of the second conductive layer is higher than the etching rate of the mask material layer.

7. The process for the production of a cold cathode field emission device according to claim 1, in which the step (D) comprises the steps of forming a resist layer on the insulating interlayer and the gate electrode by a lithography method; forming an opening portion in the gate electrode using the resist layer as an etching mask; and then, further forming an opening portion in the insulating interlayer below the opening portion formed in the gate electrode using the resist layer as an etching mask such that the opening portion reaches the electrode layer.

8. The process for the production of a cold cathode field emission device according to claim 1, in which, after the step (C), the process includes the steps of forming an insulating film on at least the gate electrode, and then, forming a focus electrode on the insulating film, and the step (D) comprises the step of forming the opening portion which penetrates through the focus electrode, the insulating film, the gate electrode and the insulating interlayer and has a bottom portion where the electrode layer is exposed.

9. A process for the production of a cold cathode field emission device comprising the steps of;

(A) forming a patterned electrode layer on a dielectric supporting substrate, (B) forming an insulating interlayer on the dielectric supporting substrate and the electrode layer, (C) forming a gate electrode comprising a first conductive layer on the insulating interlayer, (D) forming an opening portion which penetrates through at least the insulating interlayer and has a bottom portion where the electrode layer is exposed, (E) forming an insulating material layer on at least the insulating interlayer, the gate electrode and side wall surfaces of the opening portion, to decrease the opening portion in diameter, (F) forming a second conductive layer on the insulating material layer and in the opening portion by a physical or chemical vapor deposition method, (G) etching back the second conductive layer to form an emitter electrode having a column shape and comprising the second conductive layer in the opening portion, and (H) removing the insulating material layer.

10. The process for the production of a cold cathode field emission device according to claim 9, in which an acute-angled portion is formed on a top surface of the emitter electrode by etching back the second conductive layer, and the acute-angled portion comprises a surface spreading from a pit formed in a central portion of the top surface to a peripheral portion of the top surface and a side surface of the emitter electrode.

11. The process for the production of a cold cathode field emission device according to claim 9, in which the step (G) comprises the steps of forming a mask material layer on at least the second conductive layer; partly removing the mask material layer to leave the mask material layer on the second conductive layer above the opening portion formed in the insulating interlayer; and then, etching back the second conductive layer to form, in the opening portion, the emitter electrode which has the column shape, comprises the second conductive layer and has an acute-angled portion formed on its top surface, and the acute-angled portion comprising a tip end surface projecting toward a central portion of the top surface.

12. The process for the production of a cold cathode field emission device according to claim 11, in which the second conductive layer is etched back under conditions where the etching rate of the second conductive layer is higher than the etching rate of the mask material layer.

13. The process for the production of a cold cathode field emission device according to claim 9, in which the step (D) comprises the steps of forming a resist layer on the insulating interlayer and the gate electrode by a lithography method; forming an opening portion in the gate electrode using the resist layer as an etching mask; and then, further forming an opening portion in the insulating interlayer below the opening portion formed in the gate electrode using the resist layer as an etching mask such that the opening portion reaches the electrode layer.

14. A process for the production of a cold cathode field emission device comprising the steps of;

(A) forming a patterned electrode layer on a dielectric supporting substrate, (B) forming an insulating interlayer on the dielectric supporting substrate and the electrode layer, (C) forming a gate electrode constituted of a first conductive layer on the insulating interlayer, (D) forming an insulating film on at least the gate electrode, (E) forming a first opening portion which penetrates through the insulating film and has a bottom portion where the gate electrode is exposed, (F) forming a first side-wall of a first insulating material on side walls of the first opening portion, to decrease the first opening portion in diameter, (G) forming a second opening portion which penetrates the gate electrode and the insulating interlayer below the first opening portion decreased in diameter and has a bottom portion where the electrode layer is exposed, (H) forming a second side-wall of a second insulating material on the first side-wall and side walls of the second opening portion, to further decrease the first opening portion in diameter and to decrease the second opening portion in diameter, (I) forming a second conductive layer on at least the insulating film and insides of the first and second opening portions by a physical or chemical vapor deposition method, (J) etching back the second conductive layer to form an emitter electrode having a column shape and comprising the second conductive layer in the second opening portion, and (K) removing the first side-wall and removing at least an upper portion of the second side-wall.

15. The process for the production of a cold cathode field emission device according to claim 14, in which, after the step (D), the process includes the step of forming a focus electrode on the insulating film, and the step (E) comprises the step of forming the first opening portion which penetrates through the focus electrode and the insulating film and has a bottom portion where the gate electrode is exposed.

16. The process for the production of a cold cathode field emission device according to claim 14, in which, after the step (D), the process includes the steps of forming a focus electrode on the insulating film, and further forming a second insulating film on the entire surface, and the step (E) comprises the step of forming the first opening portion which penetrates through the second insulating film, the focus electrode and the insulating film and has a bottom portion where the gate electrode is exposed.

17. The process for the production of a cold cathode field emission device according to claim 14, in which, in the step (K), at least an upper portion of the second side-wall is removed such that no second side-wall is present on an imaginary line segment connecting a top surface of the emitter electrode and an edge portion of the second opening portion formed in the gate electrode.

18. The process for the production of a cold cathode field emission device according to claim 17, in which an end portion of the second opening portion formed in the gate electrode is projected over an upper end portion of the second opening portion formed in the insulating interlayer.

19. The process for the production of a cold cathode field emission device according to claim 14, in which an acute-angled portion is formed on a top surface of the emitter electrode by etching back the second conductive layer, and the acute-angled portion comprises a surface spreading from a pit formed in a central portion of the top surface to a peripheral portion of the top surface and a side surface of the emitter electrode.

20. The process for the production of a cold cathode field emission device according to any one of claims 14 to 16, in which the step (J) comprises the steps of forming a mask material layer on at least the second conductive layer; partly removing the mask material layer to leave the mask material layer on the second conductive layer above the second opening portion formed in the insulating interlayer; and then, etching back the second conductive layer to form, in the second opening portion, the emitter electrode which has the column shape, comprises the second conductive layer and has an acute-angled portion formed on its top surface, and the acute-angled portion comprising a tip end surface projecting toward a central portion of the top surface.

21. The process for the production of a cold cathode field emission device according to claim 20, in which the second conductive layer is etched back under conditions where the etching rate of the second conductive layer is higher than the etching rate of the mask material layer.

22. The process for the production of a cold cathode field emission device according to claim 14, in which the step (G) comprises the step of forming the second opening portion which penetrates through the gate electrode and the insulating interlayer below the first opening portion decreased in diameter and has a bottom portion where the electrode layer is exposed, using the first side-wall as an etching mask.

23. A process for the production of a cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer, and (d) an emitter electrode disposed on the electrode layer positioned in a bottom portion of an opening portion penetrating through the gate electrode and the insulating interlayer and shaped in the form of a column, each pixel further comprising;

(e) a second electrode layer and a fluorescent layer formed on a transparent substrate opposite to the emitter electrodes, the process comprising the steps of;

(A) forming the patterned electrode layer on the dielectric supporting substrate, (B) forming the insulating interlayer on the dielectric supporting substrate and the electrode layer, (C) forming the gate electrode constituted of a first conductive layer on the insulating interlayer, (D) forming the opening portion which penetrates through at least the insulating interlayer and has a bottom portion where the electrode layer is exposed, (E) forming a side-wall of an insulating material on side walls of the opening portion, to decrease the opening portion in diameter, (F) forming a second conductive layer on at least insulating interlayer, the gate electrode and inside of the opening portion by a physical or chemical vapor deposition method, (G) etching back the second conductive layer to form the emitter electrode having a column shape and comprising the second conductive layer in the opening portion, (H) removing at least an upper portion of the side-wall, and (I) attaching and bonding the transparent substrate on which the fluorescent layer and the second electrode layer are formed and the dielectric supporting substrate to each other.

24. The process for the production of a cold cathode field emission display according to claim 23, in which, in the step (H), at least an upper portion of the side-wall is removed such that no side-wall is present on an imaginary line segment connecting a top surface of the emitter electrode and an edge portion of the opening portion formed in the gate electrode.

25. The process for the production of a cold cathode field emission display according to claim 24, in which an end portion of the opening portion formed in the gate electrode is projected over an upper end portion of the opening portion formed in the insulating interlayer.

26. The process for the production of a cold cathode field emission display according to claim 23, in which an acute-angled portion is formed on a top surface of the emitter electrode by etching back the second conductive layer, and the acute-angled portion is constituted of a surface spreading from a pit formed in a central portion of the top surface to a peripheral portion of the top surface and a side surface of the emitter electrode.

27. The process for the production of a cold cathode field emission display according to claim 23, in which the step (G) comprises the steps of forming a mask material layer on at least the second conductive layer; partly removing the mask material layer to leave the mask material layer on the second conductive layer above the opening portion formed in the insulating interlayer; and then, etching back the second conductive layer to form, in the opening portion, the emitter electrode which has the column shape, comprises the second conductive layer and has an acute-angled portion formed on its top surface, and the acute-angled portion comprises a tip end surface projecting toward a central portion of the top surface.

28. The process for the production of a cold cathode field emission display according to claim 27, in which the second conductive layer is etched back under conditions where the etching rate of the second conductive layer is higher than the etching rate of the mask material layer.

29. The process for the production of a cold cathode field emission display according to claim 23, in which the step (D) comprises the steps of forming a resist layer on the insulating interlayer and the gate electrode by a lithography method; forming an opening portion in the gate electrode using the resist layer as an etching mask; and then, further forming an opening portion in the insulating interlayer below the opening portion formed in the gate electrode using the resist layer as an etching mask such that the opening portion reaches the electrode layer.

30. The process for the production of a cold cathode field emission display according to claim 23, in which, the cold cathode field emission device further comprises a focus electrode above the gate electrode through an insulating film, and after the step (C), the process includes the steps of forming the insulating film on at least the gate electrode, and then, forming the focus electrode on the insulating film, and the step (D) comprises the step of forming the opening portion which penetrates through the focus electrode, the insulating film, the gate electrode and the insulating interlayer and has a bottom portion where the electrode layer is exposed.

31. A process for the production of a cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer, and (d) an emitter electrode disposed on the electrode layer positioned in a bottom portion of an opening portion penetrating through the gate electrode and the insulating interlayer and having a column shape, each pixel further comprising;

(e) a second electrode layer and a fluorescent layer formed on a transparent substrate opposite to the emitter electrodes, the process comprising the steps of;

(A) forming the patterned electrode layer on the dielectric supporting substrate, (B) forming the insulating interlayer on the dielectric supporting substrate and the electrode layer, (C) forming the gate electrode comprising a first conductive layer on the insulating interlayer, (D) forming the opening portion which penetrates through at least the insulating interlayer and has a bottom portion where the electrode layer is exposed, (E) forming an insulating material layer on at least the insulating interlayer, the gate electrode and side wall surfaces of the opening portion, to decrease the opening portion in diameter, (F) forming a second conductive layer on the insulating material layer and in the opening portion by a physical or chemical vapor deposition method, (G) etching back the second conductive layer to form the emitter electrode having a column shape and comprising the second conductive layer in the opening portion, (H) removing the insulating material layer, and (I) attaching and bonding the transparent substrate on which the fluorescent layer and the second electrode layer are formed and the dielectric supporting substrate to each other.

32. The process for the production of a cold cathode field emission display according to claim 31, in which an acute-angled portion is formed on the a surface of the emitter electrode by etching back the second conductive layer, and the acute-angled portion is constituted of a surface spreading from a pit formed in a central portion of the top surface to a peripheral portion of the top surface and a side surface of the emitter electrode.

33. The process for the production of a cold cathode field emission display according to claim 31, in which the step (G) comprises the steps of forming a mask material layer on at least the second conductive layer; partly removing the mask material layer to leave the mask material layer on the second conductive layer above the opening portion formed in the insulating interlayer; and then, etching back the second conductive layer to form, in the opening portion, the emitter electrode which has the column shape, comprises the second conductive layer and has an acute-angled portion formed on its top surface, and the acute-angled portion comprises a tip end surface projecting toward a central portion of the top surface.

34. The process for the production of a cold cathode field emission display according to claim 33, in which the second conductive layer is etched back under conditions where the etching rate of the second conductive layer is higher than the etching rate of the mask material layer.

35. The process for the production of a cold cathode field emission display according to claim 31, in which the step (D) comprises the steps of forming a resist layer on the insulating interlayer and the gate electrode by a lithography method; forming an opening portion in the gate electrode using the resist layer as an etching mask; and then, further forming an opening portion in the insulating interlayer below the opening portion formed in the gate electrode using the resist layer as an etching mask such that the opening portion reaches the electrode layer.

36. A process is for the production of a cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer, and (d) an emitter electrode disposed on the electrode layer positioned in a bottom portion of a second opening portion penetrating through the gate electrode and the insulating interlayer and having a column shape, each pixel further comprising;

(e) a second electrode layer and a fluorescent layer formed on a transparent substrate opposite to the emitter electrodes, the process comprising the steps of;

(A) forming the patterned electrode layer on the dielectric supporting substrate, (B) forming the insulating interlayer on the dielectric supporting substrate and the electrode layer, (C) forming the gate electrode comprising a first conductive layer on the insulating interlayer, (D) forming an insulating film on at least the gate electrode, (E) forming a first opening portion which penetrates through the insulating film and has a bottom portion where the gate electrode is exposed, (F) forming a first side-wall of a first insulating material on side walls of the first opening portion, to decrease the first opening portion in diameter, (G) forming the second opening portion which penetrates through the gate electrode and the insulating interlayer below the first opening portion decreased in diameter and has a bottom portion where the electrode layer is exposed, (H) forming a second side-wall of a second insulating material on the first side-wall and side walls of the second opening portion, to further decrease the first opening portion in diameter and to decrease the second opening portion in diameter, (I) forming a second conductive layer on at least the insulating interlayer, the gate electrode, the insulating film and insides of the first and second opening portions by a physical or chemical vapor deposition method, (J) etching back the second conductive layer to form the emitter electrode having the column shape and comprising the second conductive layer in the second opening portion, (K) removing the first side-wall and removing at least an upper portion of the second side-wall, and (L) attaching and bonding the transparent substrate on which the fluorescent layer and the second electrode layer are formed and the dielectric supporting substrate to each other.

37. The process for the production of a cold cathode field emission display according to claim 36, in which, after the step (D), the process includes the step of forming a focus electrode on the insulating film, and the step (E) comprises the step of forming the first opening portion which penetrates through the focus electrode and the insulating film and has a bottom portion where the gate electrode is exposed.

38. The process for the production of a cold cathode field emission display according to claim 36, in which, after the step (D), the process includes the steps of forming a focus electrode on the insulating film, and further forming a second insulating film on at least the focus electrode, and the above step (E) comprises the step of forming the first opening portion which penetrates through the second insulating film, the focus electrode and the insulating film and has a bottom portion where the gate electrode is exposed.

39. The process for the production of a cold cathode field emission display according to claim 36, in which, in the step (K), at least an upper portion of the second side-wall is removed such that no second side-wall is present on an imaginary line segment connecting a top surface of the emitter electrode and an edge portion of the second opening portion formed in the gate electrode.

40. The process for the production of a cold cathode field emission display according to claim 39, in which an end portion of the second opening portion formed in the gate electrode is projected over an upper end portion of the second opening portion formed in the insulating interlayer.

41. The process for the production of a cold cathode field emission display according to claim 36, in which an acute-angled portion is formed on a top surface of the emitter electrode by etching back the second conductive layer, and the acute-angled portion is constituted of a surface spreading from a pit formed in a central portion of the top surface to a peripheral portion of the top surface and a side surface of the emitter electrode.

42. The process for the production of a cold cathode field emission display according to any one of claims 36 to 38, in which the step (J) comprises the steps of forming a mask material layer on at least the second conductive layer; partly removing the mask material layer to leave the mask material layer on the second conductive layer above the second opening portion formed in the insulating interlayer; and then, etching back the second conductive layer to form, in the second opening portion, the emitter electrode having the column shape, comprising the second conductive layer and has an acute-angled portion formed on its top surface, and the acute-angled portion being constituted of a tip end surface projecting toward a central portion of the top surface.

43. The process for the production of a cold cathode field emission display according to claim 42, in which the second conductive layer is etched back under conditions where the etching rate of the second conductive layer is higher than the etching rate of the mask material layer.

44. The process for the production of a cold cathode field emission display according to claim 36, in which the step (G) comprises the step of forming the second opening portion which penetrates through the gate electrode and the insulating interlayer below the first opening portion decreased in diameter and has a bottom portion where the electrode layer is exposed, using the first side-wall as an etching mask.

45. A cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer and comprising a first conductive layer, and (d) an emitter electrode disposed on the electrode layer positioned in a bottom portion of an opening portion penetrating through the gate electrode and the insulating interlayer and having a column shape, and (e) an insulating material which is formed on the dielectric supporting substrate and the electrode layer, and disposed as a side wall between said insulating interlayer and said emitter electrode, in which an acute-angled portion is formed on a top surface of the emitter electrode by etching back the second conductive layer, and the acute-angled portion is constituted of a surface spreading from a pit formed in a central portion of the top surface to a peripheral portion of the top surface and a side surface of the emitter electrode, each pixel further comprising;

(f) a second electrode layer and a fluorescent layer formed on a transparent substrate opposite to the emitter electrode, the emitter electrode being formed, after the gate electrode is formed on the insulating interlayer, by forming the opening portion which penetrates through at least the insulating interlayer and has the bottom portion where the electrode layer is exposed; forming a side-wall of an insulating material on side walls of the opening portion, to decrease the opening portion in diameter; forming a second conductive layer on at least the insulating interlayer, the gate electrode and inside of the opening portion by a physical or chemical vapor deposition method; and then, etching back the second conductive layer.

46. The cold cathode field emission display according to claim 45, in which an acute-angled portion is formed on the top surface of the emitter electrode, and the acute-angled portion is constituted of a tip end surface projecting toward the central portion of the top surface, and the emitter electrode is formed, after the second conductive layer is formed on at least the insulating interlayer, the gate electrode and the inside of the opening portion by a physical or chemical vapor deposition method, by forming a mask material layer on at least the second conductive layer; partly removing the mask material layer to leave the mask material layer on the second conductive layer above the opening portion formed in the insulating interlayer; etching back the second conductive layer; and then, removing at least the upper portion of the side-wall.

47. The cold cathode field emission display according to claim 46, in which the second conductive layer is etched back under conditions where the etching rate of the second conductive layer is higher than the etching rate of the mask material layer.

48. A cold cathode field emission device, comprising;

(a) a patterned electrode layer formed on a dielectric supporting substrate, (b) an insulating interlayer which is formed on the dielectric supporting substrate and the electrode layer, (c) a gate electrode formed on the insulating interlayer and constituted of a first conductive layer, and (d) an emitter electrode disposed on the electrode layer positioned in a bottom portion of an opening portion penetrating through the gate electrode and the insulating interlayer and having a column shape, in which an acute-angled portion is formed on a top surface of the emitter electrode by etching back the second conductive layer, and the acute-angled portion is constituted of a surface spreading from a pit formed in a central portion of the top surface to a peripheral portion of the top surface and a side surface of the emitter electrode, the emitter electrode being formed, after the gate electrode is formed on the insulating interlayer, by forming the opening portion which penetrates through at least the insulating interlayer and has the bottom portion where the electrode layer is exposed; forming a side-wall of an insulating material on side walls of the opening portion, to decrease the opening portion in diameter; forming a second conductive layer on at least the insulating interlayer, the gate electrode and inside of the opening portion by a physical or chemical vapor deposition method; etching back the second conductive layer; and then, removing at least an upper portion of the side-wall.

49. A cold cathode field emission device, comprising;

(a) a patterned electrode layer formed on a dielectric supporting substrate, (b) an insulating interlayer which is formed on the dielectric supporting substrate and the electrode layer, (c) a gate electrode formed on the insulating interlayer and comprising a first conductive layer, and (d) an emitter electrode disposed on the electrode layer positioned in a bottom portion of an opening portion penetrating through the gate electrode and the insulating interlayer and having a column shape, in which an acute-angled portion is formed on a top surface of the emitter electrode by etching back the second conductive layer, and the acute-angled portion is constituted of a surface spreading from a pit formed in a central portion of the top surface to a peripheral portion of the top surface and a side surface of the emitter electrode, the emitter electrode being formed, after the gate electrode is formed on the insulating interlayer, by forming the opening portion which penetrates through at least the insulating interlayer and has the bottom portion where the electrode layer is disposed; forming an insulating material layer on at least the insulating interlayer, gate electrode and side wall surfaces of the opening portion, to decrease the opening portion in diameter; forming a second conductive layer on the insulating material layer and in the opening portion by a physical or chemical vapor deposition method; and then, etching back the second conductive layer.

50. A cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer and comprising a first conductive layer, (d) a focus electrode formed above the gate electrode through an insulating film, (e) a second opening portion which communicates with a first opening portion penetrating through the focus electrode and the insulating film and penetrates through the gate electrode and the insulating interlayer, and (f) an emitter electrode disposed on the electrode layer positioned in a bottom portion of the second opening portion and having a column shape, the emitter electrode being formed, after the gate electrode is formed on the insulating interlayer, by forming the insulating film on at least the gate electrode; forming the focus electrode on the insulating film; forming the first opening portion which penetrates through the focus electrode and the insulating film and has a bottom portion where the gate electrode is exposed; forming a first side-wall of a first insulating material on side walls of the first opening portion, to decrease the first opening portion in diameter; forming the second opening portion which penetrates through the gate electrode and the insulating interlayer below the first opening portion decreased in diameter and has a bottom portion where the electrode layer is exposed; forming a second side-wall of a second insulating material on the first side-wall and side walls of the second opening portion, to further decrease the first opening portion in diameter and to decrease the second opening portion in diameter; forming a second conductive layer on at least the focus electrode and insides of the first and second opening portions by a physical or chemical vapor deposition method; etching back the second conductive layer; and then, removing the first side-wall and removing at least an upper portion of the second side-wall.

51. A cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer and comprising a first conductive layer, (d) a focus electrode formed above the gate electrode through an insulating film, (e) a second opening portion which communicates with a first opening portion penetrating through the focus electrode and the insulating film and penetrates through the gate electrode and the insulating interlayer, and (f) an emitter electrode disposed on the electrode layer positioned in a bottom portion of the second opening portion and having a column shape, the emitter electrode being formed, after the gate electrode is formed on the insulating interlayer, by forming the insulating film on at least the gate electrode; forming the focus electrode on the insulating film; forming a second insulating film on at least the focus electrode; forming the first opening portion which penetrates through the second insulating film, the focus electrode and the insulating film and has a bottom portion where the gate electrode is exposed; forming a first side-wall of a first insulating material on side walls of the first opening portion, to decrease the first opening portion in diameter; forming the second opening portion which penetrates through the gate electrode and the insulating interlayer below the first opening portion decreased in diameter and has a bottom portion where the electrode layer is exposed; forming a second side-wall of a second insulating material on the first side-wall and the side wall of the second opening portion, to further decrease the first opening portion in diameter and to decrease the second opening portion in diameter; forming a second conductive layer on at least the second insulating layer and insides of the first and second opening portions by a physical or chemical vapor deposition method; etching back the second conductive layer; and then, removing the first side-wall and removing at least an upper portion of the second side-wall.

52. A cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer and comprising a first conductive layer, and (d) an emitter electrode disposed on the electrode layer positioned in a bottom portion of an opening portion penetrating through the gate electrode and the insulating interlayer and having a column shape, in which an acute-angled portion is formed on a top surface of the emitter electrode by etching back the second conductive layer, and the acute-angled portion is constituted of a surface spreading from a pit formed in a central portion of the top surface to a peripheral portion of the top surface and a side surface of the emitter electrode, each pixel further comprising;

(e) a second electrode layer and a fluorescent layer formed on a transparent substrate opposite to the emitter electrode, the emitter electrode being formed, after the gate electrode is formed on the insulating interlayer, by forming the opening portion which penetrates through at least the insulating interlayer and has the bottom portion where the electrode layer is disposed; forming an insulating material layer on at least the insulating interlayer, the gate electrode and side walls of the opening portion, to decrease the opening portion in diameter; forming a second conductive layer on the insulating material layer and in the opening portion by a physical or chemical vapor deposition method; and then, etching back the second conductive layer.

53. A cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer and comprising a first conductive layer, (d) an emitter electrode disposed on the electrode layer positioned in a bottom portion of a second opening portion penetrating through the gate electrode and the insulating interlayer and having a column shape, and (e) a second insulating material which is formed on the dielectric supporting substrate and the electrode layer, and disposed as a second side wall between said insulating interlayer and said emitter electrode, each pixel further comprising;

(f) a second electrode layer and a fluorescent layer formed on a transparent substrate opposite to the emitter electrode, the emitter electrode being formed, after the gate electrode is formed on the insulating interlayer, by forming an insulating film on at least the gate electrode; forming a first opening portion which penetrates through the insulating film and has a bottom portion where the gate electrode is exposed; forming a first side-wall of a first insulating material on side walls of the first opening portion, to decrease the first opening portion in diameter; forming the second opening portion which penetrates through the gate electrode and the insulating interlayer below the first opening portion decreased in diameter and has a bottom portion where the electrode layer is exposed; forming the second side-wall of the second insulating material on the first side-wall and on side walls of the second opening portion, to further decrease the first opening portion in diameter and to decrease the second opening portion in diameter; forming a second conductive layer on at least the insulating film and insides of the first and second opening portions by a physical or chemical vapor deposition method; etching back the second conductive layer; and then, removing the first side-wall and removing at least an upper portion of the second side-wall.

54. A cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer and comprising a first conductive layer, (d) a focus electrode formed above the gate electrode through an insulating film, (e) a second opening portion which communicates with a first opening portion penetrating through the focus electrode and the insulating film and penetrates through the gate electrode and the insulating interlayer, and (f) an emitter electrode disposed on the electrode layer positioned in a bottom portion of the second opening portion and having a column shape, each pixel further comprising;

(g) a second electrode layer and a fluorescent layer formed on a transparent substrate opposite to the emitter electrodes, the emitter electrode being formed, after the gate electrode is formed on the insulating interlayer, by forming the insulating film on at least the gate electrode; forming the focus electrode on the insulating film; forming the first opening portion which penetrates through the focus electrode and the insulating film and has a bottom portion where the gate electrode is exposed; forming a first side-wall of a first insulating material on side walls of the first opening portion, to decrease the first opening portion in diameter; forming the second opening portion which penetrates through the gate electrode and the insulating interlayer below the first opening portion decreased in diameter and has a bottom portion where the electrode layer is exposed; forming a second side-wall of a second insulating material on the first side-wall and side walls of the second opening portion, to further decrease the first opening portion in diameter and to decrease the second opening portion in diameter; forming a second conductive layer on at least the focus electrode and insides of the first and second opening portions by a physical or chemical vapor deposition method; etching back the second conductive layer; and then, removing the first side-wall and removing at least an upper portion of the second side-wall.

55. A cold cathode field emission display having a plurality of pixels, each pixel comprising a plurality of cold cathode field emission devices, each cold cathode field emission device comprising;

(a) a patterned electrode layer formed on a dielectric supporting substrate, (b) an insulating interlayer which is formed on the dielectric supporting substrate and the electrode layer, (c) a gate electrode formed on the insulating interlayer and comprising a first conductive layer, (d) a focus electrode formed above the gate electrode through an insulating film, (e) a second opening portion which communicates with a first opening portion penetrating through the focus electrode and the insulating film and penetrates through the gate electrode and the insulating interlayer, and (f) an emitter electrode disposed on the electrode layer positioned in a bottom portion of the second opening portion and having a column shape, each pixel further comprising;

(g) a second electrode layer and a fluorescent layer formed on a transparent substrate opposite to the emitter electrode, the emitter electrode being formed, after the gate electrode is formed on the insulating interlayer, by forming the insulating film on at least the gate electrode; forming the focus electrode on the insulating film; forming a second insulating film on at least the focus electrode; forming the first opening portion which penetrates through the second insulating film, the focus electrode and the insulating film and has a bottom portion where the gate electrode is exposed; forming a first side-wall of a first insulating material on side walls of the first opening portion, to decrease the first opening portion in diameter; forming the second opening portion which penetrates through the gate electrode and the insulating interlayer below the first opening portion decreased in diameter and has a bottom portion where the electrode layer is exposed; forming a second side-wall of a second insulating material on the first side-wall and side walls of the second opening portion, to further decrease the first opening portion in diameter and to decrease the second opening portion in diameter; forming a second conductive layer on at least the second insulating film and insides of the first and second opening portions by a physical or chemical vapor deposition method; etching back the second conductive layer; and then, removing the first side-wall and removing at least an upper portion of the second side-wall.

56. The cold cathode field emission display according to any one of claims 53 to 55, in which no second side-wall is present on an imaginary segment line connecting a top surface of the emitter electrode and an end portion of the second opening portion formed in the gate electrode.

57. The cold cathode field emission display according to any one of claims 53 to 55, in which an end portion of the second opening portion formed in the gate electrode is projected over an upper end portion of the second opening portion formed in the insulating interlayer.

58. The cold cathode field emission display according to any one of claims 53 to 55, in which an acute-angled portion is formed on a top surface of the emitter electrode by etching back the second conductive layer, and the acute-angled portion is constituted of a surface spreading from a pit formed in a central portion of the top surface to a peripheral portion of the top surface and a side surface of the emitter electrode.

59. The cold cathode field emission display according to any one of claims 53 to 55, in which an acute-angled portion is formed on a top surface of the emitter electrode, and the acute-angled portion is constituted of a tip end surface projecting toward a central portion of the top surface, and the emitter electrode is formed, after the second conductive layer is formed by a physical or chemical vapor deposition method, by forming a mask material layer on at least the second conductive layer; partly removing the mask material layer to leave the mask material layer on the second conductive layer above the second opening portion formed in the insulating interlayer; etching back the second conductive layer; and then, removing the first side-wall and removing at least an upper portion of the second side-wall.

60. The cold cathode field emission display according to claim 59, in which the second conductive layer is etched back under conditions where the etching rate of the second conductive layer is higher than the etching rate of the mask material layer.

* * * * *

UNITED STATES PATENT AND TRADEMARK OFFICE

CERTIFICATE OF CORRECTION

PATENT NO. : 6,297,587 B1
DATED : October 2, 2001
INVENTOR(S) : Kazuo Kikuchi et al.

It is certified that error appears in the above-identified patent and that said Letters Patent is hereby corrected as shown below:

Column 52,
Line 49, replace “the a surface” with -- a surface --.

Column 53,
Line 52, delete “through”.

Signed and Sealed this

Second Day of December, 2003

JAMES E. ROGAN
*Director of the United States Patent and Trademark Office*